US007601679B2

(12) United States Patent
Weber et al.

(10) Patent No.: US 7,601,679 B2
(45) Date of Patent: Oct. 13, 2009

(54) PROCESS FOR PRODUCING A HOLLOW BODY WITH A COMPARTMENT, CONTAINING A PORTION OF A WASHING, CLEANING OR RINSING AGENT

(75) Inventors: Henriette Weber, Duesseldorf (DE); Sandra Hoffmann, Duesseldorf (DE); Wilfried Raehse, Duesseldorf (DE); Dieter Jung, Hilden (DE); Frank Meier, Duesseldorf (DE); Christian Block, Cologne (DE); Rolf Bayersdoerfer, Duesseldorf (DE); Markus Semrau, Timmaspe (DE); Karl-Martin Faeser, Duisburg (DE); Paul Birnbrich, Solingen (DE); Dieter Nickel, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 12/185,098

(22) Filed: Aug. 3, 2008

(65) Prior Publication Data

US 2008/0312123 A1 Dec. 18, 2008

Related U.S. Application Data

(62) Division of application No. 10/333,067, filed as application No. PCT/EP01/07633 on Jul. 4, 2001, now Pat. No. 7,417,019.

(30) Foreign Application Priority Data

| | | |
|---|---|---|
| Jul. 14, 2000 | (DE) | 100 33 827 |
| Sep. 29, 2000 | (DE) | 100 48 448 |
| Nov. 25, 2000 | (DE) | 100 58 647 |
| Feb. 20, 2001 | (DE) | 101 07 878 |

(51) Int. Cl.
*C11D 17/04* (2006.01)
*C11D 17/00* (2006.01)
*C11D 3/395* (2006.01)

(52) U.S. Cl. ..... 510/445; 510/439; 510/220; 510/276; 510/296; 510/367

(58) Field of Classification Search ..... 510/445, 510/439, 276, 220, 296, 367
See application file for complete search history.

(56) References Cited

U.S. PATENT DOCUMENTS

| | | | | |
|---|---|---|---|---|
| 3,234,258 | A | 2/1966 | Morris | |
| 3,663,449 | A * | 5/1972 | Susuki et al. | 510/293 |
| 3,927,195 | A | 12/1975 | Messora | |
| 4,001,211 | A | 1/1977 | Sarkar | |
| 4,664,839 | A | 5/1987 | Rieck | |
| 4,828,745 | A | 5/1989 | Jeschke et al. | |
| 4,913,832 | A | 4/1990 | Kruse et al. | |
| 4,973,416 | A | 11/1990 | Kennedy | |
| 5,075,041 | A | 12/1991 | Lutz | |
| 5,356,607 | A | 10/1994 | Just | |
| 5,759,974 | A | 6/1998 | Menke et al. | |
| 6,133,214 | A | 10/2000 | Jung et al. | |
| 6,699,826 | B1 * | 3/2004 | Saijo et al. | 510/296 |
| 6,737,390 | B2 | 5/2004 | Sunder et al. | |
| 2003/0108705 | A1 * | 6/2003 | Duffield et al. | 428/36.6 |

FOREIGN PATENT DOCUMENTS

| | | |
|---|---|---|
| CA | 2053900 | 10/1990 |
| CA | 2066226 | 3/1991 |
| CA | 2304527 | 2/2000 |
| CA | 2338658 | 2/2000 |
| CA | 2338711 | 2/2000 |
| CA | 2312157 | 12/2000 |
| DE | 2007413 | 8/1970 |
| DE | 2022927 | 11/1970 |
| DE | 1954244 | 5/1971 |
| DE | 2065153 | 10/1972 |
| DE | EP 0003769 | 9/1979 |
| DE | 3929973 | 3/1991 |
| DE | 4301358 | 8/1993 |
| DE | 19831703 | 1/2000 |
| DE | 19834172 | 2/2000 |
| DE | 19834180 | 2/2000 |
| DE | 19834181 | 2/2000 |
| DE | 19961661 | 12/2000 |
| DE | 19941480 | 3/2001 |
| EP | 0132726 | 2/1985 |
| EP | 0507404 | 10/1992 |
| EP | 0593952 | 4/1994 |
| EP | 0801107 | 10/1997 |
| EP | 0941939 | 9/1999 |
| EP | 1059350 | 12/2000 |
| EP | 1072675 | 1/2001 |

(Continued)

OTHER PUBLICATIONS

Patent Abstracts of Japan, vol. 1998, No. 08 JP 10057431 (1998).

(Continued)

*Primary Examiner*—Lorna M Douyon
(74) *Attorney, Agent, or Firm*—John S. Child, Jr.

(57) ABSTRACT

A process for producing a detergent portion, comprising the steps of forming one or more dimensionally stable hollow bodies comprising at least one compartment by injection moulding, providing one or more means for compartmentalizing the dimensionally stable hollow bodies, filling the compartment with at least one detersive formulation, and closing the compartment to form a partial or whole enclosure around the detersive formulation.

16 Claims, No Drawings

FOREIGN PATENT DOCUMENTS

| | | | | |
|---|---|---|---|---|
| EP | 0703292 | | | 4/2001 |
| FR | 2724388 | | | 3/1996 |
| GB | 1307387 | | | 2/1973 |
| GB | 2356842 | | | 6/2001 |
| GB | 2356842 | A | * | 6/2001 |
| GB | 2361010 | | | 10/2001 |
| GB | 2361010 | A | * | 10/2001 |
| JP | 58217598 | | | 12/1983 |
| JP | 60166400 | | | 8/1985 |
| JP | 61086933 | | | 5/1986 |
| JP | 1057431 | | | 3/1998 |
| WO | WO90/13533 | | | 11/1990 |
| WO | WO91/81171 | | | 6/1991 |
| WO | WO93/08095 | | | 4/1993 |
| WO | WO97/08244 | | | 3/1997 |
| WO | WO97/35955 | | | 10/1997 |
| WO | WO99/37746 | | | 7/1999 |
| WO | WO01/00781 | | | 1/2001 |
| WO | WO01/36290 | | | 5/2001 |
| WO | WO01/83669 | | | 11/2001 |

OTHER PUBLICATIONS

CFTA International Cosmetic Ingredient Dictionary and Handbook, 5th Edition, The Cosmetic, Toiletry and Fragrance Association, Washington (1997).

Von Bruchhausen, F., eta l. Hagers Hanbuch, der pharmazeutischen Praxis ISBN: 3.540-52459-2), pp. 802-814; 34 pages of translation enclosed.

Annex D3, "claro 3-Phasen Tabs", Opposistion to EP 1305396, Opponent—Reckitt Benckiser (UK) LTD printed Nov. 8, 2005.

Annex D4, "A&P Tabletten", Opposition to EP 1305396, Opponent—Reckitt Benckiser (UK) LTD, printed Nov. 8, 2005.

Annex D5, "Somat 2 in 1 Tabletten", Opposition to EP 1305396, Opponent—Reckitt Benckiser (UK) LTD, printed Nov. 8, 2005.

Annex D6, "Frisch Aktiv Premium", Opposition to EP 1305396 Opponent—Reckitt Benckiser (UK) LTD,printed Nov. 8, 2005.

Annex D7 "Fairy Tab in Tab", Opposition to EP 1305396 Opponent—Reckitt Benckiser (UK) LTD,printed Nov. 11, 2005.

Annex D8 "Analysis of Marketed Detergent Products from year 2000" Opposition to EP 1305396 Opponent—Reckitt Benckiser (UK) LTD.

L. Eith, R.F.T Stepto, I. Tomka, F. Wittwer, "The Injection Moulded Capsule" in Drug Development and Idustrial Pharmacy, 12 (11-13)2113-2126, Copyright Marcel Dekker Inc. 1986.

L. Eith, R.F.T. Stepto, I. Tomka, F. Wittwere, "Injection Molded Drug Delivery Systems", Manufacturing Chemicstry, Jan. 1987 pp. 21-25.

Robert, F.T. Stepto, Invan Tomka, "Injection Moulding of Natural Hydrophili Polymers in the Presence of Water", Chimia, 41 (1987) Hydrophilic Polymers in the Prescense of Water, Chimia 41 (1987) Nr. (Marz), p. 76-81.

D.J., Burns, D. Corness, G. Hay, S. Higginbottom, I. Whelan, D. Attwood, S.G. Barnwell, "An in vitro assessment of liquid-filled Capill potato starch capsules with biphasic release characteristics" International Journal of Pharmaceutics, 134 (1996) pp. 223-230.

Rompp Lexikon Chemie, Version 2.0 Stuttgart/New York, Georg Thieme Verlag, 1999.

* cited by examiner

PROCESS FOR PRODUCING A HOLLOW BODY WITH A COMPARTMENT, CONTAINING A PORTION OF A WASHING, CLEANING OR RINSING AGENT

This application is a divisional application of U.S. patent application Ser. No. 10/333,067, filed Jul. 16, 2003, now U.S. Pat. No. 7,417,019, which is a National Phase Filing under 35 U.S.C. 371 of International Application No. PCT/EP01/07633, filed Jul. 4, 2001 and designating the United States and other countries. This application also claims priority under 35 U.S.C. Section 119 of German Patent Application Nos. DE 100 33 827.5, filed Jul. 14, 2000, DE 100 48 448.4, filed Sep. 29, 2000, DE 100 58 647.3, filed Nov. 25, 2000, and DE 101 07 878.1, filed Feb. 20, 2001.

The present invention relates to detergent portions which are present within dimensionally stable hollow bodies comprising at least one compartment. The invention also relates to processes for producing such compartmented hollow bodies comprising detergent portions. The invention further relates to laundering, cleaning, and washing methods in which the detergent formulations are dosed in dimensionally stable hollow bodies having one or more separate compartments.

In the prior art it is extensively described how detergents have to date been made available to the consumer customarily in the form of spray-dried or granulated solid products or as liquid product. In accordance with the consumer's desire for easy dosing possibilities, the two conventional variants mentioned have been joined on the market by products in preportioned form, which are established and are likewise extensively described in the prior art. Descriptions can be found of detergents in the form of compressed shaped bodies, i.e., tablets, blocks, briquettes, rings, and the like, and also of pouch-packaged portions of solid and/or liquid detergents.

In the case of the single-dose amounts of detergents which are sold packaged in pouches, water-soluble film pouches are prevalent. They remove the need for the consumer to tear open the packaging. This enables an individual portion, sized for one washing or cleaning operation, to be dosed easily by inserting the pouch directly into the washing machine or dishwasher, especially into its rinse-in compartment, or by casting the pouch into a defined amount of water, in a bucket, bowl or basin, for example. The pouch surrounding the detergent portion dissolves without residue on reaching a certain temperature. Detergents packaged in water-soluble film pouches are also described in large number in the prior art. For instance, the earlier patent application DE 198 31 703 discloses a portioned detergent formulation in a pouch made of water-soluble film, in particular in a pouch made of (optionally acetalized) polyvinyl alcohol (PVAL), in which at least 70% by weight of the particles of the detergent formulation have sizes >800 μm. Pouches of this kind are indeed very consumer-friendly and facilitative of dosing but are not in all cases the appropriate form for dosing detergent formulations, especially when solid and liquid detersive formulations are to be dosed alongside one another. Furthermore, such pouches do not allow the incorporation of detergent formulations present in unstable or highly volatile phases into the detergent portion.

The document DE-A 20 65 153 describes shaped surfactant bodies which comprise a plurality of components and are composed of an outer shell of sodium silicate with laundry detergent components enclosed therein. The silicate shell is produced by compression molding in two hemispheres which, after they have been filled with the amount of laundry detergent components sufficient for one wash, are placed together and joined to form the shaped body. The process is extremely impractical and does not lead to utilizable laundry detergent portions.

The document DE-A 20 07 413 describes detergent shapes comprising a core of one or more laundry detergent components and a shell of compression-molded envelope material composed predominantly of sodium metalilicate. The compression of the envelope material to form half-shells and the filling and welding of the half-shells to form the finished shape require a complex technology, and many of the shapes fragment before they reach the laundering operation.

The documents DE-A 198 34 181, DE-A 198 34 180 and DE-A 198 34 172 describe detergent/limescale remover formulations comprising a tablet which is produced by compression molding, is composed of two identical halves, and comprises one or more detergent components, and a core which is provided where appropriate with an additional envelope and comprises a further detergent component. Aside from the fact that in this case too the only possible production process is complex and involves a number of stages, only a solid core can be incorporated into the tablet envelope unless premature dissolution of the tablet from the inside is to be initiated.

The invention was based on the object of providing detergent formulations in which readily volatile detersive components can be formulated alongside less volatile detersive components or in which mechanically unstable components can be incorporated without detriment to their integrity—during compression to form shaped bodies, for example. The invention was additionally based on the object of separating detergent components physically from one another while still formulating them in the same detergent portion, with the aim of minimizing any exchange of substances or any mutual impairment, which under certain circumstances might be connected with losses in activity. This would also have the advantage that the storage stability of the detergent formulations could be considerably increased and also that the concentration of active substance could be lowered in individual cases, since in the prior art, in connection with the calculation of these concentrations, it has always been necessary to provide an overdose owing to an expected loss of activity on the part of some components.

Surprisingly it has now been found that detergent portions can be filled into dimensionally stable hollow bodies having one or more separate compartments, so making it possible to provide dose amounts of the respective compositions which have considerable performance advantages as compared with compact shaped bodies or pouch-packaged formulations.

The invention relates to a detergent portion which is present in one or more dimensionally stable hollow bodies comprising at least one compartment and which comprises:

(a) at least one detersive formulation;

(b) at least one enclosure which wholly or partly surrounds at least one formulation according to (a) and comprises an unpressed material which can disintegrate under laundering, cleaning or washing conditions and which gives the hollow body(ies) dimensional stability; and (c) if desired, one or more means for compartmentalizing the dimensionally stable hollow body(ies).

The invention further relates to a process for producing a detergent portion present in one or more dimensionally stable hollow bodies comprising at least one compartment in accordance with the detailed description above and below, which comprises the steps whereby one or more dimensionally stable hollow bodies are produced conventionally, with the exception of hollow body production processes involving compression, this (these) hollow body(ies) is (are) provided, where appropriate, with one or more means for compartmentalizing the dimensionally stable hollow body(ies) and the compartment(s) is (are) filled with at least one detersive formulation, and subsequently, where appropriate, the dimensionally stable hollow body(ies) is (are) closed to form a partial or whole enclosure around the detersive formulation(s).

The invention also relates to a laundering process, especially process for machine laundering in a commercially customary washing machine, which comprises the steps whereby

- a detergent portion according to the detailed description above and below is introduced into the washing machine, especially into its rinse-in compartment or washing drum;
- the desired laundering conditions are set; and
- when the conditions come about the detersive formulation(s) of the detergent portion is (are) released into the laundering liquor and contacted with the material to be laundered.

The invention also relates to a cleaning process which comprises the steps whereby

- a detergent portion according to the detailed description above and below is introduced into the cleaning liquor;
- the desired cleaning conditions are set; and
- when the conditions come about the detersive formulation(s) of the detergent portion is (are) released into the cleaning liquor and contacted with the material to be cleaned.

The invention also relates to a washing process, especially process for machine washing in a commercially customary dishwasher, which comprises the steps whereby

- a detergent portion according to the detailed description above and below is introduced into the dishwasher, especially into its rinse-in compartment or wash chamber;
- the desired wash conditions are set; and
- when the conditions come about the detersive formulation(s) of the detergent portion is (are) released into the wash liquor and contacted with the material to be washed.

The term "detergent portion" refers in the context of the present invention to an amount of a laundry detergent, cleaning product or dishwash detergent which is sufficient for a laundering, cleaning or washing operation which takes place in an aqueous phase. This may be, for example, a machine laundering, cleaning or washing operation such as is carried out with commercially customary washing machines or dishwashers. In accordance with the invention, however, this term also comprehends a hand wash or manual dish wash operation (carried out, for example, in a hand washbasin or in a bowl) or any other process of laundering or cleaning. Preferably in accordance with the invention the detergent portions are employed in machine laundering, cleaning or washing operations.

The term "detergent subportion" refers in the context of the present invention to a fractional amount of a detergent portion which is present in a separate phase from other detergent subportions but in spatial communication with other detergent subportions of the same detergent portion, for example, in a separate compartment in a dimensionally stable hollow body according to the invention, and which by means of appropriate measures has been formulated so that it can be introduced into the liquor separately from other detergent subportions of the same detergent portion and, where appropriate, dissolved and/or suspended in said liquor. It is possible here for a detergent subportion to contain the same ingredients as another detergent subportion of the same detergent portion, preferably, however, two detergent subportions of the same detergent portion contain different ingredients, especially different detersive formulations.

In accordance with the invention, the detergent portions contain measured amounts of at least one detersive formulation, usually measured amounts of two or more detersive formulations. It is possible here for the portions to contain only detersive formulations of one particular composition. In accordance with the invention it is preferred, however, for two or more, usually at least two, detersive formulations of different composition to be present in the detergent portions. The composition may be different in terms of the concentration of the individual components of the detersive formulation (quantitative) and/or in terms of the nature of the individual components of the detersive formulation (qualitative). It is particularly preferred for the components to be adapted in terms of nature and concentration to the tasks which the detergent subportions are required to fulfill in the laundering, cleaning or washing operation.

The term "detersive formulation" refers in the context of the present invention to formulations of all conceivable substances that are relevant in the context of a laundering or cleaning or washing operation. These substances are, primarily, the laundry detergents or cleaning products or washing detergents themselves, with their individual components as elucidated further in the ongoing course of the description. They include active substances such as surfactants (anionic, nonionic, cationic, and amphoteric surfactants), builders (organic and inorganic builders), bleaches (such as peroxo bleaches and chlorine bleaches, for example), bleach activators, bleach stabilizers, bleach catalysts, enzymes, special polymers (those having cobuilder properties, for example), graying inhibitors, dyes, and fragrances (perfumes), without the term being limited to these groups of substances.

The term "detersive formulations" also refers, however, to laundering assistants and cleaning assistants or washing assistants. Examples of these are optical brighteners, UV stabilizers, soil repellents, i.e., polymers which counter resoiling of fibers or hard surfaces (including kitchen- and tableware), and also silver protectants, colorants, and decolorants. Laundry treatment compositions such as fabric softeners and dishwashing composition additives such as rinse aids are also regarded in accordance with the invention as detersive formulations.

In accordance with the invention the detergent portions are present in one or more dimensionally stable hollow bodies comprising at least one compartment. The precise shape of the hollow body in this context is as uncritical as its size; the only proviso in this respect is that shape and size are in agreement with the subsequent use, i.e., use in a laundering, cleaning or washing process, especially in standard washing machines or dishwashers. Hollow bodies in sphere, ellipsoid, cube, cuboid, trapezoid, cone or pyramid or trochoid form are conceivable; cuboidal or trochoidal hollow bodies have been found to be best suited to the invention and can therefore be used with advantage.

In preferred embodiments of the invention the size of the hollow bodies is such that the hollow bodies can be introduced into the rinse-in compartment of a commercially customary washing machine or dishwasher, in nets or bags or the like which are washed along with the laundry. Particularly preferred embodiments of the detergent portions of the invention do not exceed a length (longest axis) of 10 cm, while the sizes of the width and the height are much lower, for example, from 1 to 5 cm.

The term "dimensionally stable hollow body" is understood in accordance with the invention to mean that the shaped bodies containing the detergent portions have an intrinsic dimensional stability which enables them, under normal conditions of production, storage, transit, and handling by the consumer, to have a structure which is stable toward fracture and/or pressure and which does not collapse, and which also does not change under said conditions over prolonged periods of time. It is irrelevant here in accordance with the invention whether this structural stability results solely from the properties of the dimensionally stable hollow body which come about as a result of various parameters, specified below, or (also) from the presence of compartmentalization means and/or (also) from the filling with detersive formulations. In preferred embodiments of the invention the dimensionally stable hollow bodies themselves already have a sufficient intrinsic dimensional stability, since this has advantageous consequences for passage in machines in the course of the manufacture of the hollow bodies and in the course of filling during production of the detergent portions of the invention.

The pressure resistance of the dimensionally stable hollow bodies in accordance with the invention is measured in the manner (customary per se) such that unfilled hollow bodies which have been provided where appropriate with compartmentalization means are sealed with films or lids and at room temperature a steadily increasing internal vacuum is applied to these hollow bodies until the hollow body begins to collapse. The intrinsic dimensional stability of the hollow bodies should with particular preference be such that in the case of vacuum collapse tests of this kind, unfilled hollow bodies provided where appropriate with compartmentalization means do not begin to collapse before a vacuum of 900 mbar, preferably of 750 mbar, and in particular of 500 mbar, is reached. In this respect the hollow bodies used in accordance with the invention are fundamentally different from films or pouches such as are likewise used to provide detergents. These films or pouches collapse even under a pressure which is only slightly below atmospheric pressure. Similarly, however, the dimensionally stable hollow bodies of the invention are also different from coatings (applied subsequently to shaped bodies): the hollow bodies of the invention constitute an independent, self-supporting envelopment which generally exists prior to filling with one or more detersive components and which is subsequently filled. In contrast thereto, coatings are applied to already existing shaped bodies (e.g., compressed bodies, granules, extrudates, etc.) and are then dried and/or cured; only then do they form an envelopment surrounding the shaped body.

It is particularly preferred in accordance with the invention if the walls of the hollow bodies used in accordance with the invention—in the same way as the compartmentalization means that are to be elucidated in detail later on—further form an effective diffusion barrier, particularly to substances which adversely affect the detersive formulations, particularly gaseous substances, and especially water vapor. The maximum possible quantity of water vapor diffusion should be preferably 350 g/($m^2$*24 h), more preferably only 100 g/($m^2$*24 h), more preferably still 50 g/($m^2$*24 h).

Particularly inventively preferred embodiments of the detergent portions in the dimensionally stable hollow bodies also allow that with particular advantage—although not mandatorily—it be possible for the portions present in the hollow bodies to be fed into the aqueous liquor as a result of a—preferably controllable—water-solubility of the hollow body material at a certain point in time during the laundering, cleaning or washing operation or on attainment of a certain pH or a certain ionic strength of the wash liquor or else on the basis of other controllable events or conditions. The quality of the material and its quantity/strength exert a direct influence on these solubility properties. Given a certain wall thickness, which is a codeterminant of the stability, particular preference is given to hollow body materials which dissolve in the aqueous liquor at defined temperatures, pH values, ionic strengths, or after a particular residence time. A dissolution procedure of this kind may embrace the hollow body as a whole or only part of it, such that parts of the hollow body dissolve when a certain combination of parameters is set while other parts do not dissolve yet (instead dissolving later) or else do not at all. This can be achieved by making the quality of the material different and also by means of different quantities of material (wall thickness) or else different geometries of the hollow bodies. By way of example, it is possible to make ingress of water more difficult by means of the hollow body geometry and so to retard the dissolution process. In another preferred embodiment it is possible to design hollow body walls of different thickness (but of the same material) and so to allow earlier dissolving in the thinner areas. In embodiments which are likewise preferred it is possible to produce the walls of the hollow body from materials differing in water-solubility—for example, from polyvinal alcohols (PVAL) with different residual acetate contents. This leads to the formation of perforated walls which allow water to penetrate into the hollow body and/or the dissolved or else undissolved ingredients to emerge from the hollow body.

Furthermore, it is possible for the materials of the walls of the dimensionally stable hollow bodies to be composed of an active detersive substance, of which PVAL, as a builder, is one example, or to comprise such a substance. In the last-mentioned case it is possible, for example, for active detersive substances, which are present only in small amounts in the formulations and whose uniform incorporation is therefore not unproblematic, to be incorporated into the wall material of the hollow body or into part of the wall material of the hollow body, for example, a part which dissolves in the particular stage of the laundering, cleaning or washing cycle in which the active substance is required, and to be released into the liquor at the right moment when the wall material dissolves. One example of this might be fragrances, which are wanted in the final phase of the laundering or cleaning or washing operation, but also optical brighteners, UV stabilizers, dyes, and other detersive formulations. The basic principle of incorporating such components (which are normally incorporated in small amounts) into the materials which form the enclosure of the detergent portions is apparent from the applicant's co-pending patent application 199 29 098.9, entitled "Active substance portion pack", the disclosure content of which is incorporated by reference in its entirety into the disclosure content of the present application.

In one particular embodiment of the invention it is also possible for the walls of the dimensionally stable hollow bodies which comprise the detergent portions to be composed of different materials, i.e., to have a heterogeneous structure. By way of example, in a polymer material forming the wall of the hollow bodies it would be possible for there to be dispersed islands of a foreign material, insoluble in the polymer, composed, for example, of a different polymer (with different water-solubility) or even from an entirely different substance (for example, an organic or inorganic substance). Examples thereof are water-soluble salts such as, for example, sodium sulfate, sodium chloride, sodium carbonate, calcium carbonate, etc.; organic acids such as, for example, citric acid, tartaric acid, adipic acid, phthalic acid, etc.; sugars such as maltoses, dextroses, sorbitol, etc.; zeolites; silicates; crosslinked polymers, with low degrees of crosslinking, for example, such as, for example, polyacrylates, cellulose esters, cellulose ethers such as carboxymethylcellulose. In particularly preferred embodiments of the invention a structure of this kind may be associated with the advantage that the different substance dissolves more rapidly in water than the polymer, so allowing water to penetrate into the hollow body and thereby contributing to the accelerated release of detersive components of the portion. Another overall effect of such formulating is that the dimensionally stable hollow body as a whole dissolves more rapidly than a shaped body made from a single polymer material. Similarly, it is possible to form the walls of the hollow bodies from layers of two or more polymers, which in particularly preferred embodiments can be chosen so as to complement one another optimally in terms of their properties (stability, heat resistance, water-solubility, gas barrier properties, etc.).

In one particularly preferred embodiment of the invention one detergent portion comprises a dimensionally stable hollow body comprising an enclosure which wholly or partly surrounds at least one detersive formulation and which comprises an unpressed material which is disintegrable under laundering, cleaning or washing conditions and comprises at least one compartment, the compartment(s) comprising one or more detersive formulations.

In the embodiment mentioned one hollow body comprises at least one compartment, in other words a chamber, in its interior. A chamber or compartment of this kind is a space generally bounded by walls (in the case of only one compartment, these are the walls of the hollow body). Within the walls of the dimensionally stable hollow body in accordance with the invention, however, it is also possible for there to be a plurality of spaces. These may be formed either by virtue of individual spaces being delimited from one another by walls, which in the context of the present invention are referred to as "compartmentalization means" and spatially separate the same or different detersive components or formulations from one another, or of different detersive components or compositions bordering one another directly but not mixing with one another. In such a case the boundaries (phase boundaries) of the adjacent components or compositions are, so to speak, the compartmentalization means. The chamber or compartment is surrounded wholly or partly, preferably wholly, by the enclosure comprising an unpressed material which is disintegrable under laundering, cleaning or washing conditions and which forms the wall of the dimensionally stable hollow body. Present in the compartment or chamber is/are one or more detersive formulations. In the majority of embodiments of the invention one compartment advantageously comprises two or more detersive formulations; also conceivable, however, is the case where only one such formulation is present in a compartment or chamber.

In one particularly preferred embodiment of the invention the interior of the dimensionally stable hollow body comprises two or more compartments or chambers each of which contains one or more detersive formulations. Examples thereof are cuboidal or trochoidal dimensionally stable hollow bodies which have two, three or four or even more compartments each containing one or more detersive formulations. A great advantage of this embodiment of the invention is that the various detersive formulations can be distributed between the compartments in the manner best suited to the specific requirements. Thus it is possible for components which would adversely affect one another in their activity (for example, enzymes, alkali, bleach, etc.) or which would otherwise—owing, for example, to the aggregate state—mix with one another (solid and liquid components, for example) to be physically separated from one another. It is also possible for components which ought optimally to be released into the respective liquor at different points in time during the laundering, cleaning or washing operation to be separated physically from one another and each introduced into the liquor at the optimum point in time.

The size and shape of the individual compartments within a dimensionally stable hollow body is not critical and can largely be geared to the necessities of the particular case. Thus, for certain detersive formulations or mixtures which are present in fairly large amounts, larger compartments can be provided than for formulations which are present only in a small amount. In other embodiments of the invention, which can be employed with advantage, mixtures of certain formulations which are provided at the beginning of the laundering, cleaning or washing cycle and are present in defined amounts can be physically separated from other components, or from components required in different amounts, and can be disposed in compartments of a different size.

In one particularly preferred embodiment of a detergent portion present within a dimensionally stable hollow body comprising at least one, preferably two or more compartment(s), the hollow body embraces two or more compartments which contain one or more detersive formulations and are disposed embracing one another.

Within the hollow body, therefore, the compartments with the detersive formulation(s) are disposed not adjacent to one another or above/below one another but instead embracing one another, for example, more or less concentrically ("onion model") or more or less coaxially ("multilayer rod model") or such that the innermost compartment is fully surrounded by the next outward compartment, which in turn is fully surrounded by the subsequent compartment where present, and so on. In such a case the detersive substances may be distributed between the compartments in such a way that the components required first in the laundering, cleaning or washing operation are present in the outermost compartment, which is the first to be exposed to the ingress of water or liquor, while (a) component(s) required later is/are disposed in (a) compartment(s) situated further inward and is/are protected against the ingress of water by the compartments situated further outward. In the context of this embodiment it is not necessary for the inwardly sited compartments to be completely embraced by the outer compartments; a partial embracement is likewise within the scope of the present invention.

In accordance with a further preferred embodiment the invention relates to a detergent portion which comprises two or more dimensionally stable hollow bodies comprising an enclosure which wholly or partly surrounds at least one detersive formulation and comprises one or more unpressed materials which are disintegrable under laundering, cleaning or washing conditions and each comprise at least one compartment, the compartment(s) containing one or more detersive formulations.

The size, shape and arrangements of the compartment(s) and of the at least one detersive formulation may be configured in exactly the same way as in the context of the embodiments described above; in other words, in one dimensionally stable hollow body there may be one or more compartments of any desired shape and size each with one or more detersive formulations. In the present case, however, two or more such dimensionally stable hollow bodies are present together.

In one preferred embodiment in this context the two or more dimensionally stable hollow bodies are composed of two or more different materials or (optionally similar) materials having different properties, which—with particular advantage—are disintegrable under laundering, cleaning or washing conditions. Such hollow body materials include, but are not restricted to, one or more water-soluble polymers, preferably one or more materials from the group consisting of (optionally acetalized) polyvinyl alcohol (PVAL), polyvinylpyrrolidone, polyethylene oxide, gelatin, cellulose, and their derivatives and their mixtures, more preferably (optionally acetalized) polyvinyl alcohol (PVAL).

In a further, likewise preferred embodiment, it is of advantage in accordance with the invention if the dimensionally stable hollow body(ies) comprises/comprise one or more materials from the group consisting of acrylic acid polymers, polyacrylamides, oxazoline polymers, polystyrenesulfonates, polyurethanes, polyesters and polyethers, and mixtures thereof.

With particular advantage it is possible to specify one or more materials from the following exemplary but nonlimiting list:

- mixtures of from 50 to 100% polyvinyl alcohol or poly (vinyl alcohol-co-vinyl acetate) with molecular weights in the range from 10 000 to 200 000 g/mol and acetate contents of from 0 to 30 mol %; these mixtures may include processing additives such as plasticizers (glycerol, sorbitol, water, PEG, etc.), lubricants (stearic acid and other mono-, di, and tricarboxylic acids), slip agents, as they are known (e.g., "Aerosil"), organic and inorganic pigments, salts, blowmolding agents (citric acid-sodium bicarbonate mixtures);
- acrylic acid polymers, such as copolymers, terpolymers or tetrapolymers, for example, which contain at least 20% acrylic acid and possess a molecular weight of from 5000 to 500 000 g/mol; particularly preferred comonomers include acrylic esters such as ethyl aerylate, methyl aerylate, hydroxyethyl acrylate, ethylhexyl acrylate, butyl acrylate, and salts of acrylic acid such as sodium acrylate, methacrylic acid and its salts and the esters thereof such as methyl methacrylate, ethyl methacrylate, trimethylammonium methyl methacrylate chloride (TMAEMC), methacrylateamidopropyltrimethylammonium chloride (MAPTAC). Further monomers such as acrylamide, styrene, vinyl acetate, maleic anhydride, vinylpyrrolidone can likewise be used with advantage;
- polyalkylene oxides, preferably polyethylene oxides having molecular weights of from 600 to 100 000 g/mol and their derivatives modified by graft copolymerization with monomers such as vinyl acetate, acrylic acid and its salts and the esters thereof, methacrylic acid and its salts and the esters thereof, acrylamide, styrene, styrenesulfonate, and vinylpyrrolidone (example: poly(ethylene glycol-graft-vinyl acetate). The polyglycol fraction should be from 5 to 100% by weight, the graft fraction should be from 0 to 95% by weight; the latter may be composed of one or of two or more monomers. Particular preference is given to a graft fraction of from 5 to 70% by weight; the water-solubility falls with the graft fraction;
- polyvinylpyrrolidone (PVP) having a molecular weight of from 2500 to 750 000 g/mol;
- polyacrylamide having a molecular weight of from 5000 to 5 000 000 g/mol;
- polyethyloxazoline and polymethyloxazoline having a molecular weight of from 5000 to 100 000 g/mol;
- polystyrenesulfonates and their copolymers with comonomers such as ethyl(meth)acrylate, methyl (meth)acrylate, hydroxyethyl(meth)acrylate, ethylhexyl(meth) acrylate, butyl(meth)acrylate and the salts of (meth) acrylic acid such as sodium (meth)acrylate, acrylamide, styrene, vinyl acetate, maleic anhydride, vinylpyrrolidone; the comonomer content ought to be from 0 to 80 mol % and the molecular weight ought to be situated within the range from 5000 to 500 000 g/mol;
- polyurethanes, particularly the reaction products of diisocyanates (e.g., TMXDI) with polyalkylene glycols, especially polyethylene glycols of molecular weight from 200 to 35 000, or with other difunctional alcohols to give products having molecular weights of from 2000 to 100 000 g/mol;
- polyesters having molecular weights of from 4000 to 100 000 g/mol, based on dicarboxylic acids (e.g., terephthalic acid, isophthalic acid, phthalic acid, sulfoisophthalic acid, oxalic acid, succinic acid, sulfosuccinic acid, glutaric acid, adipic acid, sebacic acid, etc.) and diols (e.g., polyethylene glycols, with molecular weights, for example, of from 200 to 35 000 g/mol);
- cellulose ethers/esters, e.g., cellulose acetates, cellulose butyrates, methylcellulose, hydroxypropylcellulose, hydroxyethylcellulose, methylhydroxypropylcellulose, etc.;
- polyvinyl methyl ethers having molecular weights of from 5000 to 500 000 g/mol.

In accordance with the invention the enclosure surrounding the at least one detersive formulation is composed of an unpressed material which imparts dimensional stability to the hollow body. By "unpressed" material is meant in accordance with the invention a material which is not produced—as in the state of the art—by compression of (for example) detersive components or formulations to give a compact into which other detersive components or formulations are then embedded but instead by any other desired shaping techniques, such as are elucidated in detail below. By way of example mention may be made of thermoforming, casting, injection molding, sintering, etc. In the case of inorganic materials, which may likewise be used, casting as well may be a preferred mode of production.

In a further preferred embodiment of the invention the two or more dimensionally stable hollow bodies may be composed of two or more different materials which may be chosen, for example, from the materials listed above, but may also comprise different materials. Where two or more dimensionally stable hollow bodies are present it is possible with particular advantage for the walls of these hollow bodies to be composed of two or more similar materials, examples being materials made from the same monomeric units, but materials having different properties. Examples thereof may be similar materials having different molecular weight (and thus different solubility), PVAL materials having a different degree of acetalization (and hence different solubility and/or different dissolution temperature in water), materials with a different proportion of grafted-on co-monomers, or the like.

A further preferred embodiment is that in which, where two or more dimensionally stable hollow bodies are present, these dimensionally stable hollow bodies have a different geometrical shape. This may lead advantageously to a different dissolution behavior or different release kinetics of the detergent portion present within the compartment(s) of the hollow bodies.

Preference is further given to an embodiment of the detergent portions of the invention in which the two or more dimensionally stable hollow bodies form an assembly—which with particular preference but not imperatively is partable. An assembly of two or more dimensionally stable hollow bodies can be used with particular advantage either if detergent portions of different composition are to be metered (e.g., heavy-duty laundry detergents and coloreds laundry detergents; in the latter detergents, for example, bleaching components are unwanted or are not wanted in the same concentration as in the former; the hollow body containing bleach could then be removed by the user when colored laundry is to be washed) or if—for small amounts of laundry or ware, for example—only a partial dose of the detergent portion present in dimensionally stable hollow bodies is to be used. An assembly of this kind could be produced with particular preference by adhesive bonding, fusing, welding or clipping the dimensionally stable hollow bodies together; mechanical clipping would also allow the assembly to be parted with ease. In particularly preferred embodiments, hollow body assemblies of this kind can be parted from one another again in an aqueous environment through the use for example of a water-soluble adhesive; as a result it would be possible to ensure that an assembly used in an automatic laundering, cleaning or washing operation is fully dissolved and removed from the machine together with the laundering, cleaning or washing liquor.

For the materials from which the means for compartmentalization are composed, the above details relating to the materials of the dimensionally stable hollow bodies apply correspondingly. With a view to a simple and reliable mode of production, in one preferred embodiment of the invention the compartmentalization means within the dimensionally stable hollow bodies are composed of the same materials as the hollow bodies themselves. This allows unitary production in one process step and makes the production process particularly economic.

In principle, however, it is also possible to select the materials of the means for compartmentalization independently of the materials of the dimensionally stable hollow bodies. This has the advantage that it allows particular requirements in relation to the properties, for example, to the water-solubility, of the compartmentalization means to be taken into account.

In one preferred embodiment of the invention the compartmentalization means is/are one (or more) means which inhibit(s) an activity reduction in at least one component of a detersive formulation. Examples thereof are all of the cases in which components of detersive formulations are physically separated from one another to take account of mutual impairment of their activity. The compartmentalization means should in that case have properties which take account of these requirements: for example, should be substantially impermeable to water vapor, in order to keep bleaches free from moisture, or should be acid- and alkali-free, in order to protect enzymes against premature disintegration. Inhibiting a reduction in activity in this way not only contributes directly to enhanced activity of the particular component protected but also allows the amounts of such components to be reduced, since an excess in expectation of the otherwise customary loss of activity is no longer needed.

In other embodiments particularly preferred in accordance with the invention the compartmentalization means is (are) means determining the quality and/or quantity of the release of components of a detersive formulation. In those cases where the compartmentalization means have such a function, advantageously, either components of the detersive formulations can be delivered to the liquor at different points in time during the laundering, cleaning or washing operation (qualitative control) or different amounts of certain (qualitatively identical) formulations can be delivered to the liquor (quantitative control).

In the first-mentioned case a dimensionally stable hollow body possesses, for example, two or more compartments whose walls have a different solubility (or dissolution temperature) in water or in the liquor. The compartments contain active (detersive) components for the first, second, and any further (laundering, cleaning, washing) cycles, with different compositions, and release them at different times and/or at different temperatures in the laundering, cleaning or washing operation.

In the second-mentioned exemplary case the dimensionally stable hollow bodies may—only by way of example—possess walls and compartmentalization means into which materials have been incorporated which dissolve at different temperatures or under different other boundary conditions. By way of example, in the compartment walls there first form small holes which allow only slight substance exchange between individual compartments and the external environment and hence deliver only small amounts of a detersive formulation to the liquor; under other conditions, which can be set later, the holes or pores become enlarged as a result of the dissolution of wall components which are soluble under other conditions; as a result of the larger holes, larger amounts of substance can be exchanged between the interior of the compartment(s) and the external environment (i.e., the liquor) and so the desired higher concentrations of the detersive formulation in the liquor can be set.

Possible "triggers" for the release of the components by the compartmentalization means are, in particularly preferred embodiments, physicochemical parameters which effect or direct the disintegration of the compartmentalization means and/or of the walls of the dimensionally stable hollow bodies. Examples of such, though not to be understood as a restriction, are

- the time, i.e., the elapse of a certain time within which the walls of the dimensionally stable hollow bodies and/or the compartmentalization means are in contact with a particular medium, such as with an aqueous liquor, with linear dissolution kinetics being a prerequisite for reliable time control;
- the temperature, i.e., the attainment of a particular temperature level in the course of the temperature profile of the laundering, cleaning or washing operation; control by way of the temperature constitutes a reliable and hence preferred embodiment particularly in the case of dishwashing detergents, owing to the temperature rising with each stage of the washing operation;
- the pH, i.e., the setting of a certain pH in the course of a laundering, cleaning or washing operation by components of the detersive formulation, or the departure from a certain pH following disintegration of a component which determines or influences the pH;
- the ionic strength;
- the mechanical stability, which—as a function of the time, of the temperature or of other parameters—may be a factor which determines the disintegration;
- the permeability for a certain (primarily gaseous or liquid) component; etc.

The aforementioned parameters represent only examples, which are not intended to restrict the invention.

In a further preferred embodiment of the invention the compartmentalization means is (are) (a) means controlling the activity of at least one component of a detersive formulation. This embodiment comes to bear in particular in those cases where it is necessary for one or more active substances of a detersive formulation to be released into the laundering, cleaning or washing liquor with predetermined kinetics. One particular example is that known as controlled release, which can be controlled in accordance with the parameters stated above by way of the properties of the wall of the dimensionally stable hollow body and/or of the compartmentalization means. In this way it is possible to reduce any destructive influence of the liquor or simply of the water on the active substance and to release the substance into the liquor actively over a prolonged period of time.

A further preferred embodiment of the invention is that wherein one or more compartmentalization means contains/contain a portion or the entirety of at least one component of at least one detersive formulation.

With particular advantage this can be achieved by incorporating one or more components of at least one detersive formulation into the material of the compartmentalization means. Examples of such substances have already been specified above in connection with the material forming the stable hollow body(ies) and include (but are not restricted to) components which are present in relatively small amounts in the detergent portions and are therefore relatively difficult to incorporate into large mass batches of detersive formulations. One very simple incorporation takes place into the materials of the compartmentalization means, further resulting in reliable controllable release in the course of the laundering, cleaning or washing operation. Through an appropriate choice of the materials it is also possible for release to take place with controlled-release kinetics.

A further, likewise preferred embodiment of the invention consists in one or more compartmentalization means being composed in part or entirely of at least one component of at least one detersive formulation. This is preferred on account of the fact that, as a result, the compartmentalization means is not only a release-kinetics-influencing or even-controlling component of the detergent portion according to the invention but at the same time is also involved as a component in the success of the laundering, cleaning or washing operation. Owing to the large selection of available materials there are numerous examples for this embodiment; particular preference is given to compartmentalization means which are composed of or comprise polymers comprising (meth)acrylic acid and derivatives thereof (salts, esters).

In accordance with a further preferred embodiment of the invention the compartmentalization means is/are composed of a boundary between two adjoining components of a detersive formulation or of a boundary between two adjoining detersive formulations. In preferred embodiments of the invention this can be the case, for example, when detersive formulations are shaped by means of appropriate measures—for example, by coextrusion, compression molding or rolling of two or more components—to form structures whose components have solidified boundaries with adjacent components. In these cases, activity-reducing or otherwise deleterious effects of the detersive formulations on one another can be minimized or even ruled out. The possibility exists here either of combining individual components of a detersive formulation with the formation of adjoining boundaries or of combining detersive formulations which are mixtures of two or more components, with the formation of boundaries. In the context of the dimensionally stable hollow bodies of the invention, either possibility may lead to detergent portions having particularly advantageous properties: for example, having good dissolution kinetics of the components in the aqueous liquors.

A further preferred embodiment of the invention consists in a detergent portion which is present within one or more dimensionally stable hollow bodies comprising at least one compartment and in which the dimensionally stable hollow body is composed of a nonspherical hollow body which has n boundary surfaces of which one surface adopts the function of a "lid" which is applied at the conclusion of a process for producing the detergent portions in accordance with the invention, in other words after the compartment(s) in the interior of the hollow body has (have) been filled with one or more detersive formulations, so as to close the hollow body. The "lid" is composed with particular preference of a material with controllable water-solubility and can be joined to the rest of the hollow body by adhesive bonding, with a water-soluble adhesive, for example, by fusion, by welding or by another conventional method of joining materials. This embodiment is particularly advantageous for the production of the detergent portions since it allows the compartment(s) to be filled in steps with one or more detersive formulation and since handling in the course of subsequent use leads to optimal results, in particular to reliable control of the ingress of water or aqueous liquor to the interior of the dimensionally stable hollow body and/or of the egress of detersive formulation from the interior of the hollow body.

The detergent portions of the invention comprise one or more substances from the group consisting of surfactants, including compounded surfactants, builders, bleaches, bleach activators, enzymes, foam inhibitors, dyes, and fragrances, and also—where the detergent portions are at least partly in the form of shaped bodies—binding and disintegration auxiliaries. These classes of substance are described below.

In order to develop the wash performance the detergent portions of the invention may comprise surface-active substances from the group consisting of anionic, nonionic, zwitterionic, and cationic surfactants, with distinct preference being given to anionic surfactants on economic grounds and owing to their performance spectrum.

Anionic surfactants used are, for example, those of the sulfonate and sulfate type. Preferred surfactants of the sulfonate type are $C_{9-13}$ alkylbenzenesulfonates, olefinsulfonates, i.e., mixtures of alkenesulfonates and hydroxyalkanesulfonates, and also disulfonates, as are obtained, for example, from $C_{12-18}$ monoolefins having a terminal or internal double bond by sulfonation with gaseous sulfur trioxide followed by alkaline or acidic hydrolysis of the sulfonation products. Also suitable are alkanesulfonates, which are obtained from $C_{12-18}$ alkanes, for example, by sulfochlorination or sulfoxidation with subsequent hydrolysis or neutralization, respectively. Likewise suitable, in addition, are the esters of 2-sulfo fatty acids (ester sulfonates), e.g., the 2-sulfonated methyl esters of hydrogenated coconut, palm kernel or tallow fatty acids.

Further suitable anionic surfactants are sulfated fatty acid glycerol esters. Fatty acid glycerol esters are understood as meaning the monoesters, diesters, and triesters, and also mixtures thereof, as obtained in the preparation by esterification of a monoglycerol with from 1 to 3 mol of fatty acid or in the transesterification of triglycerides with from 0.3 to 2 mol of glycerol. Preferred sulfated fatty acid glycerol esters are the sulfation products of saturated fatty acids having from 6 to 22 carbon atoms, examples being those of caproic acid, caprylic acid, capric acid, myristic acid, lauric acid, palmitic acid, stearic acid or behenic acid.

Preferred alk(en)yl sulfates are the alkali metal salts, and especially the sodium salts, of the sulfuric monoesters of $C_{12}$-$C_{18}$ fatty alcohols, examples being those of coconut fatty alcohol, tallow fatty alcohol, lauryl, myristyl, cetyl or stearyl alcohol, or of $C_{10}$-$C_{20}$ oxo alcohols, and those monoesters of secondary alcohols with these chain lengths. Preference is also given to alk(en)yl sulfates of said chain length which contain a synthetic straight-chain alkyl radical prepared on a petrochemical basis, and which have degradation behavior similar to that of the corresponding compounds based on fatty-chemical raw materials. Prom a detergent standpoint, the $C_{12}$-$C_{16}$ alkyl sulfates and $C_{12}$-$C_{15}$ alkyl sulfates and also $C_{14}$-$C_{15}$ alkyl sulfates are preferred. In addition, 2,3-alkyl sulfates, which may for example be prepared in accordance with U.S. Pat. No. 3,234,258 or U.S. Pat. No. 5,075,041 and obtained as commercial products from Shell Oil Company under the name DAN®, are suitable anionic surfactants.

Also suitable are the sulfuric monoesters of the straight-chain or branched $C_{7-21}$ alcohols ethoxylated with from 1 to 6 mol of ethylene oxide, such as 2-methyl-branched $C_{9-11}$ alcohols containing on average 3.5 mol of ethylene oxide (EO) or $C_{12-18}$ fatty alcohols containing from 1 to 4 EO. Because of their high foaming behavior they are used in cleaning products only in relatively small amounts, for example, in amounts of from 1 to 5% by weight.

Further suitable anionic surfactants are also the salts of alkylsulfosuccinic acid, which are also referred to as sulfosuccinates or as sulfosuccinic esters and which represent monoesters and/or diesters of sulfosuccinic acid with alcohols, preferably fatty alcohols, and especially ethoxylated fatty alcohols. Preferred sulfosuccinates comprise $C_{8-18}$ fatty alcohol radicals or mixtures thereof. Especially preferred sulfosuccinates contain a fatty alcohol radical derived from ethoxylated fatty alcohols which themselves represent nonionic surfactants (for description see below). Particular preference is given in turn to sulfosuccinates whose fatty alcohol radicals are derived from ethoxylated fatty alcohols having a narrowed homolog distribution. Similarly, it is also possible to use alk(en)ylsuccinic acid containing preferably from 8 to 18 carbon atoms in the alk(en)yl chain, or salts thereof.

Further suitable anionic surfactants are, in particular, soaps. Suitable soaps include saturated fatty acid soaps, such as the salts of lauric acid, myristic acid, palmitic acid, stearic acid, hydrogenated erucic acid, and behenic acid, and also, in particular, mixtures of soaps derived from natural fatty acids, e.g., coconut, palm kernel or tallow fatty acids.

The anionic surfactants, including the soaps, may be present in the form of their sodium, potassium or ammonium salts and also as soluble salts of organic bases, such as mono-, di- or triethanolamine. Preferably, the anionic surfactants are in the form of their sodium or potassium salts, in particular in the form of the sodium salts. In another embodiment of the invention surfactants in the form of their magnesium salts are used.

Preferred in the context of the present invention are detergent portions containing from 5 to 50% by weight, more preferably from 7.5 to 40% by weight, and in particular from 15 to 25% by weight of one or more anionic surfactants, based in each case on the detergent portion.

In the selection of the anionic surfactants employed in the detergent portions of the invention, there are no restrictions to be observed that stand in the way of freedom to formulate. Preferred detergent portions in accordance with the invention, however, have a soap content which exceeds 0.2% by weight, based on the overall weight of the detergent portion. Anionic surfactants preferred for use are in this case the alkylbenzenesulfonates and fatty alcohol sulfates, with preferred detergent portions containing from 2 to 20% by weight, preferably from 2.5 to 15% by weight, and in particular from 5 to 10% by weight of fatty alcohol sulfate (s), based in each case on the weight of the detergent portion.

Nonionic surfactants used are preferably alkoxylated, advantageously ethoxylated, especially primary, alcohols having preferably from 8 to 18 carbon atoms and on average from 1 to 12 mol of ethylene oxide (EO) per mole of alcohol, in which the alcohol radical may be linear or, preferably, methyl-branched in position 2 and/or may comprise linear and methyl-branched radicals in a mixture, as are commonly present in oxo alcohol radicals. In particular, however, preference is given to alcohol ethoxylates containing linear radicals from alcohols of natural origin having from 12 to 18 carbon atoms, e.g., from coconut, palm, tallow fatty or oleyl alcohol, and on average from 2 to 8 EO per mole of alcohol. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO, and mixtures of these, and also mixtures of $C_{12-14}$ alcohol containing 3 EO and $C_{12-18}$ alcohol containing 5 EO. The stated degrees of ethoxylation represent statistical mean values, which for a specific product may be an integer or a fraction. Preferred alcohol ethoxylates have a narrowed homolog distribution (narrow range ethoxylates, NREs). In addition to these nonionic surfactants it is also possible to use fatty alcohols containing more than 12 EO. Examples thereof are tallow fatty alcohol containing 14 EO, 25 EO, 30 EO or 40 EO.

A further class of nonionic surfactants used with preference, which are used either as sole nonionic surfactant or in combination with other nonionic surfactants, are alkoxylated, preferably ethoxylated or ethoxylated and propoxylated, fatty acid alkyl esters, preferably having from 1 to 4 carbon atoms in the alkyl chain, especially fatty acid methyl esters, as are described, for example, in Japanese patent application JP 58/217598 or which are prepared preferably by the process described in international patent application WO-A-90/13533.

A further class of nonionic surfactants which can be used with advantage are the alkyl polyglycosides (APGs). Useful alkyl polyglycosides satisfy the general formula $RO(G)_z$, in which R stands for a linear or branched, especially 2-methyl-branched, saturated or unsaturated aliphatic radical having from 8 to 22, preferably from 12 to 18, carbon atoms and G is the symbol which stands for a glycose unit having 5 or 6 carbon atoms, preferably for glucose. The degree of glycosidation, z, lies between 1.0 and 4.0, preferably between 1.0 and 2.0, and in particular between 1.1 and 1.4.

Preference is given to using linear alkyl polyglucosides, i.e., alkyl polyglycosides in which the polyglycosyl radical is a glucose radical and the alkyl radical is an n-alkyl radical.

The detergent portions of the invention may preferably comprise alkyl polyglycosides, with preference being given to APG contents in the detergent portions of more than 0.2% by weight, based on the overall formulation. Particularly preferred detergent portions comprise APGs in amounts of from 0.2 to 10% by weight, preferably in amounts of from 0.2 to 5% by weight, and in particular in amounts of from 0.5 to 3% by weight.

Nonionic surfactants of the amine oxide type, for example, N-cocoalkyl-N,N-dimethylamine oxide and N-tallowalkyl-N,N-dihydroxyethylamine oxide, and of the fatty acid alkanolamide type, may also be suitable. The amount of these nonionic surfactants is preferably not more than that of the ethoxylated fatty alcohols, in particular not more than half thereof.

Further suitable surfactants are polyhydroxy fatty acid amides of the formula (I)

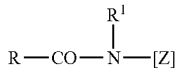

(I)

in which RCO stands for an aliphatic acyl radical having from 6 to 22 carbon atoms, $R^1$ stands for hydrogen or an alkyl or hydroxyalkyl radical having from 1 to 4 carbon atoms, and

[Z] stands for a linear or branched poly hydroxy alkyl radical having from 3 to 10 carbon atoms and from 3 to 10 hydroxyl groups. The polyhydroxy fatty acid amides are known substances which are customarily obtainable by reductive amination of a reducing sugar with ammonia, an alkylamine or an alkanolamine and subsequent acylation with a fatty acid, a fatty acid alkyl ester or a fatty acid chloride.

The group of the polyhydroxy fatty acid amides also includes compounds of the formula (II)

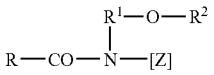

(II)

in which R stands for a linear or branched alkyl or alkenyl radical having from 7 to 12 carbon atoms, $R^1$ stands for a linear, branched or cyclic alkyl radical or an aryl radical having from 2 to 8 carbon atoms, and $R^2$ stands for a linear, branched or cyclic alkyl radical or an aryl radical or an oxyalkyl radical having from 1 to 8 carbon atoms, preference being given to $C_{1-4}$ alkyl radicals or phenyl radicals, and [Z] stands for a linear polyhydroxyalkyl radical whose alkyl chain is substituted by at least two hydroxyl groups, or for alkoxylated, preferably ethoxylated or propoxylated, derivatives of said radical.

[Z] is preferably obtained by reductive amination of a reduced sugar, e.g., glucose, fructose, maltose, lactose, galactose, mannose or xylose. The N-alkoxy- or N-aryloxy-substituted compounds may then be converted into the desired polyhydroxy fatty acid amides by reaction with fatty acid methyl esters in the presence of an alkoxide catalyst.

It may further be preferable to use cationic surfactants alongside anionic and nonionic surfactants. They are used preferably as wash performance boosters, in which case only small amounts of cationic surfactants are needed. Where cationic surfactants are used, they are present in the compositions preferably in amounts of from 0.01 to 10% by weight, in particular from 0.1 to 3.0% by weight.

In those cases where the detergent portions of the invention comprise laundry detergents, they normally comprise one or more surfactants in overall amounts of from 5 to 50% by weight, preferably in amounts of from 10 to 35% by weight, with it being possible for surfactants to be present in a larger or smaller amount in subportions of the detergent portions of the invention. In other words: the amount of surfactant does not have to be the same in every subportion; instead, subportions with relatively larger surfactant content and subportions with relatively smaller surfactant content may be envisaged.

In those cases where the detergent portions of the invention comprise dishwashing detergents, they normally comprise one or more surfactants in overall amounts of from 0.1 to 10% by weight, preferably in amounts of from 0.5 to 5% by weight, with it being possible for surfactants to be present in a larger or smaller amount in subportions of the detergent portions of the invention. In other words: for dishwashing detergents as well the amount of surfactant does not have to be the same in every subportion; instead, subportions with relatively larger surfactant content and subportions with relatively smaller surfactant content may be envisaged.

Besides the detersive substances, builders are the most important ingredients of detergents. The detergent portions of the invention may comprise builders which are commonly used in detergents, i.e., in particular, zeolites, silicates, carbonates, organic cobuilders, and—where there are no ecological prejudices against their use—the phosphates as well.

Suitable crystalline, sheetlike sodium silicates possess the general formula $NaMSi_xO_{2x+1}.H_2O$, where M denotes sodium or hydrogen, x is a number from 1.9 to 4, and y is a number from 0 to 20, and preferred values for x are 2, 3 or 4. Crystalline phyllosilicates of this kind are described, for example, in European patent application EP-A-0 164 514. Preferred crystalline phyllosilicates of the formula stated are those in which M stands for sodium and x adopts the values 2 or 3. In particular, not only β- but also δ-sodium disilicates $Na_2Si_2O_5.yH_2O$ are preferred, β-sodium disilicate, for example, being obtainable by the process described in international patent application WO-A-91/08171.

It is also possible to use amorphous sodium silicates having an $Na_2O:SiO_2$ modulus of from 1:2 to 1:3.3, preferably from 1:2 to 1:2.8, and in particular from 1:2 to 1:2.6, which are dissolution-retarded and have secondary detergency properties. The retardation of dissolution relative to conventional amorphous sodium silicates may have been brought about in a variety of ways—for example, by surface treatment, compounding, compacting or overdrying. In the context of this invention, the term "amorphous" also embraces "X-ray-amorphous". This means that in X-ray diffraction experiments, the silicates do not yield the sharp X-ray reflections typical of crystalline substances but instead yield at best one or more maxima of the scattered X-radiation, having a width of several degree units of the diffraction angle. However, good builder properties may result, even particularly good builder properties, if the silicate particles in electron diffraction experiments yield vague or even sharp diffraction maxima. The interpretation of this is that the products have microcrystalline regions with a size of from 10 to several hundred ran, values up to max. 50 nm and in particular up to max. 20 nm being preferred. Particular preference is given to compacted amorphous silicates, compounded amorphous silicates, and overdried X-ray-amorphous silicates.

A finely crystalline, synthetic zeolite which may be used, containing bound water, is preferably zeolite A and/or P. A particularly preferred P-type zeolite is zeolite MAP (e.g., commercial product: Doucil A24 from Crosfield). Also suitable, however, are zeolite X and also mixtures of A, X and/or P. A product available commercially and also able to be used with preference in the context of the present invention, for example, is a cocrystallizate of zeolite X and zeolite A (approximately 80% by weight zeolite X), which is sold by CONDEA Augusta S.p.A. under the brand name VEGOBOND AX® and may be described by the formula $$n\mathrm{Na_2O}.(1-n)\mathrm{K_2O}.\mathrm{Al_2O_3}.(2\text{-}2.5)\mathrm{SiO_2}.(3.5\text{-}5.5)\mathrm{H_2O}.$$

Suitable zeolites have an average particle size of less than 10 μm (volume distribution; measurement method; Coulter counter) and contain preferably from 18 to 22% by weight, in particular from 20 to 22% by weight, of bound water.

Of course, the widely known phosphates may also be used as builder substances in laundry detergents, provided such a use is not to be avoided on environmental grounds. Particularly suitable are the sodium salts of the orthophosphates, of the pyrophosphates, and, in particular, of the tripolyphosphates.

Organic builder substances which can be used are, for example, the polycarboxylic acids, usable in the form of their sodium salts, the term polycarboxylic acids referring to those carboxylic acids which carry more than one acid function. Examples of these are citric acid, adipic acid, succinic acid, glutaric acid, malic acid, tartaric acid, maleic acid, fumaric acid, sugar acids, aminocarboxylic acids, nitrilotriacetic acid (NTA), provided use thereof is not objectionable on environmental grounds, and also mixtures of these. Preferred salts are the salts of the polycarboxylic acids such as citric acid, adipic acid, succinic acid, glutaric acid, tartaric acid, sugar acids, and mixtures thereof. The acids per se may also be used. In addition to their builder effect, the acids typically also possess the property of an acidifying component and thus also serve for formulation of a lower, milder pH in detergent portions in accordance with the invention. In this context particular mention may be made of citric acid, succinic acid, glutaric acid, adipic acid, gluconic acid, and any desired mixtures thereof.

Also suitable as builders are polymeric polycarboxylates. These are, for example, the alkali metal salts of polyacrylic acid or of polymethacrylic acid, examples being those having a relative molecular mass of from 500 to 70 000 g/mol.

The molar masses reported for polymeric polycarboxylates are, for the purposes of the present invention, weight-average molar masses $M_w$ of the respective acid form, determined in principle by means of gel permeation chromatography (GPC) using a UV detector. This measurement was made against an external polyacrylic acid standard which, owing to its structural similarity to the polymers under investigation, provides realistic molar weight values. These figures differ markedly from the molar weight figures for which polystyrenesulfonic acids are used as the standard. The molar masses measured against polystyrene acids are generally much higher than the molar masses reported in the context of the present invention.

Suitable polymers are, in particular, polyacrylates, which preferably have a molar mass of from 2000 to 20 000 g/mol. Owing to their superior solubility, preference in this group may be given in turn to the short-chain polyacrylates, which have molar masses of from 2000 to 10 000 g/mol, with particular preference from 3000 to 5000 g/mol.

Also suitable are copolymeric polycarboxylates, particularly those of acrylic acid with methacrylic acid or of acrylic acid or methacrylic acid with maleic acid. Copolymers which have been found particularly suitable are those of acrylic acid with maleic acid which contain from 50 to 90% by weight of acrylic acid and from 50 to 10% by weight of maleic acid. Their relative molar mass, based on free acids, is generally from 2000 to 70 000 g/mol, preferably from 20 000 to 50 000 g/mol, and in particular from 30 000 to 40 000 g/mol.

The (co)polymeric polycarboxylates can be used either as powders or as an aqueous solution. The (co)polymeric polycarboxylate content of the detergent portions of the invention is preferably from 0.5 to 20% by weight, in particular from 3 to 10% by weight.

In order to improve the solubility in water, the polymers may also contain allylsulfonic acids, such as allyloxybenzenesulfonic acid and methallylsulfonic acid, for example, as monomer. Particular preference is also given to biodegradable polymers comprising more than two different monomer units, examples being those containing as monomers salts of acrylic acid and of maleic acid and also vinyl alcohol or vinyl alcohol derivatives or containing as monomers salts of acrylic acid and of 2-alkylallylsulfonic acid, and also sugar derivatives.

Further preferred copolymers are those containing preferably acrolein and acrylic acid/salts of acrylic acid, or acrolein and vinyl acetate as monomers.

Similarly, further preferred builder substances that may be mentioned include polymeric aminodicarboxylic acids, their salts or their precursor substances. Particular preference is given to polyaspartic acids and their salts and derivatives, which besides cobuilder properties also have a bleach-stabilizing action.

Further suitable builder substances are polyacetals, which may be obtained by reacting dialdehydes with polyolcarboxylic acids having from 5 to 7 carbon atoms and at least 3 hydroxyl groups. Preferred polyacetals are obtained from dialdehydes such as glyoxal, glutaraldehyde, terephthalaldehyde and mixtures thereof and from polyolcarboxylic acids such as gluconic acid and/or glucoheptonic acid.

Further suitable organic builder substances are dextrins, examples being oligomers and polymers of carbohydrates, which may be obtained by partial hydrolysis of starches. The hydrolysis can be conducted by customary methods, for example, acid-catalyzed or enzyme-catalyzed methods. The hydrolysis products in question preferably have average molar masses in the range from 400 to 500 000 g/mol. Preference is given here to a polysaccharide having a dextrose equivalent (DE) in the range from 0.5 to 40, in particular from 2 to 30, DE being a common measure of the reducing activity of a polysaccharide in comparison to dextrose, which possesses a DE of 100. It is possible to use not only maltodextrins having a DE of between 3 and 20 and dry glucose syrups having a DE of between 20 and 37 but also so-called yellow dextrins and white dextrins having higher molar masses, in the range from 2000 to 30 000 g/mol. One preferred dextrin is described in British patent application 94 19 091.

The oxidized derivatives of such dextrins comprise their products of reaction with oxidizing agents which are able to oxidize at least one alcohol function of the saccharide ring to the carboxylic acid function. Likewise suitable is an oxidized oligosaccharide. A product oxidized at $C_6$ of the saccharide ring may be particularly advantageous.

Oxydisuccinates and other disuccinate derivatives as well, preferably ethylenediamine disuccinate, are further suitable cobuilders. Ethylenediamine N,N'-disuccinate (EDDS) is used preferably in the form of its sodium or magnesium salts. Further preference in this context is given to glycerol disuccinates and glycerol trisuccinates. Suitable use amounts in formulations containing a zeolite and/or silicate are from 3 to 15% by weight.

Examples of further useful organic cobuilders are acetylated hydroxycarboxylic acids and their salts, which may also be present in lactone form, where appropriate, and which contain at least 4 carbon atoms and at least one hydroxyl group, and not more than two acid groups.

A further class of substance having cobuilder properties is represented by the phosphonates. The phosphonates in question are, in particular, hydroxyalkane- and aminoalkanephosphonates. Among the hydroalkanephosphonates, 1-hydroxyethane-1,1-diphosphonate (HEDP) is of particular importance as a cobuilder. It is used preferably as the sodium salt, the disodium salt being neutral and the tetrasodium salt giving an alkaline (pH= 9) reaction. Suitable aminoalkanephosphonates are preferably ethylenediaminetetramethylenephosphonate (EDTMP), diethylenetriaminepentamethylenephosphonate (DTPMP), and their higher homologs. They are used preferably in the form of the neutrally reacting sodium salts, e.g., as the hexasodium salt of EDTMP or as the hepta- and octasodium salt of DTPMP. As a builder in this case, preference is given to using HEDP from the class of the phosphonates. Furthermore, the aminoalkanephosphonates possess a pronounced heavy metal binding capacity. Accordingly, and especially if the detergent portions of the invention also contain bleach, it may be preferred to use aminoalkanephosphonates, especially DTPMP, or to use mixtures of said phosphonates.

Furthermore, all compounds capable of forming complexes with alkaline earth metal ions may be used as cobuilders.

In addition to the abovementioned constituents, namely surfactant and builder, the detergents of the invention may comprise further customary detergent ingredients from the group consisting of bleaches, bleach activators, alkalifiers, acidifiers, enzymes, fragrances, perfume carriers, fluorescents, dyes, foam inhibitors, silicone oils, antiredeposition agents, optical brighteners, graying inhibitors, color transfer inhibitors, decolorizers, scouring agents, antibacterial substances, and corrosion inhibitors.

Among the compounds used as bleaches which yield $H_2O_2$ in water, particular importance is possessed by sodium perborate tetrahydrate and sodium perborate monohydrate. Further bleaches which may be used are, for example, sodium percarbonate, peroxypyrophosphates, citrate perhydrates, and $H_2O_2$-donating peracidic salts or peracids, such as perbenzoates, peroxophthalates, diperazelaic acid, phthaloiminoperacid or diperdodecanedioic acid. Where detergent or bleach formulations for machine dishwashing are being produced, it is also possible to use bleaches from the group of the organic bleaches. Typical organic bleaches are the diacyl peroxides, such as dibenzoyl peroxide, for example. Further typical organic bleaches are the peroxy acids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate; (b) the aliphatic or substituted-aliphatic peroxy acids, such as peroxylauric acid, peroxystearic acid, ε-phthalimidoperoxycaproic acid [phthaloiminoperoxyhexanoic acid (PAP)], o-carboxybenzamidoperoxycaproic acid, N-nonenylamidoperadipic acid and N-nonenylamidopersuccinates; and (c) aliphatic and araliphatic peroxydicarboxylic acids, such as 1,12-diperoxycarboxylic acid, 1,9-diperoxyazelaic acid, diperocysebacic acid, diperoxybrassylic acid, the diperoxyphthalic acids, 2-decyldiperoxybutane-1,4-dioic acid, N,N-terephthaloyldi(6-aminopercaproic acid) can be used.

Bleaches used in compositions for machine dishwashing may also be substances which release chlorine or bromine. Among suitable chlorine- or bromine-releasing materials, examples include heterocyclic N-bromoamides and N-chloroamides, examples being trichloroisocyanuric acid, tribromoisocyanuric acid, dibromoisocyanuric acid and/or dichloroisocyanuric acid (DICA) and/or salts thereof with cations such as potassium and sodium. Hydantoin compounds, such as 1,3-dichloro-5,5-dimethylhydantoin, are likewise suitable.

In order to achieve an improved bleaching action when laundering, cleaning or washing at temperatures of 60° C. or below, bleach activators can be incorporated into the detergent portions. Bleach activators which may be used are compounds which under perhydrolysis conditions give rise to aliphatic peroxocarboxylic acids having preferably from 1 to 10 carbon atoms, in particular from 2 to 4 carbon atoms, and/or unsubstituted or substituted perbenzoic acid. Suitable substances are those which carry O-acyl and/or N-acyl groups of the stated number of carbon atoms, and/or unsubstituted or substituted benzoyl groups. Preference is given to polyacylated alkylenediamines, especially tetraacetylethylenediamine (TAED), acylated triazine derivatives, especially 1,5-diacetyl-2,4-dioxohexahydro-1,3,5-triazine (DADHT), acylated glycolurils, especially tetraacetylglycoluril (TAGU), N-acylimides, especially N-nonanoylsuccinimide (NOSI), acylated phenolsulfonates, especially n-nonanoyl- or isononanoyloxybenzenesulfonate (n- or iso-NOBS), carboxylic anhydrides, especially phthalic anhydride, acylated polyhydric alcohols, especially triacetin, ethylene glycol diacetate, and 2,5-diacetoxy-2,5-dihydrofuran.

In addition to the conventional bleach activators or instead of them it is also possible to incorporate what are known as bleaching catalysts into the detergent portions. These substances are bleach-boosting transition metal salts or transition metal complexes such as, for example, Mn, Fe, Co, Ru or Mo salen or carbonyl complexes. Other bleaching catalysts which can be used include Mn, Fe, Co, Ru, Mo, Ti, V, and Cu complexes with N-containing tripod ligands, and also Co, Fe, Cu, and Ru amine complexes.

Suitable enzymes include those from the classes of the proteases, lipases, amylases, cellulases, and mixtures thereof. Active enzymatic substances obtained from bacterial strains or from fungi, such as *Bacillus subtilis, Bacillus licheniformis*, and *Streptomyces griseus*, are especially suitable. It is preferred to use proteases of the subtilisin type and especially proteases obtained from *Bacillus lentus*. Of particular interest in this context are enzyme mixtures, examples being those of protease and amylase or protease and lipase or protease and cellulase or of cellulase and lipase or of protease, amylase, and lipase or protease, lipase, and cellulase, but especially mixtures containing cellulase. Peroxidases or oxidases have also proven suitable in certain cases. The enzymes may be adsorbed on carrier substances and/or embedded in coating substances in order to protect them against premature decomposition. The fraction of the enzymes, enzyme mixtures or enzyme granules in the compositions of the invention can be, for example, from about 0.1 to 5% by weight, preferably from 0.1 to about 2% by weight.

In accordance with the state of the art, enzymes are added primarily to a detergent formulation, in particular to a dishwashing detergent which is intended for the main wash. A disadvantage here was that the activity optimum of enzymes used restricted the choice of temperature and, furthermore, problems occurred in connection with the stability of the enzymes in the strongly alkaline medium. With the detergent portions of the invention it is possible to introduce enzymes into a separate compartment and then to use them in the prewash as well and so to utilize the prewash as well as the main wash for allowing the enzymes to act on soiling on the article to be cleaned.

It is therefore particularly preferred in accordance with the invention to add enzymes to the detersive formulation or subportion of a detergent portion that is intended for the prewash and then—with further preference—to enclose such a formulation with a dimensionally stable hollow body material which is already soluble in water at a low temperature, in order, for example, to protect the enzyme-containing formulation against a loss of activity as a result of ambient conditions. With further preference the enzymes are optimized for use under the conditions of the prewash, i.e., for example, in cold water.

The detergent portions of the invention may be advantageous when the enzyme formulations are in liquid form, such as they are in some cases offered commercially, since then a rapid action can be expected which occurs as early as in the prewash (which is relatively short and is carried out in cold water). Even if—as is usual—the enzymes are used in solid form and have been provided with a hollow body enclosure comprising a water-soluble material which is soluble even in cold water, the enzymes are able to develop their action even before the main wash. An advantage of using an enclosure of water-soluble material, especially of cold-water-soluble material, is that the enzyme(s) acts/act rapidly in cold water after the enclosure has dissolved. As a result it is possible to extend their activity time, to the benefit of the end wash result.

In accordance with a particularly preferred embodiment the detergent portions according to the invention comprise further additives such as are known from the prior art as additives for detergent formulations. These additives may either be added to one or more, or if necessary all, of the subportions (detersive formulations) of the detergent portions of the invention or—as described in the co-pending patent application No. 199 29 098.9 entitled "Active substance portion pack"—incorporated into the water-soluble materials of the dimensionally stable hollow bodies comprising the detersive formulations, in other words, for example, into the water-soluble wall material(s).

One preferred group of additives used in accordance with the invention are optical brighteners. Use may be made here of the optical brighteners which are customary in laundry detergents. They are added as an aqueous solution or solution in an organic solvent to the polymer solution which is transformed into the walls of the dimensionally stable hollow body, or are added to a subportion (detersive formulation) of a detergent in solid or liquid form. Examples of optical brighteners are derivatives of diaminostilbenedisulfonic acid or its alkali metal salts. Suitable, for example, are salts of 4,4'-bis(2-anilino-4-morpholino-1,3,5-triazinyl-6-amino)stilbene-2,2'-disulfonic acid or compounds of similar structure which instead of the morpholino group carry a diethanolamino group, a methylamino group, an anilino group or a 2-methoxyethylamino group. Furthermore, brighteners of the substituted diphenylstyryl type may be present in the subportions (detersive formulations) of the detergent portions of the invention, examples being the alkali metal salts of 4,4'-bis(2-sulfostyryl)biphenyl, 4,4'-bis(4-chloro-3-sulfostyryl)biphenyl or 4-(4-chlorostyryl)-4'-(2-sulfostyryl)biphenyl. Mixtures of the aforementioned brighteners may also be used.

A further group of additives which is preferred in accordance with the invention are UV protection substances. These are substances which are released in the wash liquor during the laundering operation or during the subsequent softening operation and which accumulate on the fiber so as then to achieve a UV protection effect. Suitable products are those available commercially under the name Tinosorb® from Ciba Speciality Chemicals.

Further additives which are conceivable and in specific embodiments preferred are surfactants, which may influence in particular the solubility of the water-soluble walls of the dimensionally stable hollow body or of the compartmentalization means but may also control their wettability and the formation of foam during dissolution, and also foam inhibitors, and also bitter substances, which may prevent children mistakenly swallowing such hollow bodies or parts of such hollow bodies.

A further inventively preferred group of additives are dyes, especially water-soluble or water-dispersible dyes. Preference is given here to dyes such as are commonly used to enhance the visual esthetics of the product in detergents. The selection of such dyes causes no difficulties to the skilled worker, particularly since customary dyes of this kind have a high level of storage stability and insensitivity to the other ingredients of the detersive formulations and toward light and do not have any pronounced affinity for textile fibers, so as not to stain them. In accordance with the invention the dyes are present in the detergent portions in amounts of below 0.01% by weight.

A further class of additives which can be added in accordance with the invention to the detergent portions are polymers. Suitable such polymers include on the one hand polymers which exhibit cobuilder properties in the course of washing, i.e., for example, polyacrylic acids, and also modified polyacrylic acids or corresponding copolymers. A further group of polymers are polyvinylpyrrolidone and other graying inhibitors, such as polyvinylpyrrolidone copolymers, cellulose ethers, and the like. According to a further embodiment of the invention suitable polymers also include soil repellents, which are known to the skilled detergents worker and are described in detail below.

A further group of additives are bleaching catalysts, especially bleaching catalysts for machine dishwashing detergents or laundry detergents. Use is made here of complexes of manganese and of cobalt, especially with nitrogen-containing ligands.

Another group of additives which is preferred in the context of the invention are silver protectants. This term embraces a multiplicity of usually cyclic organic compounds, which are likewise familiar to the skilled worker in question and which contribute to preventing the tarnishing of articles containing silver in the course of the cleaning operation. Specific examples may be triazoles, benzotriazoles, and complexes thereof with metals such as Mn, Co, Zn, Fe, Mo, W or Cu, for example.

Further additives according to the invention which are present in the detergent portions may also include soil repellents, i.e., polymers which attach to fibers or hard surfaces (porcelain and glass, for example), which have a positive influence on the ease with which oil and fat are washed from textiles and with which fats are washed from porcelain and glass, and which therefore act specifically to counter resoiling. This effect is particularly marked if a textile or a hard object (porcelain, glass) which has already been washed a number of times with a detergent of the invention comprising said oil- and fat-dissolving component becomes soiled again. The preferred oil- and fat-dissolving components include, for example, nonionic cellulose ethers such as methylcellulose and methylhydroxypropylcellulose having a methoxy group content of from 15 to 30% by weight and a hydroxypropoxy group content of from 1 to 15% by weight, based in each case on the nonionic cellulose ether, and also the prior art polymers of phthalic acid and/or of terephthalic acid and/or of derivatives thereof, particularly polymers comprising ethylene terephthalates and/or polyethylene glycol terephthalates or anionically and/or nonionically modified derivatives thereof. Particular preference among these is given to the sulfonated derivatives of phthalic acid polymers and of terephthalic acid polymers.

All these additives are added to the detergent portions of the invention in amounts of up to not more than 30% by weight, preferably from 2 to 20% by weight. As already stated, the addition may also be made to a material of a water-soluble enclosure of the dimensionally stable hollow body or to a material of the water-soluble compartmentalization means, said material comprising the or one of the detersive formulation(s) or holding said formulation(s) in the compartment(s). In order to maintain the balance of the formula it is therefore possible for the skilled worker either to increase the weight of the polymer material for the walls of the hollow body or for the compartmentalization means, in order thus to exploit the depot effect the invention aims to achieve, or else to keep said additives additionally, at least proportionally, in the remainder of the detersive formulation. This, however, is less preferred.

Fragrances are added to the detergent portions of the invention in order to enhance the overall esthetic impression given by the products and to provide the consumer with not only the technical performance (softening result) but also a sensorially typical and unmistakable product. As perfume oils or fragrances it is possible to use individual odorant compounds, examples being the synthetic products of the ester, ether, aldehyde, ketone, alcohol, and hydrocarbon types. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexylpropionate, styrallyl propionate, and benzyl salicylate. The ethers include, for example, benzyl ethyl ether. The aldehydes include, for example, linear alkanals having from 8 to 18 carbon atoms, citral, citronellal, citronellyloxyacetaldehyde, cyclamen aldehyde, hydroxycitronellal, lileal, and bourgeonal.

The ketones include the ionones, α-isomethylionone, and methyl cedryl ketone. The alcohols include anethole, citronellol, eugenol, geraniol, linalool, phenylethyl alcohol, and terpineol. The hydrocarbons include primarily terpenes such as limonene and pinene. Preference is given to using mixtures of different odorants which are matched to one another so as together to produce an appealing fragrance note. Such perfume oils may also contain natural odorant mixtures, as are obtainable from plant sources. Examples are pine oil, citrus oil, jasmine oil, patchouli oil, rose oil or ylang-ylang oil. Likewise suitable are muscat oil, sage oil, camomile oil, clove oil, balm oil, mint oil, cinnamon leaf oil, lime blossom oil, juniperberry oil, vetiver oil, olibanum oil, galbanum oil, and labdanum oil, and also orange blossom oil, neroliol, orange-peel oil, and sandalwood oil.

The fragrance content normally lies in the range up to 2% by weight of the overall detergent portion.

The fragrances may be incorporated directly to the detersive formulation(s); however, it may also be advantageous to apply the fragrances to carriers, which intensify the adhesion of the perfume on the laundry and, by means of slower fragrance release, ensure longlasting fragrance of textiles. Examples of materials which have become established as such carriers include cyclodextrins. In this context, the cyclodextrin-perfume complexes may additionally be coated with further auxiliaries.

The perfumes and fragrances may in principle be present in any of the subportions (detersive formulations) of the detergent portions of the invention. However, it is particularly preferred for them to be present, in a laundry detergent, in a detergent subportion which is envisaged for the afterwash or softening, or in a detergent, for dishwashing in particular, in a detergent subportion which is intended for the afterwash or clear rinse. They must therefore be comprised in accordance with the invention of a dimensionally stable hollow body material or compartmentalization means material which is soluble in water only under the conditions (especially at the temperature) of the afterwash but insoluble in water under the conditions (especially at the temperature) of the preceding washes. In accordance with the invention this can be done, for example, with a detergent portion which comprises two or more compartments in a dimensionally stable hollow body.

The detergent portions of the invention comprise, in a dimensionally stable hollow body comprising at least one compartment, one or more detersive formulations in amounts such that they are sufficient for one laundering, cleaning or washing operation. Naturally, the dosing of two units (hollow bodies) is possible under special conditions (highly soiled, e.g., highly fat-soiled laundry; highly soiled ware).

In one particularly preferred embodiment of the invention a detergent portion present in one or more dimensionally stable hollow bodies comprising at least one compartment comprises the at least one, preferably the two or more, detersive formulation (s) in one or more forms from the group consisting of powders, granules, extrudates, pellets, beads, tablets, tabs, rings, blocks, briquettes, solutions, melts, gels, suspensions, dispersions, emulsions, foams and gases. There is therefore no limit on the form of the detersive formulation present in one or more compartments of the dimensionally stable hollow body, provided the hollow body can be used in the manner intended. In this context it is to be regarded as a key advantage of the invention that for the first time it becomes possible to use fluid phases in detergent portions and that a detergent portion suitable for delivering such fluid phases is provided. Thus in the compartments of a hollow body it is possible for liquids, gels, gases or foams to be sealed, alone or together with solid constituents, in one or more compartments and for them to be contacted in use with the articles to be laundered, cleaned or washed. Accordingly, a new freedom is achieved in the formulation of detergents.

The detergent portions disclosed herein are composed of an outer hollow shape which contains one or more fillings. The hollow shape may be subdivided by partition walls into two or more compartments, and so two or more fillings may be present separately from one another within the same hollow body. Apart from compatibility with the material of the hollow shape there are no requirements imposed on the fillings, and so both solid and liquid phases (or phase systems) can be portioned.

The invention also provides filled hollow bodies which are composed only partly of an unpressed material which is disintegrable under laundering, cleaning or washing conditions and which gives the hollow body(ies) dimensional stability, while the remaining parts of the enclosure need not necessarily be dimensionally stable in the sense defined above. One preferred embodiment provides here for the provision of open, dimensionally stable hollow shapes ("shells") which are filled and later sealed, particular significance being accorded to sealing with a film.

The invention accordingly further provides a detergent portion in the form of an at least proportionally filled hollow body subdivided into at least two compartments, comprising (a) a detersive formulation surrounded by an enclosure (A) composed wholly or partly of an unpressed material which is disintegrable under laundering, cleaning or washing conditions and which gives the hollow body (ies) dimensional stability;

(b) a further detersive formulation surrounded by an enclosure (B) composed wholly or partly of an unpressed material which is disintegrable under laundering, cleaning or washing conditions and which gives the hollow body(ies) dimensional stability;

(c) if desired, further detersive formulations optionally surrounded by enclosures composed wholly or partly of an unpressed material which is disintegrable under laundering, cleaning or washing conditions and which gives the hollow body(ies) dimensional stability;

(d) if desired, further detersive formulations in solid, dimensionally stable form.

In the context of the present invention, the term "enclosure" characterizes the wall of a body which completely surrounds a detersive formulation. This body, containing the detersive formulation in its interior, may be composed completely or only partly of an unpressed material which is disintegrable under laundering, cleaning or washing conditions and which gives the hollow body(ies) dimensional stability.

The term "hollow body" characterizes, in the context of the present invention, the body formed of enclosure and contents (detersive formulation, accordingly). The term "hollow body" here embraces both the individual parts (a) or (b) in the sense of the invention and also the entire composition of the invention, which is formed by joining parts (a) and (b) to one another. In other words, the detersive formulation embraced by the enclosure (A), as a macroscopic article, is just as much a (filled) "hollow body" in the sense of the present invention as the detergent portion of the invention. The latter is characterized in that it has at least two spatially separate regions which can contain different fillings. These spatially separate regions are "compartments" in the sense of the present invention.

Naturally, the hollow body formed by the enclosure (A) and its contents may also already have been subdivided into different compartments. These various compartments may then all contain one and the same detersive formulation. It is preferred, however, to fill the individual compartments with different detersive formulations. Entirely analogous considerations apply to the hollow body embraced by the enclosure (B), so that the finished portions of the invention may have at least two compartments, but may also have three, four, five, six, seven, eight or more compartments. Where the portion of the invention has more than three compartments, these compartments may be formed by subdividing only one of the partial hollow bodies or by compartmentalizing both partial hollow bodies. In the case of a four-compartment hollow body it is possible to configure the partial hollow bodies embraced by the enclosures (A) and (B) in such a way that they are each subdivided into two compartments; it is also possible, however, to subdivide only the partial hollow body embraced by the enclosure (A) or embraced by the enclosure (B) into three compartments. The number of possibilities rises, of course, with the number of overall compartments—at the same time there is also an increase in the complexity associated with production, with the consequence that particular preference is given to invention portions having two, three, and four compartments.

Further compartments may be configured not only by subdividing the partial hollow bodies embraced by the enclosures (A) and (B). It is additionally possible in accordance with the invention to combine further partial hollow bodies, embraced by enclosures (C), (D), (E), (F), etc., with the partial hollow bodies embraced by the enclosures (A) and (B), so as to give the overall portion.

As already mentioned, one preferred embodiment envisages the provision of open, dimensionally stable hollow shapes ("shells") which are filled and later sealed, particular importance being accorded to sealing with a film. Here, preference is given to detergent portions of the invention wherein from 20 to 90%, preferably from 30 to 80%, and in particular from 40 to 70% of the surface area of the enclosures (A) and (B) and also, where appropriate, further enclosures is formed from dimensionally stable shells, comprising one or more means for compartmentalization where appropriate, while the remainder is formed by a water-soluble film.

In the simplest case, accordingly, the partial hollow body is produced by producing an open shell of any desired shape, filling this shell, and then sealing it with a film. Through an appropriate selection of the materials of which shell and film are composed it is possible to control the dissolution kinetics and thus the release of the filling. By "sealing" is meant in the context of the present invention that the film which seals the opening of the shell(s) is connected firmly to the edges of the shell.

The film which seals the opening of the shell is applied to the opening and joined firmly to its edges, possibly by adhesive bonding, partial melting or chemical reaction, for example.

The sealing film may of course also be a laminate of two or more films of different composition; by way of different compositions of individual film layers it is possible to expose the opening of the shell at defined points in time during the laundering and cleaning cycle.

Preferred film materials are the polymers known from the prior art. Particular preference is given to films of a polymer having a molar mass of between 5000 and 500 000 daltons, preferably between 7500 and 250 000 daltons, and in particular between 10 000 and 100 000 daltons. In the light of the media into which detergents are commonly introduced, particular preference is given to portions according to the invention wherein the film is composed of a water-soluble polymer.

Such preferred polymers may be of synthetic or natural origin. Where polymers on a natural or partially natural basis are used as film material, preferred film materials are selected from one or more substances from the group consisting of carrageenan, guar, pectin, xanthan, cellulose and its derivatives, starch and its derivatives, and gelatin.

Carrageenan is a formed extract, with a composition similar to that of agar, of North Atlantic red algae which belong to the Florideae, and is named for the Irish coastal town of Carragheen. The carrageenan, precipitated from the hot-water extract of the algae, is a colorless to sandy-colored powder having molar masses of 100 000-800 000 and a sulfate content of approximately 25%, which is very readily soluble in warm water. In carrageenan, three principal constituents are distinguished: the yellow-forming f fraction consists of D-galactose 4-sulfate and 3,6-anhydro-α-D-galactose, having alternate glycoside linkages in the 1,3 and 1,4 positions (agar, in contrast, contains 3,6-anhydro-α-L-galactose). The non-gelling 1 fraction is composed of D-galactose 2-sulfate with 1,3-glycoside linkages and of D-galactose 2,6-disulfate residues with 1,4 linkages, and is readily soluble in cold water. i-Carrageenan, composed of D-galactose 4-sulfate in 1,3-linkage and 3,6-anhydro-a-D-galactose 2-sulfate in 1,4-linkage, is both water-soluble and gel-forming. Further types of carrageenan are likewise labeled with Greek letters: α, β, γ, μ, ν, ξ, π, ω, χ. The nature of cations present (K, $NH_4$, Na, Mg, Ca) also influences the solubility of the carrageenans. Semi-synthetic products which contain only one ionic type and are likewise possible for use as film materials in the context of the present invention are also called carrag(h)eenates.

The guar which may be used as a film material in the context of the present invention, also called guar flour, is a grayish white powder obtained by milling the endosperm of the guar bean (*Cyamopsis tetragonobolus*). The principal constituent of guar, with up to about 85% by weight of the dry matter, is guaran (guar gum, *Cyamopsis* gum); secondary constituents are proteins, lipids, and cellulose. Guaran itself is a polygalactomarman, i.e., a polysaccharide whose linear chain is composed of unsubstituted mannose units (see formula I) and mannose units substituted in the C6 position by a galactose residue (see formula II) in β-D-(1→4) linkage.

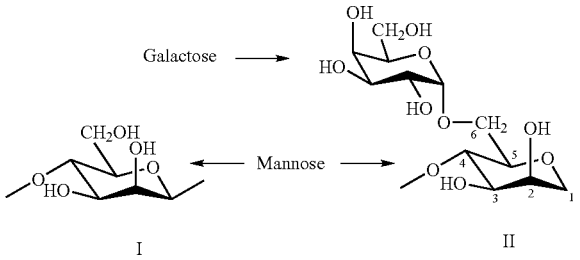

The ratio of I:II is approximately 2:1; the II units, in contrast to what was originally assumed, are not strictly alternating but are instead arranged in pairs or triplets in the polygalactomannan molecule. Data on the molar mass of guaran with values of approximately $2.2 \cdot 10^5$-$2.2 \cdot 10^6$ g/mol, depending on the degree of purity of the polysaccharide—the high value was determined on a highly purified product—vary significantly and correspond to approximately 1350-13 500 sugar units/macromolecule. Guaran is insoluble in the majority of organic solvents.

The pectins, which are likewise suitable for use as film material, are high molecular mass glycosidic plant substances which are very widespread in fruits, roots, and leaves. Pectins consist essentially of chains of 1,4-α-glycosidically linked galacturonic acid units with 20-80% of their acid groups esterified with methanol, a distinction being made between high-esterification (>50%) and low-esterification (<50%) pectins. The pectins have a folded leaf structure which positions them in the center between starch and cellulose molecules. Their macromolecules also contain some glucose, galactose, xylose and arabinose, and have weakly acidic properties.

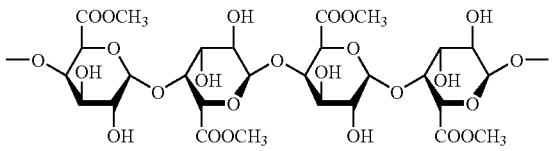

Fruit pectin contains 95%, beet pectin up to 85% galacturonic acid. The molar masses of the various pectins vary between 10 000 and 500 000, The structural properties as well are highly dependent on the degree of polymerization; for example, the fruit pectins in the dried state form asbestoslike fibers while the flax pectins form fine, granular powders.

The pectins are prepared by extraction with dilute acids predominantly from the inner portions of citrus fruit peels, fruit residues, or sugar beet chips.

Xanthan may also be used as a film material in accordance with the invention. Xanthan is a microbial anionic heteropolysaccharide produced by *Xanthomonas campestris* and certain other species under aerobic conditions, having a molar mass of from 2 to 15 million daltons. Xanthan is formed of a chain comprising β-1,4-linked glucose (cellulose) with side chains. The structure of the subgroups comprises glucose, mannose, glucuronic acid, acetate, and pyruvate, the viscosity of the xanthan being determined by the number of pyruvate units. Xanthan may be described by the following formula:

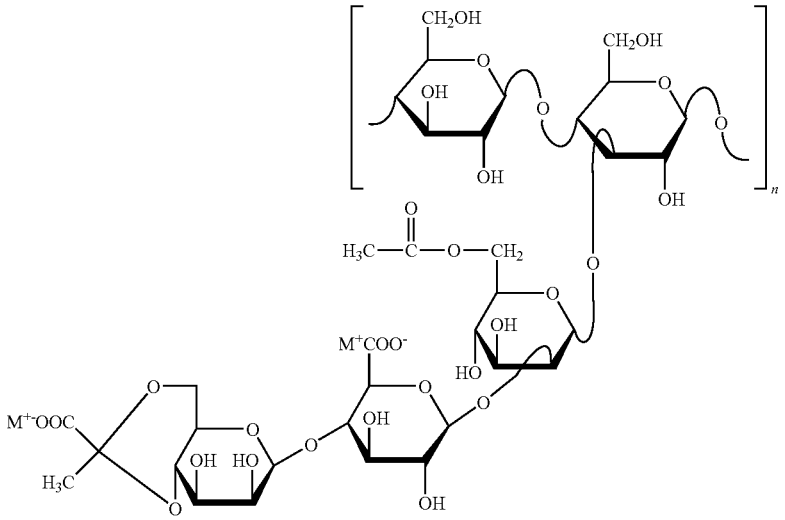

Basic unit of xanthan $M^+$ = Na, K, 1/2 Ca

The celluloses and their derivatives are likewise suitable as film materials. Pure cellulose has the formal empirical composition $(C_6H_{10}O_5)_n$ and, considered formally, constitutes a β-1,4-polyacetal of cellobiose, which is in turn composed of two molecules of glucose. Suitable celluloses are composed of from about 500 to 5000 glucose units and, accordingly, have average molar masses of from 50 000 to 500 000. Cellulose-based film materials which can be used in the context: of the present invention include cellulose derivatives obtainable by polymer-analogous reactions from cellulose. Such chemically modified celluloses include, for example, products from esterifications and/or etherifications in which hydroxy hydrogen atoms have been substituted. However, celluloses in which the hydroxyl groups have been replaced by functional groups not attached via an oxygen atom can also be employed as cellulose derivatives. The group of the cellulose derivatives includes, for example, alkali metal celluloses, carboxymethylcellulose (CMC), cellulose esters and cellulose ethers, and also aminocelluloses.

In addition to cellulose and cellulose derivatives, it is also possible to use (modified) dextrins, starch, and starch derivatives as film materials.

Suitable nonionic organic film materials are dextrins, examples being oligomers and polymers of carbohydrates obtainable by partial hydrolysis from starches. The hydrolysis may be conducted in accordance with customary processes—for example, acid- or enzyme-catalyzed processes. The products in question are preferably hydrolysis products having average molar masses in the range from 400 to 500 000 g/mol. Preference is given to a polysaccharide having a dextrose equivalent (DE) in the range from 0.5 to 40, in particular from 2 to 30, DE being a customary measure of the reducing action of a polysaccharide in comparison with dextrose, which possesses a DE of 100. Dextrins suitable for use include not only maltodextrins having a DE of between 3 and 20 and dry glucose syrups having a DE of between 20 and 37 but also what are known as yellow dextrins and white dextrins having higher molar masses in the range from 2000 to 30 000 g/mol.

The oxidized derivatives of such dextrins comprise the reaction products with oxidizing agents capable of oxidizing at least one alcohol function of the saccharide ring to the carboxylic acid function.

Starch as well may be used as film material for the portions of the invention. Starch is a homoglycan in which the glucose units are linked α-glycosidically. Starch is composed of two components of different molecular weight: approximately 20-30% straight-chain amylose (MW approx. 50 000-150 000) and 70-80% branched-chain amylopectin (MW approx. 300 000-2 000 000), with small amounts of lipids, phosphoric acids, and cations being present as well. Whereas amylose forms long, helical, interlooped chains comprising approximately 300-1200 glucose molecules, owing to the 1,4 linkage, in the case of amylopectin the chain branches by 1,6 linkage, after on average glucose units, to form a treelike structure comprising approximately 1500-12 000 molecules of glucose. In addition to straight starch, starch derivatives obtainable by polymer-analogous reactions from starch are also suitable as film materials in the context of the present invention. Examples of such chemically modified starches include products of esterifications and etherifications in which hydroxy hydrogen atoms have been substituted. Alternatively, starches in which the hydroxy groups have been replaced by functional groups not attached via an oxygen atom may be used as starch derivatives. The group of the starch derivatives includes, for example, alkali metal starches, carboxymethylstarch (CMS), starch esters and ethers, and amino starches.

Among the proteins and modified proteins, gelatin is of outstanding significance as film material. Gelatin is a polypeptide (molar mass: approx. 15 000->250 000 g/mol) obtained principally by hydrolysis under acidic or alkaline conditions of the collagen present in the skin and bones of animals. The amino acid composition of gelatin corresponds largely to that of the collagen from which it was obtained, and varies as a function of its provenance. The use of gelatin as a water-soluble envelope material is extremely widespread, especially in pharmacy, in the form of hard or soft gelatin capsules.

Further polymers suitable for use as film materials are synthetic polymers, which are preferably water-swellable and/or water-soluble. Synthetic-based polymers of this kind can be "tailored" for the desired permeability of the film on storage and dissolution of the film in use. Particularly preferred film materials are selected from a polymer or polymer mixture, the polymer or at least 50% by weight of the polymer mixture being selected from a) water-soluble nonionic polymers from the group of
- a1) polyvinylpyrrolidones,
- a2) vinylpyrrolidone-vinyl ester copolymers,
- a3) cellulose ethers b) water-soluble amphoteric polymers from the group of
- b1) alkylacrylamide-acrylic acid copolymers
- b2) alkylacrylamide-methacrylic acid copolymers
- b3) alkylacrylamide-methylmethacrylie acid copolymers
- b4) alkylacrylamide-acrylic acid-alkylaminoalkyl(meth) acrylic acid copolymers
- b5) alkylacrylamide-methacrylic acid-alkylaminoalkyl) meth)acrylic acid copolymers
- b6) alkylacrylamide-methylmethacrylic acid-alkylaminoalkyl(meth)acrylic acid copolymers
- b7) alkylacrylamide-alkyl methacrylate-alkylaminoethyl methacrylate-alkyl methacrylate copolymers
- b8) copolymers of
  - b8i) unsaturated carboxylic acids
  - b8ii) cationically derivatized unsaturated carboxylic acids
  - b8iii) if desired, further ionic or nonionic monomers c) water-soluble zwitterionic polymers from the group of
- c1) acrylamidoalkyltrialkylammonium chloride-acrylic acid copolymers and their alkali metal and ammonium salts
- c2) acrylamidoalkyltrialkylammonium chloridemethacrylic acid copolymers and their alkali metal and ammonium salts
- c3) methacroylethyl betaine-methacrylate copolymers d) water-soluble anionic polymers from the group of
- d1) vinyl acetate-crotonic acid copolymers
- d2) vinylpyrrolidone-vinyl acrylate copolymers
- d3) acrylic acid-ethyl acrylate-N-tert-butylacrylamide terpolymers
- d4) graft polymers of vinyl esters, esters of acrylic acid or methacrylic acid alone or in a mixture, copolymerized with crotonic acid, acrylic acid or methacrylic acid with polyalkylene oxides and/or polyalkylene glycols
- d5) grafted and crosslinked copolymers from the copolymerization of
  - d5i) at least one monomer of the nonionic type,
  - d5ii) at least one monomer of the ionic type,
  - d5iii) polyethylene glycol, and
  - d5iv) a crosslinker
- d6) copolymers obtained by copolymerizing at least one monomer from each of the three following groups:
  - d6i) esters of unsaturated alcohols and short-chain saturated carboxylic acids and/or esters of short-chain saturated alcohols and unsaturated carboxylic acids,
  - d6ii) unsaturated carboxylic acids,
  - d6iii) esters of long-chain carboxylic acids and unsaturated alcohols and/or esters of the carboxylic acids of group d6ii) with saturated or unsaturated, straight-chain or branched $C_{8-18}$ alcohol
- d7) terpolymers of crotonic acid, vinyl acetate and an allyl or methallyl ester
- d8) tetra- and pentapolymers of
  - d8i) crotonic acid or allyloxyacetic acid
  - d8ii) vinyl acetate or vinyl propionate d8iii) branched allyl or methallyl esters d8iv) vinyl ethers, vinyl esters or straight-chain allyl or methallyl esters d9) crotonic acid copolymers with one or more monomers from the group consisting of ethylene, vinylbenzene, vinyl methyl ether, acrylamide, and water-soluble salts thereof d10) terpolymers of vinyl acetate, crotonic acid, and vinyl esters of a saturated aliphatic α-branched monocarboxylic acid e) water-soluble cationic polymers from the group of e1) quaternized cellulose derivatives e2) polysiloxanes with quaternary groups e3) cationic guar derivatives e4) polymeric dimethyldiallylammonium salts and their copolymers with esters and amides of acrylic acid and methacrylic acid e5) copolymers of vinylpyrrolidone with quaternized derivatives of dialkylaminoacrylate and -methacrylate e6) vinylpyrrolidone-methoimidazolinium chloride copolymers e7) quaternized polyvinyl alcohol e8) polymers indicated under the INCI designations Polyquaternium 2, Polyquaternium 17, Polyquaternium 18, and Polyquaternium 27.

Water-soluble polymers in the sense of the invention are those polymers which are soluble to the extent of more than 2.5% by weight at room temperature in water.

The films may be prepared from individual polymers of those mentioned above; alternatively, mixtures or multi-ply laminar constructions of the polymers may be used. The polymers are described in more detail below.

Water-soluble polymers which are preferred in accordance with the invention are nonionic. Examples of suitable nonionic polymers are the following:

polyvinylpyrrolidones, as marketed, for example, under the designation Luviskol® (BASF). Polyvinylpyrrolidones are preferred nonionic polymers in the context of the invention.

Polyvinylpyrrolidones [poly(1-vinyl-2-pyrrolidinones)], abbreviated PVP, are polymers of the general formula (III)

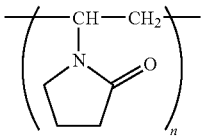

(III)

prepared by free-radical addition polymerization of 1-vinylpyrrolidone by processes of solution or suspension polymerization using free-radical initiators (peroxides, azo compounds). The ionic polymerization of the monomer yields only products having low molar masses. Commercially customary polyvinylpyrrolidones have molar masses in the range of approx. 2500-750 000 g/mol, which are characterized by stating the K values and—depending on the K value—have glass transition temperatures of 130-175°, They are supplied as white, hygroscopic powders or as aqueous solutions. Polyvinylpyrrolidones are readily soluble in water and a large number of organic solvents (alcohols, ketones, glacial acetic acid, chlorinated hydrocarbons, phenols, etc).

Vinylpyrrolidone-vinyl ester copolymers, as marketed for example under the trademark Luviskol® (BASF). Luviskol® VA 64 and Luviskol® VA 73, each vinylpyrrolidone-vinyl acetate copolymers, are particularly preferred nonionic polymers.

The vinyl ester polymers are polymers obtainable from vinyl esters and featuring the grouping of the formula (IV)

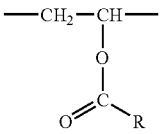

(IV)

as the characteristic basic structural unit of the macromolecules. Of these, the vinyl acetate polymers ($R{=}CH_3$) with polyvinyl acetates, as by far the most important representatives, have the greatest industrial significance.

The vinyl esters are polymerized free-radically by various processes (solution polymerization, suspension polymerization, emulsion polymerization, and bulk polymerization). Copolymers of vinyl acetate with vinylpyrrolidone comprise monomer units of the formulae (III) and (IV)

Cellulose ethers, such as hydroxypropylcellulose, hydroxyethylcellulose, and methylhydroxypropylcellulose, as marketed for example under the trademarks Culminal® and Benecel® (AQUALON).

Cellulose ethers may be described by the general formula (V)

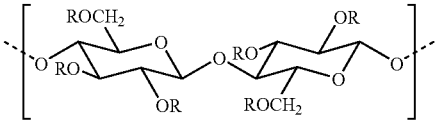

(V)

where R is H or an alkyl, alkenyl, alkynyl, aryl or alkylaryl radical. In preferred products, at least one R in formula (III) is $—CH_2CH_2CH_2—OH$ or $—CH_2CH_2—OH$. Cellulose ethers are prepared industrially by etherifying alkali metal cellulose (e.g., with ethylene oxide). Cellulose ethers are characterized by way of the average degree of substitution, DS, and/or by the molar degree of substitution, MS, which indicate how many hydroxyl groups of an anhydroglucose unit of cellulose have reacted with the etherifying reagent or how many moles of the etherifying reagent have been added on, on average, to one anhydroglucose unit. Hydroxyethylcelluloses are water-soluble above a DS of approximately 0.6 and, respectively, an MS of approximately 1. Commercially customary hydroxyethyl- and hydroxypropylcelluloses have degrees of substitution in the range of 0.85-1.35 (DS) and 1.5-3 (MS), respectively. Hydroxyethyl- and -propylcelluloses are marketed as yellowish white, odorless and tasteless powders in greatly varying degrees of polymerization. Hydroxyethyl- and -propylcelluloses are soluble in cold and hot water and in some (water-containing) organic solvents, but insoluble in the majority of (water-free) organic solvents; their aqueous solutions are relatively insensitive to changes in pH or addition of electrolyte.

Polyvinyl alcohols, denoted PVALs for short, are polymers of the general structure $$[—CH_2—CH(OH)—]_n$$

including small fractions of structural units of the $$[—CH_2—CH(OH)—CH(OH)—CH_2]$$

type. Since the corresponding monomer, the vinyl alcohol, is unstable in free form, polyvinyl alcohols are prepared by way of polymer-analogous reactions by hydrolysis, hut industrially in particular by alkali-catalyzed transesterification of polyvinyl acetates with alcohols (preferably methanol) in solution. These industrial processes also make it possible to obtain PVALs having a predeterminable residual fraction of acetate groups.

Accordingly, in the context of the present invention, the term "polyvinyl alcohol" covers homopolymers of vinyl alcohol, copolymers of vinyl alcohol with copolymerizable monomers, or hydrolysis products of vinyl ester homopolymers or vinyl ester copolymers with copolymerizable monomers.

Commercially customary polyvinyl alcohols, which are commercialized as yellowish white powders or granules having degrees of polymerization in the range of approx. 100 to 2500 (molar masses of approximately 4000 to 100 000 g/mol), have degrees of hydrolysis of 98-99 or 87-89 mol % and thus still have a residual acetyl group content. On the part of the manufacturers the polyvinyl alcohols are characterized by stating the degree of polymerization of the initial polymer, the degree of hydrolysis, the saponification number and/or the solution viscosity.

Polyvinyl alcohols are soluble in water as a function of the degree of hydrolysis and in a few strongly polar organic solvents (formamide, dimethylformamide, dimethyl sulfoxide); they are not attacked by (chlorinated) hydrocarbons, esters, fats or oils. Polyvinyl alcohols are classed as toxicologically unobjectionable and are at least partly biodegradable. The solubility in water can be reduced by aftertreatment with aldehydes (acetalization), by complexing with Ni salts or Cu salts or by treatment with dichromates, boric acid or borax. The coatings of polyvinyl alcohol are substantially impenetrable for gases such as oxygen, nitrogen, helium, hydrogen, carbon dioxide, but do allow water vapor to pass.

Portions preferred in the context of the present invention are characterized in that the film is composed of a polyvinyl alcohol whose degree of hydrolysis is from 70 to 100 mol %, preferably from 80 to 90 mol %, with particular preference from 81 to 89 mol %, and in particular from 82 to 88 mol %.

In the film it is preferred to use polyvinyl alcohols with a defined molecular weight range, preference being given to portions of the invention wherein the film is composed of a polyvinyl alcohol whose molecular weight lies in the range from 10 000 to 100 000 g $mol^{-1}$, preferably from 11 000 to 90 000 g $mol^{-1}$, with particular preference from 12 000 to 80 000 g $mol^{-1}$, and in particular from 13 000 to 70 000 g $mol^{-1}$.

The degree of polymerization of such preferred polyvinyl alcohols lies between approximately 200 to approximately 2100, preferably between approximately 220 to approximately 1890, with particular preference between approximately 240 to approximately 1680, and in particular between approximately 260 to approximately 1500.

The polyvinyl alcohols described above are widely available commercially, for example, under the trade name Mowiol® (Clariant). Examples of polyvinyl alcohols which are particularly suitable in the context of the present invention are Mowiol® 3-83, Mowiol® 4-88, Mowiol® 5-88, and Mowiol® 8-88.

Further polymers suitable in accordance with the invention are water-soluble amphopolymers. The generic term amphopolymers embraces amphoteric polymers, i.e., polymers whose molecule includes both free amino groups and free —COOH or $SO_3H$ groups and are capable of forming inner salts; zwitterionic polymers whose molecule contains quaternary ammonium groups and $—COO^-$ OR $—SO_3^-$ groups, and polymers containing —COOH or $SO_3H$ groups and quaternary ammonium groups. An example of an amphopolymer which may be used in accordance with the invention is the acrylic resin obtainable under the designation Amphomer®, which constitutes a copolymer of tert-butylaminoethyl methacrylate, N-(1,1,3,3-tetramethylbutyl)acrylamide, and two or more monomers from the group consisting of acrylic acid, methacrylic acid and their simple esters. Likewise preferred amphopolymers are composed of unsaturated carboxylic acids (e.g., acrylic and methacrylic acid), cationically derivatized unsaturated carboxylic acids, (e.g., acrylamidopropyltrimethylammonium chloride), and, if desired, further ionic or nonionic monomers, as evident, for example, from German laid-open specification 39 29 973 and the prior art cited therein. Terpolymers of acrylic acid, methyl acrylate and methacrylamidopropyltrimonium chloride, as available commercially under the designation Merquat® 2001 N, are particularly preferred amphopolymers in accordance with the invention. Further suitable amphoteric polymers are, for example, the octylacrylamide-methyl methacrylate-tert-butylaminoethyl methacrylate-2-hydroxypropyl methacrylate copolymers available under the designations Amphomer® and Amphomer® LV-71 (DELFT NATIONAL).

Acrylamidopropyltrimethylammonium chloride-acrylic acid or -methacrylic acid copolymers and their alkali metal salts and ammonium salts are preferred zwitterionic polymers. Further suitable zwitterionic polymers are methacryloylethyl betaine-methacrylate copolymers, which are obtainable commercially under the designation Amersette® (AMERCHOL).

Anionic polymers that are suitable in accordance with the invention include:

vinyl acetate-crotonic acid copolymers, as are commercialized, for example, under the designations Resyn® (NATIONAL STARCH), Luviset® (BASF), and Gafset® (GAF).

In addition to monomer units of the above-mentioned formula (IV), these polymers also have monomer units of the general formula (VI):

$$[—CH(CH_3)—CH(COOH)—]_n \quad (VI)$$

Vinylpyrrolidone-vinyl acrylate copolymers, obtainable for example under the trademark Luviflex® (BASF). A preferred polymer is the vinylpyrrolidone-acrylate terpolymer obtainable under the designation Luviflex® VBM-35 (BASF).

Acrylic acid-ethyl acrylate-N-tert-butylacrylamide terpolymers, which are marketed for example under the designation Ultrahold® strong (BASF).

Graft polymers of vinyl esters, esters of acrylic acid or methacrylic acid alone or in a mixture, copolymerized with crotonic acid, acrylic acid or methacrylic acid with polyalkylene oxides and/or polyalkylene glycols Such grafted polymers of vinyl esters, esters of acrylic acid or methacrylic acid alone or in a mixture with other copolymerizable compounds onto polyalkylene glycols are obtained by polymerization under hot conditions in homogeneous phase, by stirring the polyalkylene glycols into the monomers of the vinyl esters, esters of acrylic acid or methacrylic acid, in the presence of free-radical initiator.

Vinyl esters which have been found suitable are, for example, vinyl acetate, vinyl propionate, vinyl butyrate, vinyl benzoate, and esters of acrylic acid or methacrylic acid which have been found suitable are those obtainable with low molecular weight aliphatic alcohols, i.e., in particular, ethanol, propanol, isopropanol, 1-butanol, 2-butanol, 2-methyl-1-propanol, 2-methyl-2-propanol, 1-pentanol, 2-pentanol, 3-pentanol, 2,2-dimethyl-1-propanol, 3-methyl-1-butanol; 3-methyl-2-butanol, 2-methyl-2-butanol, 2-methyl-1-butanol, and 1-hexanol.

Suitable polyalkylene glycols include in particular polyethylene glycols and polypropylene glycols. Polymers of ethylene glycol which satisfy the general formula VII $$H—(O—CH_2—CH_2)_n—OH \quad (VII)$$

in which n may adopt values between 1 (ethylene glycol) and several thousand. For polyethylene glycols there exist various nomenclatures, which may lead to confusion. It is common in the art to state the average relative molar weight after the letters "PEG", so that "PEG 200" characterizes a polyethylene glycol having a relative molar mass of from about 190 to about 210. For cosmetic ingredients, a different nomenclature is used, in which the abbreviation PEG is provided with a hyphen and the hyphen is followed directly by a number which corresponds to the number n in the above-mentioned formula V. According to this nomenclature (known as the INCI nomenclature, CTFA International Cosmetic Ingredient Dictionary and Handbook, 5th Edition, The Cosmetic, Toiletry and Fragrance Association, Washington, 1997), for example, PEG-4, PEG-6, PEG-8, PEG-9, PEG-10, PEG-12, PEG-14, and PEG-16 may be used. Polyethylene glycols are available commercially, for example, under the trade names Carbowax® PEG 200 (Onion Carbide), Emkapol® 200 (ICI Americas), Lipoxol® 200 MED (HÜLS America), Polyglycol® E-200 (Dow Chemical), Alkapol® PEG 300 (Rhone-Poulenc), Lutrol® E300 (BASF), and the corresponding trade names with higher numbers.

Polypropylene glycols (abbreviation PPGs) are polymers of propylene glycol which satisfy the general formula VIII $$H—(O—\underset{\underset{CH_3}{|}}{CH}—CH_2)_n—OH \quad (VIII)$$

in which n may adopt values between 1 (propylene glycol) and several thousand. Industrially significant in this case are, in particular, di-, tri- and tetrapropylene glycol, i.e., the representatives where n= 2, 3 and 4 in formula VI.

In particular, it is possible to use the vinyl acetate copolymers grafted onto polyethylene glycols and the polymers of vinyl acetate and crotonic acid grafted onto polyethylene glycols.

grafted and crosslinked copolymers from the copolymerization of i) at least one monomer of the nonionic type, ii) at least one monomer of the ionic type, iii) polyethylene glycol, and iv) a crosslinker The polyethylene glycol used has a molecular weight of between 200 and several million, preferably between 300 and 30 000.

The nonionic monomers may be of very different types, and include the following preferred monomers: vinyl acetate, vinyl stearate, vinyl laurate, vinyl propionate, allyl stearate, allyl laurate, diethyl maleate, allyl acetate, methyl methacrylate, cetyl vinyl ether, stearyl vinyl ether, and 1-hexene.

The nonionic monomers may equally be of very different types, among which particular preference is given to the presence in the graft polymers of crotonic acid, allyloxyacetic acid, vinylacetic acid, maleic acid, acrylic acid, and methacrylic acid.

Preferred crosslinkers are ethylene glycol dimethacrylate, diallyl phthalate, ortho-, meta- and paradivinylbenzene, tetraallyloxyethane, and polyallylsaccharoses containing 2 to 5 alkyl groups per molecule of saccharin.

The above-described grafted and crosslinked copolymers are formed preferably of:

i) from 5 to 85% by weight of at least one monomer of the nonionic type, ii) from 3 to 80% by weight of at least one monomer of the ionic type, iii) from 2 to 50% by weight, preferably from 5 to 30% by weight, of polyethylene glycol, and iv) from 0.1 to 8% by weight of a crosslinker, the percentage of the crosslinker being shaped by the ratio of the overall weights of i), ii) and iii).

copolymers obtained by copolymerizing at least one monomer from each of the three following groups:

i) esters of unsaturated alcohols and short-chain saturated carboxylic acids and/or esters of short-chain saturated alcohols and unsaturated carboxylic acids, ii) unsaturated carboxylic acids, iii) esters of long-chain carboxylic acids and unsaturated alcohols and/or esters of the carboxylic acids of group ii) with saturated or unsaturated, straight-chain or branched $C_{8-18}$ alcohols Short-chain carboxylic acids and alcohols here are those having 1 to 8 carbon atoms, it being possible for the carbon chains of these compounds to be interrupted, if desired, by divalent hetero-groups such as —O—, —NH—, and —S_.

terpolymers of crotonic acid, vinyl acetate, and an allyl or methallyl ester

These terpolymers contain monomer units of the general formulae (II) and (IV) (see above) and also monomer units of one or more allyl or methallyl esters of the formula IX:

$$R^2—\underset{\underset{CH_3}{|}}{\overset{\overset{R^1}{|}}{C}}—C(O)—O—CH_2—\overset{\overset{R^3}{|}}{C}=CH_2 \quad (IX)$$

in which $R^3$ is —H or —$CH_3$, $R^2$ is —$CH_3$ or —$CH(CH_3)_2$ and $R^1$ is —$CH_3$ or a saturated straight-chain or branched $C_{1-6}$ alkyl radical and the sum of the carbon atoms in the radicals $R^1$ and $R^2$ is preferably 7, 6, 5, 4, 3 or 2.

The abovementioned terpolymers result preferably from the copolymerization of from 7 to 12% by weight of crotonic acid, from 65 to 86% by weight, preferably from 71 to 83% by weight, of vinyl acetate and from 8 to 20% by weight, preferably from 10 to 17% by weight, of allyl or methallyl esters of the formula IX.

tetra- and pentapolymers of i) crotonic acid or allyloxyacetic acid ii) vinyl acetate or vinyl propionate iii) branched allyl or methallyl esters iv) vinyl ethers, vinyl esters or straight-chain allyl or methallyl esters crotonic acid copolymers with one or more monomers from the group consisting of ethylene, vinylbenzene, vinyl methyl ether, acrylamide and the water-soluble salts thereof.

terpolymers of vinyl acetate, crotonic acid and vinyl esters of a saturated aliphatic α-branched monocarboxylic acid.

Particularly appropriate film materials among the anionic polymers are polycarboxylates/polycarboxylic acids, polymeric polycarboxylates, polyaspartic acid, polyacetals, and dextrins, which are described below.

Examples of organic film materials which may be used are the polycarboxylic acids which may be used in the form of their sodium salts but also in free form. Polymeric polycarboxylates are, for example, the alkali metal salts of polyacrylic acid or of polymethacrylic acid, examples being those having a relative molecular mass of from 500 to 70 000 g/mol.

The molar masses reported for polymeric polycarboxylates, for the purposes of this document, are weight-average molar masses, $M_w$, of the respective acid form, determined fundamentally by means of gel permeation chromatography (GPC) using a UV detector. Measurement was made against an external polyacrylic acid standard, which owing to its structural similarity to the polymers under investigation provides realistic molar weight values. These figures differ markedly from the molar weight values obtained using polystyrenesulfonic acids as the standard. The molar masses measured against polystyrenesulfonic acids are generally much higher than the molar masses reported in this document.

Suitable polymers are, in particular, polyacrylates, which preferably have a molecular mass of from 2000 to 20 000 g/mol. Owing to their superior solubility, preference in this group may be given in turn to the short-chain polyacrylates, which have molar masses of from 2000 to 10 000 g/mol, and with particular preference from 3000 to 5000 g/mol.

Also suitable are copolymeric polycarboxylates, especially those of acrylic acid with methacrylic acid and of acrylic or methacrylic acid with maleic acid. Copolymers which have been found particularly suitable are those of acrylic acid with maleic acid, containing from 50 to 90% by weight acrylic acid and from 50 to 10% by weight maleic acid. Their relative molecular mass, based on free acids, is generally from 2000 to 70 000 g/mol, preferably from 20 000 to 50 000 g/mol, and in particular from 30 000 to 40 000 g/mol.

In order to improve the solubility in water, the polymers may also contain allylsulfonic acids, such as allyloxybenzenesulfonic acid and methallylsulfonic acid, for example, as monomers.

Particular preference as film materials is also given to biodegradable polymers comprising more than two different monomer units, examples being those comprising, as monomers, salts of acrylic acid and of maleic acid, and also vinyl alcohol or vinyl alcohol derivatives, or those comprising, as monomers, salts of acrylic acid and of 2-alkylallylsulfonic acid, and also sugar derivatives.

Further preferred copolymeric film materials are those whose monomers are preferably acrolein and acrylic acid/acrylic salts, and, respectively, acrolein and vinyl acetate.

Similarly, further preferred film materials that may be mentioned include polymeric aminodicarboxylic acids, their salts or their precursor substances. Particular preference is given to polyaspartic acids and their salts and derivatives.

Further suitable film materials are polyacetals, which may be obtained by reacting dialdehydes with polyolcarboxylic acids having 5 to 7 carbon atoms and at least 3 hydroxyl groups. Preferred polyacetals are obtained from dialdehydes such as glyoxal, glutaraldehyde, terephthalaldehyde and mixtures thereof and from polyolcarboxylic acids such as gluconic acid and/or glucoheptonic acid.

Further polymers which may be used with preference as film materials are cationic polymers. Among the cationic polymers, the permanently cationic polymers are preferred. "Permanently cationic" refers according to the invention to those polymers which independently of the pH of the composition (i.e., both of the film and of the remaining portion) have a cationic group. These are generally polymers which include a quaternary nitrogen atom, in the form of an ammonium group, for example.

Examples of preferred cationic polymers are the following:

Quaternized cellulose derivatives, as available commercially under the designations Celquat® and Polymer JR®. The compounds Celquat® H 100, Celquat® L200 and Polymer JR® 400 are preferred quaternized cellulose derivatives.

Polysiloxanes with quaternary groups, such as, for example, the commercially available products Q2-7224 (manufacturer: Dow Corning; a stabilized trimethylsilylamodimethicone), Dow Corning® 929 emulsion (comprising a hydroxyl-amino-modified silicone, also referred to as amodimethicone), SM-2059 (manufacturer: General Electric), SLM-55067 (manufacturer: Wacker), and Abil®-Quat 3270 and 3272 (manufacturer: Th. Goldschmidt; diquaternary polydimethylsiloxanes, Quaternium-80), Cationic guar derivatives, such as in particular the products marketed under the trade names Cosmedia® Guar and Jaguar®, Polymeric dimethyldiallylammonium salts and their copolymers with esters and amides of acrylic acid and methacrylic acid. The products available commercially under the designations Merquat® 100 (poly(dimethyldiallylammonium chloride)) and Merquat® 550 (dimethyldiallylammonium chlorideacrylamide copolymer) are examples of such cationic polymers.

Copolymers of vinylpyrrolidone with quaternized derivatives of dialkylamino acrylate and methacrylate, such as, for example, with diethyl sulfate-quaternized vinylpyrrolidone-dimethylamino methacrylate copolymers. Such compounds are available commercially under the designations Gafquat® 734 and Gafquat® 755.

Vinylpyrrolidone-methoimidazolinium chloride copolymers, as offered under the designation Luviquat®.

Quaternized polyvinyl alcohol and also the polymers known under the designations Polyquaternium 2, Polyquaternium 17, Polyquaternium 18, and Polyquaternium 27, having quaternary nitrogen atoms in the polymer main chain. These polymers are designated in accordance with the INCI nomenclature; detailed information can be found in the CTFA International Cosmetic Ingredient Dictionary and Handbook, 5th Edition, The Cosmetic, Toiletry and Fragrance Association, Washington, 1997, which is expressly incorporated herein by reference.

Cationic polymers which are preferred in accordance with the invention are quaternized cellulose derivatives and also polymeric dimethyldiallylammonium salts and copolymers thereof. Cationic cellulose derivatives, especially the commercial product Polymer® JR 400, are especially preferred cationic polymers.

Irrespective of the chemical composition of the film, preference is given to detergent portions of the invention which are characterized in that the film forming a part of the enclosure (A) and/or (B) has a thickness of from 1 to 150 μm, preferably from 2 to 100 μm, with particular preference from 5 to 75 μm, and in particular from 10 to 50 μm.

A detergent portion of the invention thus comprises two regions, in which different ingredients may be contained or different release mechanisms and dissolution kinetics effectuated. The active substance present in a compartment may adopt any aggregate state or any presentation form whatsoever. Preferred detergent portions comprise the further active substance in at least one compartment in liquid, gel, paste or solid form; see later on below.

When liquid, gellike or pastelike active substances or active substance mixtures are incorporated, the composition of the enclosure and thus also of the film must be tailored to the filling in order to prevent premature destruction of the film or loss of active substance through the enclosure. This is necessary only to a minor extent (chemical incompatibilities) when solid substances are incorporated into the compartments, so that preferred detergent portions comprise in at least one compartment further active substance in particle form, preferably in pulverulent, granular, extruded, pelletized, prilled, flaked or tableted form.

The enclosure sealed by the film can be filled completely with the detersive formulation. It is likewise possible, however, to fill only part of the respective hollow shape prior to sealing, so as to allow the particles or liquids introduced to move within the hollow shape. Particularly in the case of filling with relatively large particles of regular shape it is possible to realize attractive optical effects. Preference is given in this case to detergent portions where the volume ratio of the space embraced by the film and the further enclosure to the detersive formulation contained within said space is from 1:1 to 100:1, preferably from 1.1:1 to 50:1, with particular preference from 1.2:1 to 25:1, and in particular from 1.3:1 to 10:1. In this terminology a volume ratio of 1:1 means that the hollow shape is completely filled.

Through appropriate formulation of the unpressed material which is disintegrable under laundering, cleaning or washing conditions and which gives the hollow body(ies) dimensional stability, and of the film material, it is possible to predetermine the point in time at which the detersive formulation is released. For example, the film may be soluble instantly, so to speak, so that the detersive formulation is dosed right at the beginning of the wash into the wash liquor (or as soon as the film comes into contact with the wash liquor, i.e., in cases where the portion of the invention has no film on its outer face, after the portion has disintegrated into the partial hollow bodies (A) and (B), respectively).

The shape of the "shell" can be chosen freely, with certain geometrical forms such as hemispheres, for example, having been found preferable on esthetic grounds. However, box shapes or shells shaped like the lid of a coffin are also realizable in accordance with the invention. The "shell" may possess an edge having only the thickness of the material, but may also have a web edge which serves as a relatively large attachment surface and sealing surface for the film. In one preferred embodiment of the present invention the "shell" is produced by the injection molding technique from water-soluble thermoplastics. In the case of this process, any partition walls for the subsequent formation of two or more compartments can be included in the injection. Also preferred is the production of the "shell" by a melt casting method from suitable substances (see later on below).

Film sealing of the filled shells takes place by firmly adhering connection with their edges, which can be done, for example, by adhesive bonding, partial melting or by chemical reaction. In the case of subdivided shells, the film providing the lid can be tightly sealed not only at the edges of the outer shell periphery but also with the upper edge of the inner partition walls, thereby ensuring a tight seal between individual compartments as well. In this case the film providing the lid can also be configured such that differently formulated film regions come to lie over the different compartments, so as to influence the disintegration kinetics in aqueous solution and hence the release of the individual formulations from the compartments.

The enclosures (A) and (B) and any further enclosures and/or other constituents of the portions of the invention form, in their entirety, the detergent portion of the invention. It is preferred here for the enclosures (A) and (B) and any further enclosures to be joined together in such a way that at least 80%, preferably at least 90%, and in particular the whole, of the surface area of the detergent portion that is not formed by any part. (d) that may be present is composed of the unpressed material which gives the hollow body(ies) dimensional stability.

In other words, the separately produced partial hollow bodies are assembled such that only a small part (in particularly preferred cases, no part at all) of the surface area of the detergent portion of the invention is formed by film. Instead, the "outer skin" of the detergent portion of the invention is composed predominantly (in particularly preferred cases: completely) of the unpressed material which gives the hollow body dimensional stability.

The corresponding materials, their chemical and physical parameters, and indications relating to their processing were described earlier on above.

The detergent portions of the invention comprise detersive formulations. These may be present in any formulation form whatsoever in the partial hollow bodies and/or compartments. Particularly preferred detergent portions are characterized in this respect in that at least one detersive formulation in the enclosures (A) or (B) is in liquid form.

This liquid must be chosen so that it does not attack the materials of the envelope. Liquids which have been found appropriate here include nonaqueous solutions, suspensions, dispersions or emulsions. Particularly when filling the partial hollow bodies with liquid detersive formulation it is preferred if the enclosure is transparent or at least translucent, in order to allow the esthetic attraction of the liquid filling to be visible from the outside as well. Particularly preferred detergent portions of the invention here are those in which at least one enclosure is transparent or translucent, the wall thickness of the [lacuna] in whole or in part of an unpressed material which is disintegrable under laundering, cleaning or washing conditions and which gives the hollow body(ies) dimensional stability being from 100 to 5000 μm, preferably from 200 to 3000 μm, with particular preference from 300 to 2000 μm, and in particular from 500 to 1500 μm.

The detergent portions of the invention possess at least two regions in which there is detersive formulation. One of these formulations, as stated above, is preferably liquid. The second formulation may likewise be a liquid (where appropriate with a different composition), although it is also possible to use solids of any desired formulation here. Particular preference is given to filling the second cavity with a formulation which is pulverulent to granular.

As a result of their division into two or more separate regions, the detergent portions of the invention can be utilized with preference for separating incompatible active substances. The table below gives a nonlimiting overview of possible active substances and their division into different compartments. The form of the corresponding formulation in the partial hollow body has also been specified.

| Partial hollow body enclosed by (A) | Partial hollow body enclosed by (B) |
|---|---|
| bleach (powder form) | bleach activator (liquid form) |
| bleach (powder form) | enzymes (liquid form) |
| bleach (powder form) | dyes and fragrances (liquid form) |
| bleach (powder form) | optical brighteners (liquid form) |
| bleach (powder form) | silver protectants (liquid form) |
| bleach (granular form) | bleach activator (liquid form) |
| bleach (granular form) | enzymes (liquid form) |
| bleach (granular form) | dyes and fragrances (liquid form) |
| bleach (granular form) | optical brighteners (liquid form) |
| bleach (granular form) | silver protectants (liquid form) |
| bleach (extruded form) | bleach activator (liquid form) |
| bleach (extruded form) | enzymes (liquid form) |
| bleach (extruded form) | dyes and fragrances (liquid form) |
| bleach (extruded form) | optical brighteners (liquid form) |
| bleach (extruded form) | silver protectants (liquid form) |
| bleach (powder form) | bleach activator (powder form) |
| bleach (powder form) | enzymes (powder form) |
| bleach (powder form) | dyes and fragrances (powder form) |
| bleach (powder form) | optical brighteners (powder form) |
| bleach (powder form) | silver protectants (powder form) |
| bleach (granular form) | bleach activator (powder form) |
| bleach (granular form) | enzymes (powder form) |
| bleach (granular form) | dyes and fragrances (powder form) |
| bleach (granular form) | optical brighteners (powder form) |
| bleach (granular form) | silver protectants (powder form) |
| bleach (extruded form) | bleach activator (powder form) |
| bleach (extruded form) | enzymes (powder form) |
| bleach (extruded form) | dyes and fragrances (powder form) |
| bleach (extruded form) | optical brighteners (powder form) |
| bleach (extruded form) | silver protectants (powder form) |
| bleach (powder form) | bleach activator (granular form) |
| bleach (powder form) | enzymes (granular form) |
| bleach (powder form) | dyes and fragrances (granular form) |
| bleach (powder form) | optical brighteners (granular form) |
| bleach (powder form) | silver protectants (granular form) |
| bleach (granular form) | bleach activator (granular form) |
| bleach (granular form) | enzymes (granular form) |
| bleach (granular form) | dyes and fragrances (granular form) |
| bleach (granular form) | optical brighteners (granular form) |
| bleach (granular form) | silver protectants (granular form) |

-continued

| Partial hollow body enclosed by (A) | Partial hollow body enclosed by (B) |
|---|---|
| bleach (extruded form) | bleach activator (granular form) |
| bleach (extruded form) | enzymes (granular form) |
| bleach (extruded form) | dyes and fragrances (granular form |
| bleach (extruded form) | optical brighteners (granular form) |
| bleach (extruded form) | silver protectants (granular form) |
| bleach (powder form) | bleach activator (extruded form) |
| bleach (powder form) | enzymes (extruded form) |
| bleach (powder form) | dyes and fragrances (extruded form) |
| bleach (powder form) | optical brighteners (extruded form) |
| bleach (powder form) | silver protectants (extruded form) |
| bleach (granular form) | bleach activator (extruded form) |
| bleach (granular form) | enzymes (extruded form) |
| bleach (granular form) | dyes and fragrances (extruded form) |
| bleach (granular form) | optical brighteners (extruded form) |
| bleach (granular form) | silver protectants (extruded form) |
| bleach (extruded form) | bleach activator (extruded form) |
| bleach (extruded form) | enzymes (extruded form) |
| bleach (extruded form) | dyes and fragrances (extruded form) |
| bleach (extruded form) | optical brighteners (extruded form) |
| bleach (extruded form) | silver protectants (extruded form) |
| surfactants (liquid form) | bleach activator (liquid form) |
| surfactants (liquid form) | enzymes (liquid form) |
| surfactants (liquid form) | dyes and fragrances (liquid form) |
| surfactants (liquid form) | optical brighteners (liquid form) |
| surfactants (liquid form) | silver protectants (liquid form) |
| surfactants (powder form) | bleach activator (liquid form) |
| surfactants (powder form) | enzymes (liquid form) |
| surfactants (powder form) | dyes and fragrances (liquid form) |
| surfactants (powder form) | optical brighteners (liquid form) |
| surfactants (powder form) | silver protectants (liquid form) |
| surfactants (granular form) | bleach activator (liquid form) |
| surfactants (granular form) | enzymes (liquid form) |
| surfactants (granular form) | dyes and fragrances (liquid form) |
| surfactants (granular form) | optical brighteners (liquid form) |
| surfactants (granular form) | silver protectants (liquid form) |
| surfactants (extruded form) | bleach activator (liquid form) |
| surfactants (extruded form) | enzymes (liquid form) |
| surfactants (extruded form) | dyes and fragrances (liquid form) |
| surfactants (extruded form) | optical brighteners (liquid form) |
| surfactants (extruded form) | silver protectants (liquid form) |
| surfactants (liquid form) | bleach activator (granular form) |

-continued

| Partial hollow body enclosed by (A) | Partial hollow body enclosed by (B) |
|---|---|
| surfactants (liquid form) | enzymes (granular form) |
| surfactants (liquid form) | dyes and fragrances (granular form) |
| surfactants (liquid form) | optical brighteners (granular form) |
| surfactants (liquid form) | silver protectants (granular form) |
| surfactants (powder form) | bleach activator (powder form) |
| surfactants (powder form) | enzymes (powder form) |
| surfactants (powder form) | dyes and fragrances (powder form) |
| surfactants (powder form) | optical brighteners (powder form) |
| surfactants (powder form) | silver protectants (powder form) |
| surfactants (granular form) | bleach activator (powder form) |
| surfactants (granular form) | enzymes (powder form) |
| surfactants (granular form) | dyes and fragrances (powder form) |
| surfactants (granular form) | optical brighteners (powder form) |
| surfactants (granular form) | silver protectants (powder form) |
| surfactants (extruded form) | bleach activator (powder form) |
| surfactants (extruded form) | enzymes (powder form) |
| surfactants (extruded form) | dyes and fragrances (powder form) |
| surfactants (extruded form) | optical brighteners (powder form) |
| surfactants (extruded form) | silver protectants (powder form) |
| surfactants (liquid form) | bleach activator (granular form) |
| surfactants (liquid form) | enzymes (granular form) |
| surfactants (liquid form) | dyes and fragrances (granular form) |
| surfactants (liquid form) | optical brighteners (granular form) |
| surfactants (liquid form) | silver protectants (granular form) |
| surfactants (powder form) | bleach activator (granular form) |
| surfactants (powder form) | enzymes (powder form) |
| surfactants (powder form) | dyes and fragrances (granular form) |
| surfactants (powder form) | optical brighteners (granular form) |
| surfactants (powder form) | silver protectants (granular form) |
| surfactants (granular form) | bleach activator (granular form) |
| surfactants (granular form) | enzymes (granular form) |
| surfactants (granular form) | dyes and fragrances (granular form) |
| surfactants (granular form) | optical brighteners (granular form) |
| surfactants (granular form) | silver protectants (granular form) |
| surfactants (extruded form) | bleach activator (granular form) |
| surfactants (extruded form) | enzymes (powder form) |
| surfactants (extruded form) | dyes and fragrances (granular form) |
| surfactants (extruded form) | optical brighteners (granular form) |
| surfactants (extruded form) | silver protectants (granular form) |
| surfactants (liquid form) | bleach activator (extruded form) |
| surfactants (liquid form) | enzymes (extruded form) |
| surfactants (liquid form) | dyes and fragrances (extruded form) |

-continued

| Partial hollow body enclosed by (A) | Partial hollow body enclosed by (B) |
|---|---|
| surfactants (liquid form) | optical brighteners (extruded form) |
| surfactants (liquid form) | silver protectants (extruded form) |
| surfactants (powder form) | bleach activator (extruded form) |
| surfactants (powder form) | enzymes (extruded form) |
| surfactants (powder form) | dyes and fragrances (extruded form) |
| surfactants (powder form) | optical brighteners (extruded form) |
| surfactants (powder form) | silver protectants (extruded form) |
| surfactants (granular form) | bleach activator (extruded form) |
| surfactants (granular form) | enzymes (extruded form) |
| surfactants (granular form) | dyes and fragrances (extruded form) |
| surfactants (granular form) | optical brighteners (extruded form) |
| surfactants (granular form) | silver protectants (extruded form) |
| surfactants (extruded form) | bleach activator (extruded form) |
| surfactants (extruded form) | enzymes (extruded form) |
| surfactants (extruded form) | dyes and fragrances (extruded form) |
| surfactants (extruded form) | optical brighteners (extruded form) |
| surfactants (extruded form) | silver protectants (extruded form) |

The partial hollow bodies comprising detersive formulation in the enclosures (A) and (B), respectively, are combined with one another to form the detergent portion of the invention. In this context, in accordance with the invention, there is no tie to joining only two partial hollow bodies. Rather, it is also possible to attach further partial hollow bodies, comprising detersive formulation in further enclosures (C) and (D), etc. For reasons of process economy, preference is given here to partial hollow bodies which have planar joining faces. Naturally, there is no tie to joining only filled partial hollow bodies with one another to form the detergent portion of the invention. Instead, it is also possible and preferred to join partial hollow bodies comprising detersive formulation in the enclosures (A) and (B), respectively, with further detersive formulations in solid, dimensionally stable form. In particular, the joining of partial hollow bodies to tablets has proven particularly advantageous here. Corresponding embodiments are described later on below.

As already mentioned above, the portions of the invention are particularly suitable for releasing different detersive formulations from the enclosures (A) and (B), respectively, at different times. This controlled release of defined formulations serves to achieve improved results in the laundering, cleaning or washing operation. Release from the enclosures (A) and (B) can on the one hand be achieved at different times by virtue of the fact that the parts of the respective enclosure which consist of the material imparting dimensional stability to the hollow body have different dissolution or disintegration rates. This is possible, for example, through the choice of the thickness of material. For industrial production, however, it is advantageous to choose the aforementioned part of the enclosures (A) and (B) to be identical, since in this way only one process step must be carried out, where otherwise two independent process steps would be needed. It is more elegant here to choose the other part of the enclosure (in preferred embodiments: the film sealing the shell) to be different in terms of the enclosures (A) and (B), respectively, and in this way to achieve differentiated release of the formulation from the enclosures (A) and (B), respectively. Preference is given here to detergent portions of the invention in which the enclosures (A) and (B) are formed from a film-sealed, injection molded half-shell, the wall thickness of the half-shells of the enclosures (A) and (B) being from 100 to 1000 μm, preferably from 150 to 700 μm, and in particular from 250 to 500 μm, and the thickness of the film of the enclosure (A) being from 10 to 200 μm, preferably from 20 to 100 μm, and in particular from 40 to 80 μm and the thickness of the film of the enclosure (B) being from 20 to 250 μm, preferably from 40 to 200 μm, and in particular from 60 to 150 μm.

As set out in detail later on below, the injection molding operation can be facilitated by adding external plasticizers (e.g., glycerol) to the polymers or using "internally" plasticized polymers.

Through the choice of different film thicknesses and/or film materials, the compositions are released at different times from the partial hollow bodies (A) and (B) which are formed from the portions of the invention, following introduction into the application liquor, by "disintegration" (see below). It is preferred here to release the ingredients from enclosure (A) into the application medium earlier than those from enclosure (B). For this purpose it is possible either to choose a thicker film of the enclosure (B) and/or to chemically modify the film so that it dissolves more readily. Preference is given here to detergent portions of the invention in which the film of enclosure (A) and (B) is composed of thermoplastic polymers, the film of enclosure (B) dissolving retardedly or more slowly in the application liquor than the film of enclosure (A).

Corresponding films of water-soluble thermoplastics are available commercially. By way of example, a suitable film for enclosure (A) is a polyvinyl alcohol film which dissolves with sufficient rapidity even at 20° C., while for enclosure (B) in such a case a film with slower dissolution kinetics at 20° C. is chosen: for example, one having a better solubility above 40° C. or 50 or 60° C.

In the context of the joining together of the closed enclosures (A) and (B) to form the portion of the invention, preference is given to embodiments in which the outer area of the portion is composed completely of the dimensionally stable material (handling reliability). In the abovementioned example of the film-sealed shells, therefore, the film sides are placed against one another and, after the closed enclosures (A) and (B) have been joined, do not come into contact with the external environment; in other words, they are internal. Critical to the type of controlled release elucidated above, through differences in film solubility, is that the closed enclosures (A) and (B) separate from one another in the application liquor, i.e., that the portions of the invention "disintegrate" in the application medium.

This can be achieved, for example, by joining the closed enclosures (A) and (B) using an adhesion promoter which exhibits an extremely high solubility. On contact with the application liquor, the adhesion promoter is rapidly dissolved and releases the two partial hollow bodies from the portion, as a result of which the film sides come into contact with the liquor. Further details on adhesion promoters can be found later on below. In particular, the materials mentioned earlier on above for shells made of fusible materials are suitable adhesion promoters. Merely by way of example mention may be made here of urea and also sodium or potassium hydrogen sulfate.

Particularly preferred detergent portions are characterized in that the closed enclosures (A) and (B) are joined with a water-soluble hotmelt adhesive so that the portion disintegrates in the application liquor within 60 s, preferably within 30 s, in such a way that the film of the closed enclosures (A) and (B), respectively, comes into contact with the application liquor.

The choice of the filling of the partial hollow bodies (A) and (B) can be completely arbitrary, with numerous examples having already been described earlier on above. Particular preference is given in the context of the present invention to detergent portions in which the closed enclosure (A) contains a laundry detergent base composition rich in nonionic surfactants, preferably a liquid laundry detergent, while the closed enclosure (B) preferably contains a composition with further benefit, in particular a bleach compositions and/or an enzyme composition and/or a fragrance formulation and/or a discoloration, graying or hardness inhibitor composition and/or a softener composition.

The ingredients for the aforementioned formulations have been described in detail above. The aforementioned principle can of course be adapted for other detergents, such as for machine dishwashing detergents, in which the closed enclosure (A) contains a detergent composition rich in builders while the closed enclosure (B) preferably contains a composition with further benefit, in particular a rinse aid composition and/or an enzyme composition and/or a fragrance formulation and/or a complexing agent composition and/or a polymer composition.

The present invention further provides a process for producing a detergent portion contained within a hollow body which is at least proportionally filled and is subdivided into at least two compartments, comprising the steps of (i) preparing dimensionally stable hollow bodies optionally comprising one or more means of compartmentalization;

(ii) filling the hollow bodies and/or compartments with detersive formulations;

(iii) sealing the dimensionally stable hollow bodies to form closed enclosures (A), (B), and, if desired, further closed enclosures around the detersive formulation(s);

(iv) joining the closed enclosures (A) and (B) and any further enclosures and/or further detersive formulations in solid, dimensionally stable form to give the detergent portion.

Particularly preferred processes of the invention are characterized in that step (i) comprises an injection molding process which is conducted preferably at a pressure of between 100 and 5000 bar, more preferably between 500 and 2500 bar, with particular preference between 750 and 1500 bar, and in particular between 1000 and 1250 bar, and preferably at temperatures between 100 and 250° C., more preferably between 120 and 200° C., and in particular between 140 and 180° C.

As already set out during the description of the detergent portions of the invention, the individual hollow bodies are preferably not completely filled. In the case of processes of the invention as well, preference is given to those in which the hollow bodies and/or compartments are filled in step (ii) to from 20 to 100%, preferably from 30 to 95%, with particular preference from 40 to 90%, and in particular from 50 to 85% of their volume with detersive formulations.

Earlier on above, film materials and physical parameters of the films were already addressed at length. In analogy, in the case of the process of the invention, preference is given to those in which the sealing of the hollow bodies takes place with a water-soluble film, the film having a thickness of from 1 to 150 μm, preferably from 2 to 100 μm, with particular preference from 5 to 75μm, and in particular from 10 to 50μm.

Following the production of the filled partial hollow bodies surrounded by the enclosures (A) and (B), they are joined together. Preference is given here to processes of the invention in which the joining of the enclosures (A) and (B) and also any further enclosures and/or further detersive formulations in solid, dimensionally stable form to form the detergent portion in step (iv) takes place by cold sealing, adhesive bonding with water-soluble hotmelt adhesives, adhesive bonding with adhesive solutions, or mechanical joining.

Preference is given in the context of the present invention to adhesive bonding of the partial hollow bodies to one another using adhesion promoters. As adhesion promoters it is possible to use substances which impart a sufficient adhesion ("tack") to the surfaces to which they are applied, so that the partial hollow bodies adhere durably to one another. Substances suitable here in principle are the substances mentioned in the relevant adhesives literature and in particular in the monographs therein, particular importance attaching in the context of the present invention to the application of melts which have an adhesion-promoting effect at elevated temperature but after cooling are no longer tacky but solid instead.

Processes of the invention in which adhesion promoters used in step iv) are melts of one or more substances having a melting range of from 40° C. to 75° C. are therefore preferred.

A variety of requirements are imposed on the adhesion promoters, relating on the one hand to the melting or solidification behavior but on the other hand also to the material properties in the solidified range at ambient temperature. Since the partial hollow bodies bonded to one another are to hold to one another durably in transit or storage, the adhesive bond must have a high stability with respect, for example, to impact loads which occur during packing or transit. Thus the adhesion promoters ought to have either at least partly elastic or at least plastic properties, in order to react to any impact load which occurs by elastic or plastic deformation, and not to break up. The adhesion promoters ought to have a melting range (solidification range) in a temperature range in which the partial hollow bodies or the formulations they contain are not exposed to excessive thermal load. On the other hand, however, the melting range must be sufficiently high to offer effective attachment at a temperature which is at least slightly elevated. In accordance with the invention the enveloping substances preferably have a melting point of above 30° C. The breadth of the melting range of the adhesion promoters likewise has direct consequences for the process regime. In the subsequent process step, the partial hollow body provided with adhesion promoter has to be contacted with the further partial hollow body(ies)—the adhesiveness must not be lost in the meantime. Following adhesive bonding to one another, the adhesiveness should be reduced as rapidly as possible in order to avoid unnecessary loss of time and to avoid instances of caking and congestion in downstream process steps or during handling and packaging. Where melts are employed, the reduction in adhesiveness can be assisted by cooling (for example, by blowing with cold air).

It has proven advantageous for the adhesion promoters not to exhibit a sharply defined melting point, such as commonly occurs with pure, crystalline substances, but instead to have a melting range which spans, under certain circumstances, several degrees Celsius.

The adhesion promoters preferably have a melting range which is situated between about 45° C. and about 75° C. In the present case, this means that the melting range is within the stated temperature interval, and does not define the breadth of the melting range. The breadth of the melting range is preferably at least 1° C., more preferably from about 2 to about 3° C.

The abovementioned properties are generally satisfied by what are known as waxes. By "waxes" are meant a series of natural or artificially obtained substances which generally melt above 40° C. without decomposition and are of relatively low viscosity, without stringing, at just a little above the melting point. They have a highly temperature-dependent consistency and solubility.

Waxes are divided into three groups according to their origin: natural waxes, chemically modified waxes, and synthetic waxes.

The natural waxes include, for example, plant waxes such as candelilla wax, carnauba wax, Japan wax, espartograss wax, cork wax, guaruma wax, rice germoil wax, sugarcane wax, ouricury wax, or montan wax, animal waxes such as beeswax, shellac wax, spermaceti, lanolin (wool wax) or uropygial grease, mineral waxes, such as ceresin or ozokerite (earth wax), or petrochemical waxes such as petrolatum, paraffin waxes or microcrystalline waxes.

The chemically modified waxes include, for example, hard waxes such as montan ester waxes, sassol waxes or hydrogenated jojoba waxes.

By synthetic waxes are meant, in general, polyalkylene waxes or polyalkylene glycol waxes. As adhesion promoters it is also possible to use compounds from other classes of substance which meet the stated requirements with regard to the softening point.

Synthetic compounds which have proven suitable are, for example, higher esters of phthalic acid, especially dicyclohexyl phthalate, which is available commercially under the name Unimoll® 66 (Bayer AG). Also suitable are waxes prepared synthetically from lower carboxylic acids and fatty alcohols, an example being dimyristyl tartrate, which is available under the name Cosmacol® ETLP (Condea). Conversely, it is also possible to employ synthetic or partly synthetic esters of lower alcohols with fatty acids from natural sources. This class of substance includes, for example, Tegin® 90 (Goldschmidt), a glycerol monostearate palmitate. Shellac, shellac-KPS-Dreiring-SP (Kalkhoff GmbH) for example, can also be used in accordance with the invention as an adhesion promoter.

Likewise counted as waxes in the context of the present invention are, for example, the substances known as wax alcohols. Wax alcohols are relatively high molecular mass fatty alcohols which are insoluble in water and have in general from about 22 to 40 carbon atoms. The wax alcohols occur, for example, in the form of wax esters of relatively high molecular mass fatty acids (wax acids), as a principal constituent of many natural waxes. Examples of wax alcohols are lignoceryl alcohol (1-tetracosanol), cetyl alcohol, myristyl alcohol or melissyl alcohol. The adhesion promoters in step iv) may if desired also comprise wool wax alcohols, by which are meant triterpenoid and steroid alcohols, lanolin for example, which is available, for example, under the commercial designation Argowax® (Pamentier & Co). In the context of the present invention it is likewise possible to use, at least proportionally, as a constituent of the adhesion promoters, fatty acid glycerol esters or fatty alkanolamides, but also, if desired, water-insoluble or only sparingly water-soluble polyalkylene glycol compounds.

If temperature-controlled release of the partial hollow bodies bonded to one another is desired, the solubility in water—even water at elevated temperature—of the adhesion promoters should be as low as possible, in order as far as possible to avoid temperature-independent release of the enveloped active substances.

The adhesion promoters for application in process step iv) may be pure substances or substance mixtures. In the latter case the melt may comprise varying amounts of adhesion promoter and auxiliaries.

The principle described above serves for the retarded detachment of the partial hollow bodies bonded to one another in step iv) from one another at a defined point in time, in the wash cycle of a dishwasher, for example, and can be employed with particular advantage when washing in the main wash cycle is carried out at a relatively low temperature (55° C. for example), so that the active substance is released from the adhesive layer only in the rinse cycle at higher temperatures (about 70° C.).

It is, however, also possible to turn the said principle around such that the partial hollow bodies are parted from one another not with a delay but instead with acceleration. In the process of the invention this can be achieved in a simple way by using, as adhesion promoters in step iv), not dissolution retarders but instead dissolution accelerators, so that the partial hollow bodies do not part from one another more slowly but instead more rapidly. In contrast to the adhesion promoters of poor water-solubility, described above, adhesion promoters preferred for rapid detachment are readily soluble in water. The solubility of the adhesion promoters in water can be further increased significantly by means of certain additions: for example, by incorporating readily soluble salts or effervescent systems. Solution-accelerated adhesion promoters of this kind (with or without additions of further solubility improvers) lead to rapid detachment and thus, depending on the nature and thickness of the film, to the release of the detersive formulations at the beginning of the laundering, washing or cleaning cycle.

The acceleration of dissolution may also be assisted or achieved by means of certain geometric factors. Detailed remarks concerning this can be found later on below.

Particularly suitable adhesion promoters for accelerated release are the abovementioned synthetic waxes from the group of the polyethylene glycols and polypropylene glycols. Besides the PEGs and PPGs which can be used with preference as adhesion promoters it is of course also possible to employ other substances provided they possess a sufficiently high water-solubility and have a melting point of above 30° C.

In addition to melts, other substances too may be applied as adhesion promoters in step iv) of the process of the invention. Examples of substances suitable for this purpose include concentrated salt solutions, which following application of the active substances are converted into an adhesion-promoting salt crust by crystallization or evaporation. It is of course also possible to use saturated solutions or solutions of salts in solvent mixtures.

As adhesion promoters in step iv) it is also possible to employ solutions or suspensions of water-soluble or water-dispersible polymers, preferably polycarboxylates. These substances have already been described on account of their cobuilder properties.

Further especially suitable adhesion promoters are solutions of water-soluble substances from the group consisting of (acetalized) polyvinyl alcohol, polyinylpyrrolidone, gelatin, and mixtures thereof. These substances have already been described earlier on above, as film materials.

The application of adhesion promoter preferably to the edge region of the sealed partial hollow bodies can take place in various ways. It is possible, for example, to wet the sealed partial hollow body with adhesive on one side, in a dipping process, and then to place it in the cavity. This technology is simple to realize but harbors the risk that the adhesive will wet the film as a whole and thereby make any film-controlled release envisaged more difficult. In this variant, the amount of adhesive can be controlled by varying the rheological properties of the adhesion promoters.

Another possibility of applying adhesion promoters, and one which is preferred in the context of the present invention, consists in guiding the surfaces to be wetted (generally the edges of the partial hollow bodies) past adhesive metering systems. This can be achieved by means of nozzles which meter adhesion promoter, nonwovens or brushes soaked with adhesion promoters, or rollers. The latter process configuration is particularly simple to realize.

The aforementioned possibilities of the joining of partial hollow bodies can also be utilized for the purpose of making the entire portion of the invention, or parts thereof, more rapidly soluble. Where, for example, two partial hollow bodies are bonded to one another with adhesion promoter at their planar surfaces (usually the film-sealed opening of the "shell"), then under application conditions the ingress of water to the adhesive when the portion of the invention has not yet undergone incipient dissolution is possible only at the edges. Even where readily water-soluble adhesion promoters are used, the connection can in practice not be parted until part of the overall portion has dissolved.

Through targeted application of the adhesion promoter it is possible to overcome the drawbacks mentioned. Thus it is possible, for example, and preferred, not to apply the adhesion promoter to the joining surface when joining two partial hollow bodies by their planar surfaces but instead only to apply "adhesion promoter dots" to the contact edge and/or to the corners. On application, these are immediately subjected to the ingress of water, so that the two partial hollow bodies separate from one another more rapidly. Where two partial hollow bodies with a rectangular contact surface are joined to one another in this way, it is not necessary to apply the adhesion promoter to all four edges. Instead, a contribution can be made to the even more rapid separation of the join by applying dots of adhesion promoter only at the four corners. For even more rapid separation it is possible to dispense with individual dots of adhesion promoter, so that, for example, only two diagonally opposite contact corners are provided with adhesion promoter.

In summary: if more rapid dissolution of the entire portion or individual parts is required, then rapid surface enlargement by separation of the attachment is optimal. This can be achieved or assisted by the selection of a favorable form of the attachment. In such cases linear adhesive bonding is to be preferred over extensive adhesive bonding, with dot adhesive bonding being particularly preferred.

The process for producing the detergent portion of the invention contained within one or more dimensionally stable hollow bodies comprising at least one compartment is accomplished in ways which are known per se by producing, in a first step, one or more dimensionally stable hollow bodies. This can take place, for example, by thermoforming, casting (for example, by techniques known from the confectionery industry or modified), injection molding, sintering or casting (for example) of inorganic mixtures. For the production of the dimensionally stable hollow bodies of the invention, processes which operate with compression are excluded for the production of the hollow body(ies).

Techniques for the thermal shape conversion of polymers by thermoforming are known per se from the prior art. A sheet or film of a polymer is shaped at elevated temperature by means of a thermoforming press, which is composed of upper and lower molds, to give the desired blank comprising a dimensionally stable polymer. A disadvantage of this procedure for the present case, production of a hollow body, is the fact that when the blank is demolded a vacuum is formed in the interior of the hollow body and must be removed by blowing in a gas. As a result, the otherwise technically simple thermoforming press becomes complex. Moreover, with the procedure of thermoforming it is possible only to realize very irregular wall thicknesses s of the dimensionally stable hollow body. Furthermore, with the procedure of thermoforming, dimensionally stable hollow bodies comprising compartmentalization means cannot be produced in one step.

In accordance with a further procedure, blanks for dimensionally stable hollow bodies can also be produced by casting the polymer into correspondingly prepared molds. The process variant of casting allows not only the use of meltable polymers as wall materials but also of other meltable substances.

The production of the external hollow shapes can be carried out process-economically by means of what are termed casting techniques, this technology specifically allowing a very great degree of flexibility in terms of the processing to give the hollow shape and in terms of the material systems used. A common feature of casting techniques is the shape conversion of a fluid mixture which is brought to solidification under appropriate conditions.

The invention further provides a process for producing portioned detergents, comprising the steps of:

i) producing an open hollow shape by solidification;

ii) filling the hollow shape with detergent;

iii) if desired, sealing the hollow shape.

The production of the open hollow shape comprises the shaping of a shapable, preferably fluid, mixture or substance and its solidification to form a dimensionally stable hollow shape. In the context of the present invention, "solidification" characterizes any curing mechanism whatsoever which yields a body which is solid at room temperature from a shapable, preferably fluid, mixture or substance or composition without the need for compression or compaction forces. "Solidification" in the sense of the present invention, therefore, is, for example, the curing of melts of substances solid at room temperature by cooling. "Solidification events" in the sense of the present specification are also the curing of shapable compositions by temporally retarded water binding, by evaporation of solvents, by chemical reaction, crystallization, etc., and also the reactive curing of flowable powder mixtures to give stable hollow bodies. As already remarked earlier on above, tableting, pelletizing, and briquetting events, etc., i.e., compression methods, do not belong in this category.

In summary, preference is given to processes of the invention in which the open hollow shape is produced by temporally retarded water binding, by cooling below the melting point, by evaporation of solvents, by crystallization, by chemical reaction(s), especially polymerization, by a change in rheological properties as a result, for example, of altered shearing, by sintering or by means of radiation curing, particularly by means of UV, alpha beta or gamma rays.

Said solidification mechanisms are described in detail later on below.

For the conduct of the process of the invention it is not necessary for the open hollow shape to be produced and stored in the interim until, for example, it is filled. Instead, steps i) and ii) of the process of the invention may also be conducted simultaneously, by filling a hollow shape "in situ", i.e., directly during its production. This is particularly simple to realize in the production of hollow shapes from self-solidifying compositions (for example, by cooling below the melting point or by temporally retarded water binding), by metering the filling on the inside and the material for the hollow shape on the outside through a two-fluid nozzle, constructed like a Daniell valve, into a mold. This "one-shot" process, described in detail later on below, allows the economic production of large quantities of shaped, bodies.

Accordingly, preference is given to processes of the invention in which steps i) and ii) are conducted simultaneously.

Naturally, however, it is also possible to conduct the process of the invention "step by step", so that, for example, hollow bodies are produced and then filled. This technology includes the possibility of altering the formula of the detergent introduced in step ii) without having to adapt the process. This procedure is advisable particularly in respect of detergents which cannot be metered or are not easily meterable using two-fluid nozzles. Processes in which steps i) and ii) are conducted in succession, accordingly, are also preferred embodiments of the present invention.

Regardless of whether the "shell" (the open hollow shape) is produced prior to filling or simultaneously therewith, producing the shell comprises shaping a shapable mixture which while it is being or after it has been shaped solidifies to form the open hollow shape. The shapable mixture, which may also consist of a single substance, may be present in the form of a powder, liquid, gel, melt, etc., with one or more of the solidification mechanisms specified earlier on above coming into play, depending on composition.

Particularly preferred from the standpoint of process economics are melts, because they solidify by simple cooling below the melting point and in general have good processing properties. Particular preference is therefore given to processes of the invention in which the open hollow shape is produced in step i) by solidification of a melt composed of a material whose melting point is situated in the range from 40 to 1000° C., preferably from 42.5 to 500° C., with particular preference from 45 to 200° C., and in particular from 50 to 160° C.

Substances particularly suitable for conducting this variant of the process of the invention are, for example, polyethylene glycols $$H—(O—CH_2—CH_2)_n—OH$$

in which the degree of polymerization, n, may adopt values between about 30 and several thousand. Various nomenclatures exist for polyethylene glycols, and can lead to confusion. It is common in the art to specify the average relative molar weight following the letters "PEG", so that "PEG 200" characterizes a polyethylene glycol having a relative molar mass of from about 190 to about 210. For cosmetic ingredients a different nomenclature is used, in which the abbreviation PEG is given a hyphen and the hyphen is followed directly by a number which corresponds to the number n in the above formula. Polyethylene glycols are available commercially, for example, under the trade names Carbowax® PEG (Union Carbide), Emkapol® (ICI Americas), Lipoxol® (HULS America), Polyglycol® E (Dow Chemical), Alkapol® PEG (Rhone-Poulenc), Lutrol® E (BASF).

The molar masses of preferred polyethylene glycols are situated in the range between 1500 and 35 000 daltons, preferably between 2000 and 30 000 Da, with particular preference between 3000 and 25 000 Da, and in particular between 4000 and 20 000 Da.

It is also possible, moreover, to use polypropylene glycols (abbreviation: PPG)

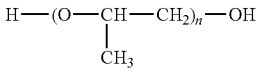

in which the degree of polymerization, n, likewise is able to adopt values between about 30 and several thousand. As far as the molecular weights of PPGs whose use is preferred are concerned, the comments made in respect of PEG apply analogously.

The polyethylene or polypropylene glycols can be used with particular advantage in a mixture with other substances as the shell material. Particularly suitable additives to the polyalkylene glycols are polymers or polymer mixtures, the polymer or at least 50% by weight of the polymer mixture being selected from graft copolymers obtainable by grafting (a) polyalkylene oxides with (b) vinyl acetate. These polymers are described in more detail below.

The graft copolymers suitable in the context of the present invention as an additive to polyalkylene glycols are obtainable by grafting a polyalkylene oxide with vinyl acetate, it being possible for some of the acetate groups of the vinyl acetate to have been hydrolyzed. Particularly suitable polyalkylene oxides include polymers with ethylene oxide, propylene oxide, and butylene oxide units, polyethylene oxide being preferred.

The graft copolymers are prepared, for example, by dissolving polyalkylene oxides in vinyl acetate and carrying out continuous or batchwise polymerization following the addition of a polymerization initiator, or by semicontinuous polymerization, in which a part of the polymerization mixture comprising polyalkylene oxide, vinyl acetate, and polymerization initiator is heated to polymerization temperature, after which the remainder of the mixture to be polymerized is added. The graft copolymers may also be obtained by initially introducing polyalkylene oxide, heating it to the polymerization temperature, and adding vinyl acetate and polymerization initiator either all at once, in stages or, preferably, continuously.

Processes preferred in the context of the present invention employ in step i) melts of polyalkylene glycols which include at least one polymer obtainable by grafting (a) polyalkylene oxides having a molecular weight of from 1500 to 70 000 g $mol^{-1}$ with (b) vinyl acetate in a weight ratio (a):(b) of from 100:1 to 1:5, up to 15% of the acetate groups having been hydrolyzed where appropriate. In preferred embodiments of the present invention the molecular weight of the polyalkylene oxides present in the graft copolymers is from 2000 to 50 000 g $mol^{-1}$, preferably from 2500 to 40 000 g $mol^{-1}$, with particularly preference from 3000 to 20 000 g $mol^{-1}$, and in particular from 4000 to 10 000 g $mol^{-1}$.

The fraction of the individual monomers of the graft copolymers that are added to the melt may vary as a function of the desired properties of the open hollow shape. Preference is given here to polymers in which the vinyl acetate fraction is from 1 to 60% by weight, preferably from 2 to 50% by weight, with particular preference from 3 to 40% by weight, and in particular from 5 to 25% by weight, based in each case on the graft copolymer.

A graft copolymer which is particularly preferred in the context of the present invention is based on a polyethylene oxide having an average molar mass of 6000 g $mol^{-1}$ (corresponding to 136 ethylene oxide units) which contains about 3 parts by weight of vinyl acetate per part by weight of polyethylene oxide. This polymer, which possesses an average molar mass of approximately 24 000 g $mol^{-1}$, is commercialized by BASF under the name Sokalan® HP22.

A further class of substance which is outstandingly suitable as material for the open hollow shape are aliphatic and aromatic dicarboxylic acids, which can be melted, and processed in accordance with the invention, individually, in a mixture with one another or else in a mixture with other substances. Particularly preferred dicarboxylic acids are summarized in the table below:

| Trivial name | IUPAC name | Melting point [° C.] |
|---|---|---|
| oxalic acid | ethanedioic acid | 101.5 |
| malonic acid | propanedioic acid | 135 |
| succinic acid | butanedioic acid | 185 |
| glutaric acid | pentanedioic acid | 97 |
| adipic acid | hexanedioic acid | 153 |
| pimelic acid | heptanedioic acid | 105 |
| azelaic acid | nonanedicic acid | 106 |
| sebacic acid | decanedioic acid | 134.5 |
| | dodecanedioic acid | 128 |
| maleic acid | (Z)-butenedioic acid | 130-139 |
| fumaric acid | (E)-butenedioic acid | 287 |
| sorbic acid | 2,4-hexadienedioic acid | 134 |
| phthalic acid | benzene-1,2-dicarboxylic acid | 208 |
| terephthalic acid | benzene-1,4-dicarboxylic acid | |

Instead of said dicarboxylic acids or in a mixture with them it is also possible to use the corresponding anhydrides, which is particularly advantageous in the case of glutaric acid, maleic acid, and phthalic acid.

Besides the dicarboxylic acids, carboxylic acids and their salts are also suitable as materials for producing the open hollow shape. From this class of substance, citric acid and trisodium citrate and also salicylic acid and glycolic acid have proved particularly suitable. With particular advantage it is also possible to use fatty acids, preferably having more than 10 carbon atoms, and their salts as material for the open hollow shape. Examples of carboxylic acids which can be used in the context of the present invention are hexanoic acid (caproic acid), heptanoic acid (enanthic acid), octanoic acid (caprylic acid), nonanoic acid (pelargonic acid), decanoic acid (capric acid), undecanoic acid, etc. In the context of the present connection it is preferred to use fatty acids such as dodecanoic acid (lauric acid), tetradecanoic acid (myristic acid), hexadecanoic acid (palmitic acid), octadecanoic acid (stearic acid), eicosanoic acid (arachidic acid), docosanoic acid (behenic acid), tetracosanoic acid (lignoceric acid), hexacosanoic acid (cerotinic acid), triacotanoic acid (melissic acid), and also the unsaturated species 9c-hexadecenoic acid (palmitoleic acid), 6c-octadecenoic acid (petroselinic acid), 6t-octadecenoic acid (petroselaidic acid), 9c-octadecenoic acid (oleic acid), 9t-octadecenoic acid ((elaidic acid), 9c,12c-octadecadienoic acid (linoleic acid), 9t,12t-octadecadienoic acid (linolaidic acid), and 9c,12c,15c-octadecatreinoic acid (linolenic acid). On grounds of cost it is preferred to use not the pure species but rather technical-grade mixtures of the individual acids, such as are obtainable from cleavage of fats. Such mixtures are, for example, coconut oil fatty acid (about 6% by weight $C_8$, 6% by weight $C_{10}$, 48% by weight $C_{12}$, 18% by weight $C_{14}$, 10% by weight $C_{16}$, 2% by weight $C_{18}$, 8% by weight $C_{18'}$, 1% by weight $C_{18''}$), palm kernel oil fatty acid (about 4% by weight $C_8$, 5% by weight $C_{10}$, 50% by weight $C_{12}$, 15% by weight $C_{14}$, 7% by weight $C_{16}$, 2% by weight $C_{18}$, 15% by weight $C_{18'}$, 1% by weight $C_{18''}$), tallow fatty acid (about 3% by weight $C_{14}$, 26% by weight $C_{16}$, 2% by weight $C_{16'}$, 2% by weight $C_{17}$, 17% by weight $C_{18}$, 44% by weight $C_{18'}$, 3% by weight $C_{18''}$, 1% by weight $C_{18'''}$), hydrogenated tallow fatty acid (about 2% by weight $C_{14}$, 28% by weight $C_{16}$, 2% by weight $C_{17}$, 63% by weight $C_{18}$, 1% by weight $C_{18'}$), technical-grade oleic acid (about 1% by weight $C_{12}$, 3% by weight $C_{14}$, 5% by weight $C_{16}$, 6% by weight $C_{16'}$, 1% by weight $C_{17}$, 2% by weight $C_{18}$, 70% by weight $C_{18'''}$), 10% by weight $C_{18''}$, 0.5% by weight $C_{18'''}$), technical-grade palmitic/stearic acid (about 1% by weight $C_{12}$, 2% by weight $C_{14}$, 45% by weight $C_{16}$, 2% by weight $C_{17}$, 47% by weight $C_{18}$, 1% by weight $C_{18'}$), and soybean oil fatty acid (about 2% by weight $C_{14}$, 15% by weight $C_{16}$, 5% by weight $C_{18}$, 25% by weight $C_{18'}$, 45% by weight $C_{18''}$, 7% by weight $C_{18'''}$).

Industrially, the aforementioned carboxylic acids are obtained largely from naturally occurring fats and oils by hydrolysis. While the alkaline saponification carried out as early ago as the last century led directly to the alkali metal salts (soaps), nowadays only water is used industrially for the cleavage, and cleaves the fats into glycerol and the free fatty acids. Examples of processes employed industrially are cleavage in an autoclave or continuous high-pressure cleavage. The alkali metal salts of the above-mentioned carboxylic acids or carboxylic acid mixtures can also be used, where appropriate in a mixture with other materials, for producing the open hollow shape.

Further suitable materials which can be processed by the melt state to give open hollow shapes are hydrogen carbonates, particularly the alkali metal hydrogen carbonates, especially sodium and potassium hydrogen carbonate, and also the hydrogen sulfates, particularly alkali metal hydrogen sulfates, especially potassium hydrogen sulfate and/or sodium hydrogen sulfate. Also proven particularly suitable has been the eutectic mixture of potassium hydrogen sulfate and sodium hydrogen sulfate, consisting of 60% by weight $NaHSO_4$ and 40% by weight $KHSO_4$.

Further suitable materials for the open hollow shape which can be processed by the melt state in step i) of the process of the invention are sugars. In the context of the present invention the term "sugars" characterizes single and multiple sugars, i.e., monosaccharides and oligosaccharides, in which from 2 to 6 monosaccharides are joined to one another in the manner of acetals. In the context of the present invention, therefore, "sugars" are monosaccharides, disaccharides, trisaccharides, tetra-, penta- and hexasaccharides.

Monosaccharides are linear polyhydroxy aldehydes (aldoses) or polyhydroxy ketones (ketoses). They generally have a chain length of five (pentoses) or six (hexoses) carbon atoms. Monosaccharides having more (heptoses, octoses, etc.) or fewer (tetroses) carbon atoms are relatively uncommon. Some monosaccharides have a large number of asymmetric carbon atoms. For a hexose having four asymmetric carbon atoms, the resulting number of stereoisomers is 24. The orientation of the OH group on the highest-numbered asymmetric carbon atom in the Fischer projection divides the monosaccharides into series with D and L configuration. In the case of the naturally occurring monosaccharides the D configuration is by far the most common. Where possible, monosaccharides form intramolecular hemiacetals, giving annular structures of the pyran (pyranoses) and furan (furanoses) types. Smaller rings are unstable, larger rings stable only in aqueous solutions. The cyclization produces a further asymmetric carbon atom (known as the anomeric carbon atom), which doubles the number of possible stereoisomers again. This is expressed by means of the prefixes α- and β-. The formation of the hemiacetals is a dynamic process which is dependent on various factors such as temperature, solvent, pH, etc. In the majority of cases, mixtures of both anomeric forms are present, in some cases also in mixtures of the furanose and pyranose forms.

Examples of monosaccharides which can be used as sugars in the context of the present invention are the tetroses D(−)-erythrose and D(−)-threose and also D(−)erythrulose, the pentoses D(−)-ribose, D(−)-ribulose, D(−)-arabinose, D(+)-xylose, D(−)-xylulose and also D(−)lyxose, and the hexoses D(+)-allose, D(+)-altrose, D(+)-glucose, D(+)-mannose, D(−)-gulose, D(−)-idose, D(+)-galactose, D(+)-talose, D(+)-psicose, D(−)fructose, D(+)-sorbose, and D(−)-tagatose. The most important and most widespread monosaccharides are the following: D-glucose, D-galactose, D-mannose, D-fructose, L-arabinose, D-xylose, D-ribose, and 2-deoxy-2-ribose.

Disaccharides are composed of two single monosaccharide molecules (D-glucose, D-fructose, etc.) linked by a glycosidic linkage. If the glycosidic linkage is between the acetal carbon atoms (1 in the case of aldoses or 2 in the case of ketoses) of the two monosaccharides, then the ring form is fixed in both; the sugars exhibit no mutarotation, do not react with ketone reagents, and no longer have a reducing action (Fehling's-negative: trehalose or sucrose type). If, on the other hand, the glycosidic linkage connects the acetal carbon atom of one monosaccharide with any carbon atom of the second, then the monosaccharide may also adopt the open-chain form, and the sugar continues to have a reducing action (Fehling's-positive: maltose type).

The most Important disaccharides are sucrose (cane sugar, saccharose), trehalose, lactose (milk sugar), lactulose, maltose (malt sugar), cellobiose (degradation product of cellulose), gentobiose, melibiose, turanose, et cetera.

Trisaccharides are carbohydrates composed of 3 Monosaccharides linked glycosidically with one another, for which the incorrect designation trioses is occasionally also encountered. Trisaccharides are relatively uncommon in nature; examples are gentianose, kestose, maltotriose, melecitose, raffinose, and, as examples of trisaccharides containing amino sugars, streptomycin and validamycin.

Tetrasaccharides are oligosaccharides having 4 Monosaccharide units. Examples of this class of compound are stachyose, lychnose (galactose-glucose-fructose-galactose), and secalose (comprising 4 fructose units).

In the context of the present invention it is preferred as sugars to use saccharides from the group consisting of glucose, fructose, sucrose, cellubiose, maltose, lactose, lactulose, ribose, and mixtures thereof.

A further particularly preferred material for the open hollow shape is urea, the diamide of carbonic acid, which is occasionally also referred to as carbamide and can be described by the formula $H_2N—CO—NH_2$. Urea forms colorless, odorless crystals with a density of 1.335 which melt at 133° C. Urea is soluble in water, methanol, ethanol, and glycerol with a neutral reaction. Particularly in a mixture with other substances, urea is outstandingly suitable as a material for the hollow shape. Thus, for example, polyethylene glycols and polypropylene glycols, fragrances, dyes, etc. in large amounts can be melted together with the urea and processed to give the open hollow shape, without adversely affecting the mechanical and haptic properties of the hollow shape.

Further suitable materials which may be added, in some cases in large amounts, to the abovementioned meltable substances are silicates, phosphates and/or starches.

When processing the melts to give the open hollow shape it may be of advantage to incorporate additives into the melts.

Those which have proven particularly suitable here, besides the dyes and fragrances which are used for esthetic reasons, include, for example, disintegration assistants, reinforcing fibers or liquid binders. Disintegration assistants have been described in detail earlier on above; examples of suitable reinforcing fibers include natural or synthetic polymer fibers. Microcrystalline cellulose is another suitable additive.

To sum up, preference is given to processes of the invention in which the melt in step i) comprises one or more substances from the groups of the carboxylic acids, carboxylic anhydrides, dicarboxylic acids, dicarboxylic anhydrides, hydrogen carbonates, hydrogen sulfates, polyethylene glycols, polypropylene glycols, sodium acetate trihydrate and/or urea in amounts of at least 40% by weight, preferably at least 60% by weight, and in particular at least 80% by weight, based in each case on the melt.

The solidification of the shapable mixtures may take place by different mechanisms, those which can be mentioned including temporally retarded water binding, the evaporation of solvents, crystallization, chemical recation(s), especially polymerization, the changing of rheologlcal properties as a result, for example, of altered shearing of the composition(s), and also radiation curing by UV, alpha beta or gamma rays as the most important curing mechanisms in addition to the cooling below the melting point that has already been mentioned.

In processes which are likewise preferred in the context of the present invention, solidification takes place by means of temporally retarded water binding.

The temporally retarded water binding can itself be realized in different ways. Appropriate here, for example, are raw materials or raw material mixtures which comprise hydratable, water-free raw materials, or raw materials in low hydration states, which are able to undergo transition to stable higher hydrates, and also comprise water. The formation of the hydrates, which is not spontaneous, then leads to the binding of free water, which in turn leads to a hardening of the mixtures, accompanied by the formation of the hollow shape. After that, it is no longer possible to carry out shaping processing using low pressures, and the hollow bodies present are stable to handling.

The temporally offset binding of water may also take place, for example, by incorporating salts which contain water of hydrate, and which dissolve in their own water of crystallization when the temperature is raised, into the compositions. If the temperature subsequently falls, the water of crystallization becomes bound again, leading to a loss of the possibility of shaping processing with simple means and to a solidification of the compositions.

The swelling of natural or synthetic polymers temporally retarded water binding mechanism is also capable of utilization in the context of the process of the invention. It is possible here to incorporate mixtures of unswollen polymer and suitable swelling agent, e.g., water, diols, glycerol, etc., into the compositions, with swelling and hardening taking place after shaping.

The most important mechanism of hardening by temporally retarded water binding is the use of a combination of water and water-free or low-water-content raw materials, which slowly hydrate. Particularly appropriate for this purpose are substances which contribute to cleaning performance in the laundering or cleaning operation. Examples of preferred ingredients of the hollow shapes in the context of the process of the invention are phosphates, carbonates, silicates, and zeolites.

It is particularly preferred if the hydrate forms produced have low melting points, since in this way a combination of the curing mechanisms by internal drying and cooling is achieved. Preferred processes are characterized in that the starting materials for the hollow shape contain from 10 to 95% by weight, preferably from 15 to 90% by weight, with particular preference from 20 to 85% by weight, and in particular from 25 to 80% by weight of water-free substances which undergo transition, through hydration, into a hydrate form having a melting point below 120° C., preferably below 100° C., and in particular below 80° C.

The deformable properties can be influenced by adding plasticizing auxiliaries such as polyethylene glycols, polypropylene glycols, waxes, paraffins, nonionic surfactants, etc. Further details on said classes of substance can be found earlier on above.

Raw materials whose use is preferred in the context of the production of the open hollow shapes come from the group of the phosphates, with alkali metal phosphates being particularly preferred. In the context of the production, these substances are used in water-free or low-water-content form and the desired plastic properties or shapeable properties of the compositions are adjusted with water and also optional plasticizing auxiliaries. After shaping processing, the fully formed hollow shapes are then hardened by hydration of the phosphates.

In preferred processes, the mixtures used to produce the hollow shapes comprise phosphate(s), preferably alkali metal phosphate(s), with particular preference pentasodium and/or pentapotassium triphosphate (sodium or potassium tripolyphosphate, respectively) in amounts of from 20 to 80% by weight, preferably from 25 to 75% by weight, and in particular from 30 to 70% by weight, based in each case on their weight.

Where phosphates are used as sole hydratable substances, the amount of water added should not exceed their water binding capacity, in order to minimize the free water content of the hollow bodies. Overall, in order to stay within the abovementioned limits, processes which have been found preferable are those in which the weight ratio of phosphate(s) to water in the mixtures for producing the hollow shapes is less than 1:0.3, preferably less than 1:0.25, and in particular less than 1:0.2.

Further ingredients, which may be present instead of or in addition to phosphates, are carbonates and/or hydrogen carbonates, preference being given to the alkali metal salts and, of these, particular preference to the potassium and/or sodium salts. Here again, the comments made above regarding the water content apply as well. Processes which have particularly been found preferable are those in which the weight ratio of carbonate(s) and/or hydrogen carbonate(s) to water in the mixtures for producing the hollow shapes is less than 1:0.2, preferably less than 1:0.15, and in particular less than 1:0.1.

Further ingredients, which may be present instead of or in addition to said phosphates and/or carbonates/hydrogen carbonates, are silicates, preference being given to the alkali metal silicates and, of these, particular preference to the amorphous and/or crystalline potassium and/or sodium disilicates. Here again, the comments made above regarding the water content of the compositions apply as well.

Above, the weight ratio of water to certain ingredients in mixtures for preferred processing to hollow bodies in accordance with the invention has been stated. After processing, this water is preferably bound in the form of water of hydration, so that the hollow shapes produced in step i) preferably have a significantly lower free water content. Preferred hollow shapes are substantially water-free, i.e., are in a state in which the amount of liquid water, i.e., water not present in the form of water of hydration and/or constitution, is less than 2% by weight, preferably less than 1% by weight, and in particular even below 0.5% by weight, based in each case on the shaped bodies. Accordingly, water may be present substantially only in chemically and/or physically bound form or as a constituent of the solid raw materials or compounded formulations, but not as a liquid, solution or dispersion, in the end products of step i). Advantageously, the hollow bodies at the end of the production process have an overall water content of not more than 15% by weight, with this water, therefore, being present not in liquid, free form but instead in chemically and/or physically bound form, and it is particularly preferred for the amount of water that is not bound to zeolite and/or silicates in the solid premix to be not more than 10% by weight and in particular not more than 7% by weight.

In the context of the present invention, particularly preferred hollow shapes not only possess an extremely low proportion of free water but are preferably themselves still able to bind further free water. In preferred processes, the water content of the hollow shapes is from 50 to 100% of the calculated water binding capacity.

The water binding capacity is the ability of a substance (in this case, the hollow shape) to absorb water in chemically stable form, and ultimately indicates the amount of water which can be bound in the form of stable hydrates by a substance or by a shaped body. The dimensionless value of the water binding capacity (WBC) is calculated from:

$$WBC = \frac{n \cdot 18}{M}$$

where n is the number of water molecules in the corresponding hydrate of the substance and M is the molar mass of the unhydrated substance. For the water binding capacity of water-free sodium carbonate (formation of sodium carbonate monohydrate), for example, this gives a value of $$WBC = \frac{1 \cdot 18}{2 \cdot 23 + 12 + 3 \cdot 16} = 0.17$$

The value WBC may be calculated for all hydrate-forming substances which are used in the mixtures to be processed to hollow shapes in accordance with the invention. The percentage fractions of these substances then give the overall water binding capacity of the formula. In preferred hollow shapes, then, the water content is between 50 and 100% of this calculated value.

In addition to the water content of hollow shapes and the ratio of water to certain raw materials, it is also possible to make statements about the absolute water content of the mixtures for processing in accordance with the invention. In particularly preferred processes the mixtures which serve to produce the hollow shapes has/have on processing a water content of from 2.5 to 30% by weight, preferably from 5 to 25% by weight, and in particular from 7.5 to 20% by weight, based in each case on the composition.

In summary, preference is given to process variants of the invention in which the open hollow shape is produced in step i) by temporally retarded water binding, the solidifying composition containing, based on its weight, from 10 to 95% by weight, preferably from 15 to 90% by weight, with particular preference from 20 to 85% by weight, and in particular from 25 to 80% by weight of water-free substances which harden by hydration.

Another mechanism according to which the solidification may take place in step i) of the process of the invention to give the hollow shape is the evaporation of solvents. For this purpose it is possible to prepare solutions or dispersions of the desired ingredients in one or more suitable, readily volatile solvents, which, after the shaping processing step, release this (these) solvent(s) and, in doing so, harden. Examples of appropriate solvents include lower alkanols, aldehydes, ethers, esters, etc., whose selection is made depending on the further composition of the mixtures to be processed. Particularly suitable solvents for such processes are ethanol, propanol, isopropanol, 1-butanol, 2-butanol, 2-methyl-1-propanol, 2-methyl-2-propanol, 1-pentanol, 2-pentanol, 3-pentanol, 2,2-dimethyl-1-propanol, 3-methyl-1-butanol; 3-methyl-2-butanol, 2-methyl-2-butanol, 2-methyl-1-butanol, 1-hexanol, and the acetates of the aforementioned alcohols, especially ethyl acetate.

The evaporation of said solvents may be accelerated by heating following the shaping operation or by movement of air. Combinations of said measures are also suitable for this purpose: for example, blowing of the hollow bodies with warm or hot air.

Preference is given here to processes of the invention in which the open hollow shape is produced in step i) by evaporation of solvents, the solidifying composition containing, based on its weight, from 1 to 50% by weight, preferably from 2 to 40% by weight, and in particular from 5 to 30% by weight of evaporable solvents.

A further mechanism on which the solidification in step i) of the process of the invention to form the hollow shape may be based is that of crystallization.

Crystallization can be utilized as the mechanism on which solidification is based, for example, by virtue of melts of crystalline substances serving as the basis for one or more shapingly processable mixtures. Following processing, such systems undergo transition to a higher state of order, which leads in turn to the hardening of the overall hollow body formed. Alternatively, crystallization may take place by crystallizing out from a supersaturated solution. In the context of the present invention, supersaturation is the designation of a metastable state in which, in a closed system, there is more of one substance present than is necessary for saturation. A supersaturated solution, obtained for example by supercooling, accordingly comprises more dissolved substance than it ought to contain at thermal equilibrium. The excess of dissolved substance can be induced to crystallize by seeding with nuclei or dust particles or by agitating the system. In the context of the present invention the term "supersaturated" always relates to a temperature of 20° C.

What the present invention understands by the term "solubility" is the maximum amount of a substance which the solvent is able to take up at a certain temperature, i.e., the fraction of the dissolved substance in a solution which is saturated at the temperature in question. Where a solution contains more dissolved substance than it ought to contain at a given temperature in thermodynamic equilibrium (e.g., in the case of solvent evaporation), it is referred to as being supersaturated. Seeding with nuclei can be used to cause the excess to precipitate as a sediment to the solution, which is then merely saturated. A solution which is saturated in respect of one substance, however, is still able to dissolve other substances (for example, sugar can still be dissolved in a saturated sodium chloride solution).

The state of supersaturation can be achieved, as described above, by cooling a solution, provided the dissolved substance is more soluble in the solvent at higher temperatures.

Other possibilities in obtaining supersaturated solutions are, for example, the combination of two solutions whose ingredients react to form a different substance which is not immediately precipitated (hindered or delayed precipitation reactions). The last-mentioned mechanism is particularly suitable as the basis for the formation of mixtures for processing in accordance with the invention.

In principle, the state of supersaturation is achievable with any kind of solution, although the application of the principle described in the present specification, as already mentioned, finds its application in the production of detergents.

Accordingly, some systems which tend in principle to form supersaturated solutions are less suitable for use in accordance with the invention, since the systems of substances on which they are based cannot be used on environmental, toxicological or economic grounds. Besides nonionic surfactants or common nonaqueous solvents, therefore, particularly preferred processes of the invention with the last-mentioned hardening mechanism are those in which a supersaturated aqueous solution is used as a basis of at least one mixture for processing.

As already mentioned above, the state of supersaturation relates, in the context of the present invention, to the saturated solution at 20° C. Through the use of solutions which have a temperature above 20° C. it is easily possible to attain the state of supersaturation. Processes of the invention in which the mixture which solidifies by crystallization has a temperature during processing of between 35 and 120° C., preferably between 40 and 110° C., with particular preference between 45 and 90° C., and in particular between 50 and 80° C., are preferred in the context of the present invention.

Since the hollow bodies produced are generally neither stored at elevated temperatures nor employed later at these elevated temperatures, the cooling of the mixture leads to the precipitation from the supersaturated solution of that fraction of dissolved substance which was present in the solution beyond the saturation limit of 20° C. On cooling, therefore, the supersaturated solution may divide into a saturated solution and a sediment. However, it is also possible, as a result of recrystallization and hydration phenomena, for the supersaturated solution to solidify on cooling to form a solid. This is the case, for example, when certain hydrated salts dissolve in their water of crystallization on heating. In this case cooling is often accompanied by the formation of supersaturated solutions which through mechanical exposure or addition of nuclei solidify to form a solid—the hydrated salt as the state which is thermodynamically stable at room temperature. This phenomenon is known, for example, of sodium thiosulfate pentahydrate and sodium acetate trihydrate, the last-mentioned hydrated salt in particular being suitable for advantageous use, in the form of the supersaturated solution, in the process of the invention. Specific detergent ingredients, such as phosphonates, for example, also display this phenomenon and are outstandingly suitable, in the form of the solutions, as granulation auxiliaries. For this purpose the corresponding phosphonic acids (see below) are neutralized with concentrated alkali metal hydroxide solution, the solution heating up through the heat of neutralization. On cooling, solids of the corresponding alkali metal phosphonates form from these solutions. By incorporating further detergent ingredients into the still-hot solutions it is possible to produce compositions of different makeup which can be processed in accordance with the invention. Particularly preferred processes of the invention are characterized in that the supersaturated solution used as a basis for the solidifying mixture solidifies at room temperature. It is preferred in this context that the previously supersaturated solution, following its solidification, cannot be converted back into a supersaturated solution by heating to the temperature at which the supersaturated solution was formed. This is the case, for example, with the phosphonates mentioned.

As mentioned above, the supersaturated solution serving as a basis for the solidifying mixture can be obtained in a number of ways and then processed in accordance with the invention, following optional admixture of further ingredients. One simple way consists, for example, in preparing the supersaturated solution used as a basis for the solidifying mixture by dissolving the dissolved substance in heated solvent. Where the amounts of the dissolved substance dissolved in this way in the heated solvent are higher than those which would dissolve at 20° C., then the product is a solution which is supersaturated in the sense of the present invention and which can be shaped either hot (see above) or cooled and in the metastable state.

It is additionally possible to dewater hydrated salts by "dry" heating and to dissolve them in their own water of crystallization (see above). This too is a method of preparing supersaturated solutions which can be used in the context of the present invention.

A further way consists in adding a gas or another liquid or solution to a nonsupersaturated solution, so that the dissolved substance in the solution reacts to form a less soluble substance or dissolves less readily in the mixture of the solvents. The combining of two solutions containing in each case two substances which react with one another to form a less soluble substance is likewise a method of preparing supersaturated solutions, provided the less soluble substance does not precipitate instantaneously. Processes which are likewise preferred in the context of the present invention are characterized in that the supersaturated solution serving as a basis for the solidifying mixture is prepared by combining two or more solutions. Examples of such ways of preparing supersaturated solutions are treated below.

Preferred processes of the invention are characterized in that the supersaturated aqueous solution is obtained by combining an aqueous solution of one or more acidic ingredients of detergents, preferably from the group of the surfactants acids, the builder acids, and the complexing agent acids, and an aqueous alkali metal solution, preferably an aqueous alkali metal hydroxide solution, in particular an aqueous sodium hydroxide solution.

Among the representatives of said classes of compound, already mentioned earlier on above, the phosphonates in particular occupy an outstanding position in the context of the present invention. In preferred processes of the invention, therefore, the supersaturated aqueous solution is obtained by combining an aqueous phosphonic acid solution with concentrations above 45% by weight, preferably above 50% by weight, and in particular above 55% by weight, based in each case on the phosphonic acid solution, and an aqueous sodium hydroxide solution with concentrations above 35% by weight, preferably above 40% by weight, and in particular above 45% by weight, based in each case on the sodium hydroxide solution.

The hardening of the solidifying mixture(s) can also take place in accordance with the invention by means of chemical recation(s), especially polymerization. Suitable in principle here are all chemical reactions which, starting from one or more liquid to pastelike substances, lead, by reaction with (an)other substance(s), to solids. Particularly suitable chemical reactions are those which do not lead suddenly to the stated change of state. From the diversity of chemical reactions which lead to solidification phenomena, particularly suitable reactions are those in which relatively large molecules are built up from smaller molecules. Such reactions in turn preferably include reactions in which a large number of small molecules react to form (one) larger molecule (s). These are what are known as polymerizations (addition polymerization, polyaddition, and polycondensation) and polymer-analogous reactions. The corresponding addition polymers, polyadducts (polyaddition products) or polycondensates (polycondensation products) then give the finished hollow body its strength.

In the light of the intended use of the products produced in accordance with the invention it is preferred to utilize, as the hardening mechanism, the formation, from liquid or pastelike starting materials, of those solid substances which are to be used in any case in the detergent as ingredients, examples being cobuilders, soil repellents or soil release polymers, Such cobuilders may hail, for example, from the groups of the polycarboxylates/polycarboxylic acids, polymeric polycarboxylates, aspartic acid, polyacetals, dextrins, etc. These classes of substance have been described earlier on above.

Another mechanism in accordance with which the solidifying mixture(s) may harden in the context of the process of the invention is that of hardening through a change in rheological properties.

In this case, the property exploited is that whereby certain substances undergo a change—in some cases, a drastic change—in their rheological properties under the action of shearing forces. Examples of such systems which are familiar to the skilled worker are, for example, phyllosilicates, which, under shearing in appropriate matrices, become highly thickening and can lead to firm compositions.

In one solidifying mixture it is of course also possible for two or more hardening mechanisms to be used in conjunction with one another and/or simultaneously. Appropriate here, for example, are crystallization with simultaneous solvent evaporation, cooling with simultaneous crystallization, water binding ("internal drying") with simultaneous external drying, and so on.

Another preferred mechanism in accordance with which shapable, preferably fluid, mixture can solidify is sintering. Sintering constitutes the provision of an assemblage of particles, preshaped in the form of the subsequent hollow body, which under the action of external conditions (temperature, radiation, reactive gases, liquids, etc.) is converted into a compact hollow body component. Examples of sintering operations are the prior art production of moldings by microwaves, or radiation curing.

A further preferred sintering operation for the production of hollow bodies is reactive sintering. In this operation the starting components are shaped and then solidified by reacting a component A and a component B with one another, the components A and B being mixed with the starting components, applied thereto or added after the shaping operation.

In the course of the implementation of this process, components A and B react with one another with solidification of the individual ingredients. The reaction product formed from components A and B joins the individual starting components such that a solid, relatively fracture-stable hollow body is obtained.

With this process, hollow bodies featuring good disintegration are obtained. Since the binding of the individual ingredients takes place by reactive sintering and is not governed by the "tack" of the granules of the premix, there is no need to adapt the formula to the binding properties of the individual ingredients. The latter can be adapted arbitrarily as a function of their activity.

In order to bring components A and B to reaction with one another it has proven advantageous if the starting components are mixed with component A or are coated with it before being shaped. Examples of compounds of component A are the alkali metal hydroxides, especially NaOH and KOH, alkaline earth metal hydroxides, especially $Ca(OH)_2$, alkali metal silicates organic or inorganic acids, such as citric acid, or acidic salts such as hydrogen sulfate, water-free hydratable salts or hydrated salts, such as sodium carbonate, acetates, sulfates, alkali metallates, where the compounds mentioned above, where possible, can also be used in the form of their aqueous solutions.

Component B is selected such that it reacts with component A without exertion of relatively high pressures or substantial increase in temperature, the reaction being accompanied by formation of a solid and solidification of the other starting components present. Examples of compounds of component B are $CO_2$, $NH_3$, water vapor or spray mist, hydrated salts, which may react by hydrate migration with the water-free salts present as component A, hydrate-forming water-free salts, which react by hydrate migration with the hydrated salts of component A, $SO_2$, $SO_3$, HCl, HBr, silicon halides such as $SiCl_4$ or silicates $S(OR)_xR'_{4-x}$.

The abovementioned components A and B are interchangeable, provided two components are used which react with one another with sintering.

In one preferred embodiment of this production route, the starting components are mixed or coated with compounds of component A and then the compounds of component B are added. It has proven particularly suitable if the compounds of component B are gaseous. The shaped starting components (referred to below as preforms) can then either be gassed in simple form or introduced into a gas atmosphere. One particularly preferred combination of components A and B are concentrated solutions of the alkali metal hydroxides, especially NaOH and KOH, and alkaline earth metal hydroxides, such as $Ca(OH)_2$, or alkali metal silicates, as component A, and $CO_2$ as component B.

For the implementation of process step i) according to the invention, the starting components are first shaped, i.e., they are customarily introduced into a die which has the external shape of the hollow body to be produced. The starting components are preferably in pulverulent to granular form. They are first of all mixed with component A or coated with it After being introduced into the die or mold, it has proven preferable to apply slight pressure to the starting components, e.g., by hand or using a ram, at a pressure which lies below the levels mentioned above, in particular below 100 $N/cm^2$. It is also possible to compact the premix by vibration (tapping compaction).

Where component A is not already in the form of a mixture with the starting components, the components are then coated with it, and component B is added. After the reaction has taken place, a fracture-stable hollow body is obtained without the action of pressure or temperature.

Where one of the components, A or B, is a gas, it can be added, for example, to a preform, so that the gas flows through it. This procedure permits uniform hardening of the tablet within a short time.

In a further process variant, a preform is introduced into an atmosphere of the reactive gas. This variant is easy to carry out. It is possible to produce hollow bodies which have a hardness gradient, i.e., hollow bodies having only a hardened surface through to hollow bodies which are completely hardened.

A preform or the premix can also be reacted with the reactive gas under superatmospheric pressure. This process variant has the advantage that the surface hardens rapidly to form a hard shell, the hardening process being stopped right here, or, as described above, fully hardened tablets can also be produced by way of ascending hardening stages.

The above process variants can also be combined, by first passing reactive gas through the preform in order to expel air. The preform is then exposed to a gas atmosphere at atmospheric pressure. As a result of the reaction between the gas and second component, gas is automatically drawn into the preform by suction.

In one possible embodiment of the present invention, not the starting mixture but instead an already shaped preform is coated with component A and then reacted with component B. The layer on the surface of the preform hardens, while in the core the loose or slightly compacted structure is retained. Hollow bodies of this kind are notable for particularly good disintegration characteristics.

In summary, preference is also given to process variants in which the open hollow shape is produced in step i) by sintering, the flowable mixture being induced to solidify by temperature exposure or chemical reaction.

Irrespective of the mechanism of solidification during the production of the hollow shape, preferred processes of the invention are those in which the hollow shape produced in step i) has wail thicknesses of from 100 to 6000 μm, preferably from 120 to 4000 μm, with particular preference from 150 to 3000 μm, and in particular from 200 to 2500 μm, wall thicknesses below 2000 μm being preferred in turn.

The production of the hollow shape in step i) can take place by different techniques, which depend in part on the nature of the solidification mechanism. In the simplest case, a flowable mixture is introduced into a corresponding mold, caused to harden therein, and then demolded. A disadvantage here is the design of the mold, since the desired wall thicknesses of the resultant hollow bodies do not allow rapid filling of complex geometries.

Alternatively, the solidifying mixture can be filled into a mold constructed simply as a cavity. Were the mixture to be allowed to solidify therein, the result would be a compact body, not a hollow shape. By means of an appropriate process regime it is possible to ensure that the mixture solidifies first on the walls of the mold. If the mold is rotated after a certain time t, the excess mixture flows off and leaves a mold lining which itself constitutes a hollow shape, which can be demolded following complete solidification. As already mentioned, however, filling can also take place prior to demolding; also possible is filling during the solidification procedure.

Preferred embodiments of the present invention are therefore processes in which in step i) an open cavity mold is filled with the flowable shell material and after a time t of between 0 and 5 minutes the excess composition is discharged.

Alternatively to the complete filling of the cavity mold and the pouring off of excess mixture, the cavity mold can be only partly filled. In these cases the mixture is pressed, using an appropriate ram, against the walls of the cavity mold, where it solidifies to form the hollow body. This process variant constitutes, so to speak, a hybrid of the "pouring off technique" and of the casting technique in negative molds of the hollow bodies. Corresponding processes, in which in step i) an open cavity mold is filled with the flowable shell material and the material is pressed against the walls of the mold by means of a ram, so producing a hollow shape, are likewise preferred, accordingly. A particularly advantageous feature of this process regime, which is also referred to as the "cold stamp method", is the possibility of producing even large numbers of units with precisely defined hollow body wall thickness. Moreover, the process is substantially insensitive to fluctuating flow properties and can be employed even in the case of mixtures of relatively high viscosity.

The processes described above are particularly suitable for producing hollow bodies which possess a shape without undercuts, i.e., which have the form of a "shell", in other words an aperture area which corresponds to the largest horizontal cross-sectional area. These "shells" can be filled and optionally sealed.

As far as the shape of the shells is concerned, no limits are imposed on the skilled worker for its selection. From the hemisphere via angular ("cartonlike") shells through to complicated structures with a pronounced surface texture (in the form of nutshells or animal shapes, for example), all hollow bodies can be produced.

It is also possible in accordance with the invention, however, to produce hollow bodies which possess only a small aperture, and to fill the resultant hollow shape later through this small "bunghole". Industrially, such processes are usually carried out using closable two-part molds, which are filled with an amount of solidifying mixture sufficient for lining the walls in the desired thickness, and are moved in all spatial directions. All designs are possible in this context, from the sphere via egg shapes through to complex hollow structures such as animal shapes, company logos, etc. A further preferred embodiment of the present invention therefore provides a process in which in step i) a closable two-part mold is filled with the subsequently solidifying composition and is moved for a time t of between 0 and 5 minutes.

During or after their production, the hollow shapes are filled with detergent. In this case, all ready-preformulated detergents, in liquid, paste, gel, powder, extruded, granulated, pelletized, flaked, or tableted form, can be introduced into the hollow shape. It is, however, not necessary to introduce a ready-made detergent; instead, it is also possible for individual detergent ingredients and/or precursors thereof to be introduced into the hollow bodies.

Powders: bicarbonates, silicates, potash, sodium carbonate, zeolites, polymers (PEG, maleic acid-polyacrylic acid copolymer salts, citric acid, citrates, sugars, soap, disintegration assistants and disintegrants, sulfates, phosphates, perborates, carboxymethylcellulose (CMC), LAS powders (linear alkylbenzenesulfonates), FAS powders (fatty alcohol sulfates).

Pastes: surfactants pastes (LAS paste, aqueous FAS paste), waterglass

Compounded formulations: tower powders (spray agglomerates), LAS compounds, FAS compounds, TAED, percarbonate, enzyme extrudates, crude extrudate, nonionic surfactants compounds Liquids: polymer solutions (maleic acid-polyacrylic acid copolymer salts in aqueous solutions), phosphonate solutions (aqueous), perfume oils, enzyme solutions, chlorine bleaching liquors, hydrogen peroxide solutions, cationic surfactants solutions, nonionic surfactants The liquids may also be in gel form (as a result of relatively high active substance concentrations or the addition of thickeners, e.g., Tixogel® (Süd-Chemie)). The solids can also be processed as solutions or suspensions, the liquids as compounded formulations in bound form.

The above examples show that all said substances or substance mixtures can be introduced into the hollow bodies or into the compartments of hollow bodies. The liquid and pastelike media (which are obtained in said aggregate states in the upstream production stages) must normally be dried or absorbed on carriers. In the case of introduction into compartments, these formulating stages are no longer required, which represents a further advantage of the process of the invention.

After the filling operation, it is possible to seal the open hollow shape. This is necessary in the case of liquid or pastelike fillings, in order to prevent emergence of the filling prior to application. In the case of fillings which remain firmly attached within the hollow shape, the sealing of the shape can be omitted if desired. Even in such cases, however, sealing may be indicated on esthetic grounds.

The optional sealing of the hollow shape can take place in a variety of ways. In the case of shaped bodies with a bunghole, this hole can be sealed, for example, by inserting a part which fits. Open hollow shapes in the form of hollow bodies without undercuts can be sealed with films or, after filling, can be overcast with further material for the hollow shape. The optional sealing with films is described below.

The film which seals the aperture (s) of the hollow shape(s) is applied to the surface of the hollow shape and is joined firmly to it, which can be done, for example, by adhesive bonding, partial melting or chemical reaction. It is possible to apply the film to all surfaces of the hollow shape (i.e., not just over the aperture) and to join it firmly thereto, so that the film constitutes a coating of the entire shaped body. Preferred detergent portions produced in accordance with the invention, however, are characterized in that the film does not embrace the entire shaped body.

For reasons of process economics and of the esthetic impression it is preferred for the film to be applied only such that it fulfills one function, i.e., serves to seal the hollow shape.

The sealing film can of course also be a laminate comprising two or more films of different composition; by way of different compositions of individual film layers it is possible to expose the aperture of the hollow shape at certain points in time during the laundering and cleaning operation.

Preferred film materials have already been described at length earlier on above.

Independently of the chemical composition of the film, preference is given to processes of the invention in which the film used to seal the hollow shape in step iii) has a thickness of from 1 to 150 μm, preferably from 2 to 100 μm, with particular preference from 5 to 75 μm, and in particular from 10 to 50 μm.

As a result of the division into hollow shape and filling, a shaped body produced in accordance with the invention comprises two regions, in which different ingredients may be contained or different release mechanisms and dissolution kinetics effectuated. The active substance present in the hollow shape may adopt any aggregate state or any presentation form whatsoever. Preferred detergent portions comprise the further active substance in liquid, gel, paste or solid form.

When liquid, gellike or pastelike active substances or active substance mixtures are incorporated, the composition of the hollow body and of the film must be tailored to the filling in order to prevent premature destruction of the film or loss of active substance through the hollow body. This is necessary only to a minor extent (chemical incompatibilities) when solid substances are incorporated into the hollow shape, so that in preferred production processes the detergent composition introduced into the hollow shape is present in particle form, preferably in pulverulent, granular, extruded, pelletized, prilled, flaked or tableted form.

The hollow shape sealed by the film can be filled completely with the further active substance. It is likewise possible, however, to fill only part of the hollow shape prior to sealing, so as to allow the particles or liquids introduced to move within the hollow shape. Particularly in the case of filling with relatively large particles of regular shape it is possible to realize attractive optical effects. Preference is given in this case to inventively produced detergent portions where the volume ratio of the space embraced by the film and the hollow body to the active substance contained within said space is from 1:1 to 100:1, preferably from 1.1:1 to 50:1, with particular preference from 1.2:1 to 25:1, and in particular from 1.3:1 to 10:1. In this terminology a volume ratio of 1:1 means that the hollow shape is completely filled.

Depending on the size of the hollow shape, the density of the hollow body, the density of the active substance in the hollow shape, and the filled level of the hollow shape, the fraction of the further active substance in the hollow shape may account for different proportions of the overall shaped body. Preference is given here to inventively produced detergent portions for which the weight ratio of hollow body to the active substance present in the space embraced by the film and the hollow body is from 1:1 to 100:1, preferably from 2:1 to 80:1, with particular preference from 3:1 to 50:1, and in particular from 4:1 to 30:1. The above-defined weight ratio is the ratio of the mass of the unfilled hollow body to the mass of the filling. The mass of the film is not taken into account for this calculation.

Through appropriate formulation of hollow body and film material it is possible to predetermine the point in time at which the substances present in the hollow body are released. For example, the film may be soluble suddenly, so to speak, so that the active substance present in the hollow shape is metered into the laundering or cleaning liquor right at the beginning of the laundering or cleaning operation. Alternatively to this, the solubility of the film may be so low that the shaped body is dissolved first and the active substance present in the hollow shape is released as a result.

Depending on this release mechanism it is possible, for example, to realize shaped bodies for which the active substance present in the hollow shape is present in solution in the cleaning liquor before the constituents of the hollow body have dissolved, or after this has occurred. Accordingly, preference is given on the one hand to shaped detergent bodies which are characterized in that the active substance present in the space embraced by the film and the hollow body dissolves more rapidly than the hollow body. However, shaped detergent bodies for which the active substance present in the space embraced by the film and the hollow body dissolves more slowly than the hollow body are also preferred embodiments of the present invention.

Alternatively to sealing with a film, the filled hollow bodies may also be sealed by application of a melt, solution, emulsion or dispersion of the aforementioned film materials. In this case the sealing layer is formed from the melt, solution, emulsion or dispersion by cooling or evaporation of the solvent; in other words, the sealing "film" is produced on the hollow shape. This alternative can be employed in particular for fully filled hollow shapes, while only part-filled hollow shapes are appropriately sealed in other ways, where value is placed on the contents possessing "mobility"—for example, as a particular purchasing incentive.

Naturally, the hollow bodies can also be produced in step i) such that they can be joined to a further filled hollow body and in that way sealed. Such bodies are shapes assembled from two half-shells, without undercuts, and possess an equatorial plane. The latter need not necessarily be central but may also lie, for example, in the upper or lower third, fourth, fifth, etc. This procedure is made easier if the hollow bodies produced in step i) possess flange parts.

Alternatively, the attachment of the shaped parts to one another may also take place only by way of the boundary edges of the aperture surfaces. Thus preference is also given to processes in which the hollow shape possesses flange parts and is sealed in step iii) by welding to a further hollow shape.

One complete production sequence is illustrated below using the example of a melt as starting material for the hollow shape—naturally, all other of the solidification mechanisms mentioned above can be employed in an entirely analogous manner. In one first initial stage the shaped shell material is melted in an initial-charge vessel and conditioned to the requisite casting temperature, accompanied where appropriate by targeted precrystallization. The melt is then supplied via heated and/or insulated pipeline systems to the metering stations; in parallel with this, the individual casting molds are preheated or cooled to the desired temperature.

In a casting machine the liquid melt is metered into the mold depressions, which are filled to the upper die edge. In general, two or more identically configured casting molds run past the casting machine and are filled. After leaving the casting machine (or after passing the metering head), the filled molds are either passed on to a cooling section or are moved or "parked" until the melt begins to solidify from the outside. One critical determinant of the subsequent wall thickness of the shaped shell to be formed is the cooling time, which is material-dependent.

After the allowed time has expired, the mold is turned once from top to bottom or turned upside down, so that the melt composition which has not yet solidified, and is in excess, runs from the mold into a waiting collection reservoir, for recycling to the operation.

Depending on the physical nature of the system, and particularly in the case of melts which are slow to solidify, at the moment of discharge there has not yet been any formation of fully solidified shell, so that it is primarily the adhesion to the casting mold which ensures that the melt composition remains in the mold. Adhesive formation of shells can be supported by an eccentric movement of the mold, with the centrifugal forces transporting the still fluid melt uniformly to the mold surface and ensuring that a shell is formed with uniform wall thickness. Degassing of the melt by vibration of the mold may also be necessary where appropriate.

Subsequently, the formation of the shell can be completed by cooling. Any shell remnant projecting beyond the edge of the casting mold can be cut off, the use of knives or thermal rollers being possible.

The formed shaped shell is then filled and the filling is later cooled, where appropriate. Depending on the desired mode of sealing, the shape is filled fully or only partly. The shape can be sealed by applying a sealing barrier layer (particularly in the case of liquid fillings) which is composed of a substance whose melting point is lower than that of the shell material, and which lends itself readily to spraying. The firm sealing of the shape can be carried out subsequently by filling up the filled shaped shell with the melt for the shell material. For the purpose of uniformly forming the lid and for degassing where appropriate, the shape may in turn be set in vibration during the solidification time. Here again, solidification to give the finished shaped body may be promoted by passage through a cooling section.

Finally, the shaped bodies are demolded in a mold discharge station. For this purpose, the mold is turned from top to bottom, so that the shaped body formed can fall downward, or is set down, onto a conveyor belt. This demolding step can be assisted by twisting the mold or by striking it on its rear side.

As already mentioned, the shaped bodies produced in accordance with the invention can be produced in any desired form and size, and combine a high esthetic attraction with great technical flexibility and the possibility of actualizing different product advantages such as, for example, controlled release concepts.

The present invention further provides portioned detergents comprising a detergent composition which is enclosed at least proportionally by solidified material and is characterized in that the enclosure has a wall thickness 100 to 6000 μm and is composed of a material which has been produced by temporally retarded water binding, by cooling below the melting point, by evaporation of solvents, by crystallization, by chemical recation(s), especially polymerization, by change in rheological properties, for example, by altered shearing, by sintering or by means of radiation curing, in particular by UV, alpha beta or gamma rays.

The mechanisms by which the hollow shape may be formed have been described at length earlier on above. These remarks also apply to the enclosure of the detergents of the invention. The term "enclosed at least proportionally by solidified material" is characteristic here of the fact that at least part of the surface area of the detergent composition is enclosed by solidified material in the sense of the definition given above. The part not enclosed by solidified material may either be otherwise enclosed (e.g., lined with film; see above) or possess direct contact with the atmosphere. Since in accordance with the production process described earlier on above the detergent composition is introduced into a hollow shape, preference is given here to portioned detergents of the invention for which the enclosure covers at least 50%, preferably at least 60%, with particular preference at least 70%, and in particular at least 80% of the surface area of the portioned composition.

Similar remarks can also be made regarding the masses occupied by the enclosure and the enclosed content. Preference is given here to portioned detergents for which the ratio of the masses of enclosure and contents is situated in the range from 10:1 to 1:1000, preferably from 2:1 to 1:100, with particular preference from 1:1 to 1:50, and in particular from 1:5 to 1:25.

As mentioned earlier on above, melts are particularly suitable. For the portioned detergents of the invention as well, therefore, preference is given to those in which the enclosure is composed of a material whose melting point is situated in the range from 40 to 250° C.

For the portioned detergents as well there are certain substances, which have been described in detail above, that are particularly suitable as enclosures. Portioned detergents which are preferred in the context of the present invention are characterized in that the enclosure comprises one or more substances from the groups of the dicarboxylic acids, dicarboxylic anhydrides, hydrogen carbonates, hydrogen sulfates and/or urea in amounts of at least 40% by weight, preferably at least 60% by weight, and in particular at least 80% by weight, based in each case on the mass of the enclosure.

As described in detail above, the detergent composition at least proportionally enclosed within the enclosure can be present in any form at all. Portioned detergents for which the enclosed detergent composition is in liquid, paste, gel or particulate form or in the form of a suspension or emulsion and is completely enclosed by the enclosure are, accordingly, a further preferred embodiment of the present invention.

In accordance with the invention it is particularly preferred to effect the production of the dimensionally stable hollow body(ies) comprising, where appropriate, one or more means of compartmentalization by injection molding. Thermoplastic polymers in particular can be processed outstandingly by this technique to give dimensionally stable hollow bodies, in particular, where appropriate, to give dimensionally stable hollow bodies comprising means of compartmentalization within their interior. The injection molding of suitable materials takes place in accordance with conventional procedures at high pressures and temperatures: for example, at temperatures between 100 and 220° C., in particular above the softening point of the thermoplastic, for example, at 140° C. or more, in particular at about 180° C., and at a pressure of between 500 and 2000 bar, preferably of > 1000 bar, in particular at about 1400 bar, comprising the steps of closing the mold attached to the extruder for the purpose of injection molding, injecting the polymer at high temperature and high pressure, cooling the injection molding, opening the mold, and withdrawing the shaped preform. Further, optional steps, such as the application of release agents, demolding, etc., are known to the skilled worker and can be carried out in accordance with conventional technology.

The advantages of the procedure of producing the dimensionally stable hollow bodies by injection molding lie in the established technology of this procedure, the high flexibility in relation to the materials which can be used, the possibility of obtaining precisely desired wall thicknesses s of the preform and dimensionally stable hollow body, respectively, and the possibility of producing a dimensionally stable hollow body having one or more integral compartmentalization means with high reproducibility in one step.

The [lacuna] in the detergent portions disclosed here are composed of an outer hollow shape which comprises one or more fillings. This hollow shape can be subdivided by partition walls into two or more compartments, and so two or more fillings can be present separately from one another within the same hollow body. There are no requirements imposed on the fillings apart from compatibility with the material of the hollow shape, so that both solid and liquid phase (systems) can be portioned.

The uniform portioning of two or more different fillings requires hollow bodies which comprise compartmentalization means. The production of such hollow bodies from two or more compartments bordering one another comes up against difficulties with conventional techniques. The present specification discloses a process for producing such hollow bodies and the detergent portions which can be produced from them.

The invention further provides a process for producing a detergent portion which is contained within one or more dimensionally stable hollow bodies comprising at least one compartment and which comprises (a) at least one detersive formulation;

(b) at least one enclosure which wholly or partly surrounds said at least one formulation according to (a) and comprises an unpressed material which is disintegrable under laundering, cleaning or washing conditions and gives the hollow body(ies) dimensional stability; and (c) if desired, one or more means for compartmentalization of the dimensionally stable hollow body(ies), comprising the steps of (i) producing the dimensionally stable hollow body(ies), comprising where appropriate one or more means for compartmentalization, by injection molding;

(ii) filling the compartment(s) with at least one detersive formulation;

(iii) if desired, subsequently sealing the dimensionally stable hollow body(ies) to form a partial or complete enclosure around the detersive formulation(s).

For this purpose, injection molded in step (i) is a hollow body which has one or more spaces for the accommodation of detersive formulations. The injection molding of appropriate materials takes place in accordance with conventional procedures at high pressures and temperatures, with the steps of closing the mold attached to the extruder for injection molding, injecting the polymer at high temperature and high pressure, cooling the injection molding, opening the mold, and withdrawing the shaped preform. Further, optional steps, such as the application of release agents, demolding, etc., are known to the skilled worker and can be carried out in accordance with conventional technology.

The advantages of the procedure of producing the dimensionally stable hollow bodies by injection molding lie in the established technology of this procedure, the high flexibility in relation to the materials which can be used, the possibility of obtaining exactly desired wall thicknesses s of the molding and/or dimensionally stable hollow body, and the possibility of producing a dimensionally stable hollow body having one or more integral compartmentalization means with high reproducibility in one step.

In preferred processes of the invention step (i) is conducted at a pressure of between 100 and 5000 bar, preferably between 500 and 2500 bar, with particular preference between 750 and 1500 bar, and in particular between 1000 and 1250 bar.

The temperature of the material to be injection molded lies preferably above the melting or softening point of the material and thus is also dependent on the nature of the material of the hollow body. In preferred processes of the invention step (i) is conducted at temperatures of between 100 and 250° C., preferably between 120 and 200° C., and in particular between 140 and 180° C.

The molding tools which accommodate the materials are preferably temperature-conditioned beforehand and have temperatures above room temperature, preference being given to temperatures of between 25 and 60° C. and in particular from 35 to 50° C.

Independently of the material used for the hollow body (see below), but depending on the desired dissolution properties, it is possible to vary the thickness of the walls. The walls should on the one hand be chosen to be sufficiently thin that rapid dissolution or disintegration is achieved and the ingredients are released rapidly into the application liquor, although a certain minimum thickness is also necessary in order to give the hollow shape the desired stability, especially dimensional stability.

The term "dimensionally stable hollow body" is understood in accordance with the invention to mean that the shaped bodies containing the detergent portions have an intrinsic dimensional stability which enables them, under normal conditions of production, storage, transit, and handling by the consumer, to have a structure which is stable toward fracture and/or pressure and which does not collapse, and which also does not change under said conditions over prolonged periods of time. It is irrelevant here in accordance with the invention whether this structural stability results solely from the properties of the dimensionally stable hollow body which come about as a result of various parameters, specified below, or (also) from the presence of compartmentalization means and/or (also) from the filling with detersive formulations. In preferred embodiments of the invention the dimensionally stable hollow bodies themselves already have a sufficient intrinsic dimensional stability, since this has advantageous consequences for passage in machines in the course of the manufacture of the hollow bodies and in the course of filling during production of the detergent portions of the invention.

The pressure resistance of the dimensionally stable hollow bodies in accordance with the invention is measured in the manner (customary per se) such that unfilled hollow bodies which have been provided where appropriate with compartmentalization means are sealed with films or lids and at room temperature a steadily increasing internal vacuum is applied to these hollow bodies until the hollow body begins to collapse. The intrinsic dimensional stability of the hollow bodies should with particular preference be such that in the case of vacuum collapse tests of this kind, unfilled hollow bodies provided where appropriate with compartmentalization means do not begin to collapse before a vacuum of 900 mbar, preferably of 750 mbar, and in particular of 500 mbar, is reached. In this respect the hollow bodies used in accordance with the invention are fundamentally different from films or pouches such as are likewise used to provide detergents. These films or pouches collapse even under a pressure which is only slightly below atmospheric pressure. Similarly, however, the dimensionally stable hollow bodies of the invention are also different from coatings (applied subsequently to shaped bodies): the hollow bodies of the invention constitute an independent, self-supporting envelopment which generally exists prior to filling with one or more detersive components and which is subsequently filled. In contrast thereto, coatings are applied to already existing shaped bodies (e.g., compressed bodies, granules, extrudates, etc.) and are then dried and/or cured; only then do they form an envelopment surrounding the shaped body.

In preferred processes of the invention, in step (i), hollow bodies are produced for which collapse does not begin before a vacuum of 250 mbar, preferably of 100 bar, and in particular of 20 mbar has been reached.

Preferred processes of the invention are therefore characterized in that the wall thickness of the enclosure (b) produced in step (i) is from 100 to 5000 μm, preferably from 200 to 3000 μm, with particular preference from 300 to 2000 μm, and in particular from 500 to 1500 μm.

The use of polymers having a flow index (MFI) of less than 120, preferably less than 10, and in particular less than 8 is preferred.

In general, the dimensionally stable hollow body produced by injection molding does not have closed walls on all sides and as a result of its production is open on at least one of its sides—in the case of a spherical or elliptical body, in the region of one part of its shell. Through the aperture which remains, one or more detersive formulations is/are introduced into the compartment (s) formed in the interior of the dimensionally stable hollow body. This is done likewise in a conventional way, for example, as part of production processes which are known from the confectionery industry; also conceivable are procedures taking place over two or more steps. A single-stage procedure is especially preferred when in addition to solid formulations the intention is to incorporate formulations (dispersions or emulsions, suspensions) comprising liquid components or even formulations (foams) comprising gaseous components into the detergent portions in the hollow bodies.

Particularly appropriate materials for the hollow body to be produced in step (i) are polymers, preference being given to processes of the invention in which the enclosure (b) produced in step (i) comprises one or more materials from the group consisting of acrylic acid (co)polymers, polyacrylamides, oxazoline polymers, polystyrenesulfonates, polyurethanes, polyesters, and polyethers, and mixtures thereof.

Particular preference is given to the use of water-soluble polymers as material for the hollow bodies. In this context, processes have been found appropriate which are characterized in that the enclosure (b) produced in step (i) comprises one or more water-soluble polymers, preferably a material from the group consisting of (unacetalized or acetalized) polyvinyl alcohol (PVAL), polyvinylpyrrolidone, polyethylene oxide, gelatin, cellulose, and their derivatives, and mixtures thereof, more preferably (unacetalized or acetalized) polyvinyl alcohol (PVAL).

In the context of the present invention, polyvinyl alcohols are particularly preferred coating materials. "Polyvinyl alcohols" (abbreviation PVAL, occasionally also PVOH) is the designation for polymers of the general structure

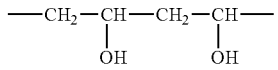

which also contain, in minor fractions (about 2%), structural units of the type

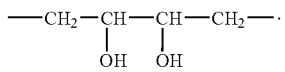

Standard commercial polyvinyl alcohols, which are supplied as yellowish white powders or granules having degrees of polymerization in the range from approximately 100 to 2500 (molar masses from approximately 4000 to 100 000 g/mol), have degrees of hydrolysis of 98-99 or 87-89 mol %, and thus still have a residual acetyl group content. On the part of the manufacturers, the polyvinyl alcohols are characterized by stating the degree of polymerization of the initial polymer, the degree of hydrolysis, the hydrolysis number, and/or the solution viscosity.

Depending on the degree of hydrolysis, polyvinyl alcohols are soluble in water and a few strongly polar organic solvents (formamide, dimethylformamide, dimethyl sulfoxide); by (chlorinated) hydrocarbons, esters, fats, and oils, they are not attacked. Polyvinyl alcohols are classified as toxicologieally unobjectionable and are at least partly biodegradable. The solubility in water can be reduced by aftertreatment with aldehydes (acetalization), by complexing with Ni or Cu salts, or by treatment with dichromates, boric acid or borax. The coatings of polyvinyl alcohol are substantially impenetrable for gases such as oxygen, nitrogen, helium, hydrogen, and carbon dioxide, but do allow water vapor to pass through.

Processes preferred in the context of the present invention are characterized in that the hollow bodies are composed of a polyvinyl alcohol whose degree of hydrolysis is from 70 to 100 mol %, preferably from 80 to 90 mol %, with particular preference from 81 to 89 mol %, and in particular from 82 to 88 mol %.

As materials for the hollow bodies it is preferred to use polyvinyl alcohols from a particular molecular weight range, preference being given to processes of the invention in which the hollow bodies produced in step (i) are composed of a polyvinyl alcohol whose molecular weight is situated in the range from 10 000 to 100 000 g $mol^{-1}$, preferably from 11 000 to 90 000 g $mol^{-1}$, with particular preference from 12 000 to 80 000 g $mol^{-1}$, and in particular from 13 000 to 70 000 g $mol^{-1}$.

The degree of polymerization of preferred polyvinyl alcohols of this kind is situated between approximately 200 to approximately 2100, preferably between approximately 220 to approximately 1890, with particular preference between approximately 240 to approximately 1680, and in particular between approximately 260 to approximately 1500.

The above-described polyvinyl alcohols are widely available commercially, for example, under the trademark Mowiol® (Clariant). Examples of polyvinyl alcohols particularly suitable in the context of the present invention are Mowiol® 3-83, Mowiol® 4-88, Mowiol® 5-88, and Mowiol® 8-88.

Further polyvinyl alcohols particularly suitable as material for the hollow bodies are apparent from the table below:

| Name | Degree of hydrolysis [%] | Molar mass [kDa] | Melting point [° C.] |
|---|---|---|---|
| Airvol ® 205 | 88 | 15-27 | 230 |
| Vinex ® 2019 | 88 | 15-27 | 170 |
| Vinex ® 2144 | 88 | 44-65 | 205 |
| Vinex ® 1025 | 99 | 15-27 | 170 |
| Vinex ® 2025 | 88 | 25-45 | 192 |
| Gohsefimer ® 5407 | 30-28 | 23 600 | 100 |
| Gohsefimer ® LL02 | 41-51 | 17 700 | 100 |

Further polyvinyl alcohols suitable as material for the hollow shape are ELVANOL® 51-05, 52-22, 50-42, 85-82, 75-15, T-25, T-66, 90-50 (trademark of Du Pont), ALCOTEX® 72.5, 78, B72, F80/40, F88/4, F88/26, F88/40, F88/47 (trademark of Harlow Chemical Co.), Gohsenol® NK-05, A-300, AH-22, C-500, GH-20, GL-03, GM-14L, KA-20, KA-500, KH-20, KP-06, H-300, NH-26, NM110, KZ-06 (trademark of Nippon Gohsei K.K.).

In order to facilitate the injection molding procedure (i.e., their production) the hollow bodies may comprise plasticizing aids. This may be especially advantageous when polyvinyl alcohol or partially hydrolyzed polyvinyl acetate have been chosen as material for the hollow bodies. The fraction of the plasticizing aids (based on the polymer) is normally up to 15% by weight, with figures between 5 and 10% by weight being preferred. Compounds which have been found particularly appropriate as plasticizing aids include glycerol, triethanolamine, ethylene glycol, propylene glycol, diethylene or dipropylene glycol, diethanolamine, and methyldiethylamine.

In addition to the plasticizing aids, demolding additives are important auxiliaries which can be used in the injection molding compounds. From the groups of the fatty substances and the finely divided substances, stearic acid and/or stearates and also pyrogenic silicas (Aerosil®), and also talc, have been found particularly appropriate in the context of the present invention. The fraction of the demolding additives (based on the polymer) is normally up to 5% by weight, with figures between 0.5 and 2.5% by weight being preferred.

Further substances which can be used as demolding additives originate in particular from the group of fatty substances. In the context of this specification, fatty substances are substances which are liquid to solid at standard temperature (20° C.) and come from the group of the fatty alcohols, fatty acids, and fatty acid derivatives, especially the fatty acid esters. Reaction products of fatty alcohols with alkylene oxides are included among the surfactants (see above) in the context of the present specification, and are not fatty substances for the purpose of the invention. As fatty substances it is preferred in accordance with the invention to use fatty alcohols and fatty alcohol mixtures, fatty acids and fatty acid mixtures, fatty acid esters with alkanols and/or diols and/or polyols, fatty acid amides, fatty amines, etc.

Fatty alcohols used are, for example, the following alcohols obtainable from natural fats and oils; 1-hexanol (caproyl alcohol), 1-heptanol (enanthyl alcohol), 1-octanol (capryiyl alcohol), 1-nonanol (pelargonal alcohol), 1-decanol (capryl alcohol), 1-undecanol, 10-undecen-1-ol, 1-dodecanol (lauryl alcohol), 1-tridecanol, 1-tetradecanol (myristyl alcohol), 1-pentadecanol, 1-hexadecanol (cetyl alcohol), 1-heptadecanol, 1-octadecanol (stearyl alcohol), 9-cis-octadecen-1-ol (oleyl alcohol), 9-trans-octadecen-1-ol (erucyl alcohol), 9-cisoctadecene-1,12-diol (ricinolyl alcohol), all-cis-9,12-octadecadien-1-ol (linoleyl alcohol), all-cis-9,12,15-octadecatrien-1-ol (linolenyl alcohol), 1-nonadecanol, 1-eicosanol (arachidyl alcohol), 9-cis-eicosen-1-ol (gadoleyl alcohol), 5,8,11,14-eicosatetraen-1-ol, 1-heneicosanol, 1-docosanol (behenyl alcohol), 1-3-cisdocosen-1-ol (erucyl alcohol), 1-3-trans-docosen-1-ol (brassidyl alcohol), and mixtures of these alcohols. In accordance with the invention it is also possible to use guerbet alcohols and oxo alcohols, examples being $C_{13-15}$ oxo alcohols or mixtures of $C_{12-18}$ alcohols with $C_{12-14}$ alcohols, without problems as fatty substances. Naturally, however, it is also possible to use alcohol mixtures, examples being those such as the $C_{16-18}$ alcohols prepared by Ziegler ethylene polymerization. Specific examples of alcohols which can be used as component b) are the alcohols already mentioned above and also lauryl alcohol, palmityl and stearyl alcohol, and mixtures thereof.

Preferred demolding additives are $C_{10-30}$ fatty alcohols, preferably $C_{12-24}$ fatty alcohols, with particular preference being given to 1-hexadecanol, 1-octadecanol, 9-cis-octadecen-1-ol, all-cis-9,12-octadecadien-1-ol, all-cis-9,12,15-octadecatrien-1-ol, 1-docosanol, and mixtures thereof.

Fatty acids can also be used as demolding additive. Industrially, they are obtained largely from naturally occurring fats and oils by hydrolysis. While the alkaline saponification carried out as early ago as the last century led directly to the alkali metal salts (soaps), nowadays water is used industrially for the cleavage, and cleaves the fats into glycerol and the free fatty acids. Examples of processes employed industrially are cleavage in an autoclave or continuous high-pressure cleavage. Examples of carboxylic acids which can be used in the context of the present invention as fatty substance are hexanoic acid (caproic acid), heptanoic acid (enanthic acid), octanoic acid (caprylic acid), nonanoic acid (pelargonic acid), decanoic acid (capric acid), undecanoic acid, etc. In the context of the present connection it is preferred to use fatty acids such as dodecanoic acid (lauric acid), tetradecanoic acid (myristic acid), hexadecanoic acid (palmitic acid), octadecanoic acid (stearic acid), eicosanoic acid (arachidic acid), docosanoic acid (behenic acid), tetracosanoic acid (lignoceric acid), hexacosanoic acid (cerotinic acid), triacotanoic acid (melissic acid), and also the unsaturated species 9c-hexadecenoic acid (palmitoleic acid), 6c-octadecenoic acid (petroseiinic acid), 6t-octadecenoic acid (petroselaidic acid), 9c-octadecenoic acid (oleic acid), 9t-octadecenoic acid (elaidic acid), 9c,12c-octadecadienoic acid (linoleic acid), 9t,12t-octadecadienoic acid (linolaidic acid), and 9c,12c,15c-octadecatreinoic acid (linolenic acid). Naturally, tridecanoic acid, pentadecanoic acid, margaric acid, nonadecanoic acid, emcic acid, elaeostearic acid, and arachidonic acid may also be used. On grounds of cost it is preferred to use not the pure species but rather technical-grade mixtures of the individual acids, such as are obtainable from cleavage of fats. Such mixtures are, for example, coconut oil fatty acid (about 6% by weight $C_8$, 6% by weight $C_{10}$, 48% by weight $C_{12}$, 18% by weight $C_{14}$, 10% by weight $C_{16}$, 2% by weight $C_{18}$, 8% by weight $C_{18'}$, 1% by weight $C_{18''}$), palm kernel oil fatty acid (about 4% by weight $C_8$, 5% by weight $C_{10}$, 50% by weight $C_{12}$, 15% by weight $C_{14}$, 7% by weight $C_{16}$, 2% by weight $C_{18}$, 15% by weight $C_{18'}$, 1% by weight $C_{18''}$), tallow fatty acid (about 3% by weight $C_{14}$, 26% by weight $C_{16}$, 2% by weight $C_{16'}$, 2% by weight $C_{17}$, 17% by weight $C_{18}$, 44% by weight $C_{18'}$, 3% by weight $C_{18''}$, 1% by weight $C_{18'''}$), hydrogenated tallow fatty acid (about 2% by weight $C_{14}$, 28% by weight $C_{16}$, 2% by weight $C_{17}$, 63% by weight $C_{18}$, 1% by weight $C_{18'}$), technical-grade oleic acid (about 1% by weight $C_{12}$, 3% by weight $C_{14}$, 5% by weight $C_{18}$, 6% by weight $C_{16'}$, 1% by weight $C_{17}$, 2% by weight $C_{18}$, 70% by weight $C_{18'}$, 10% by weight $C_{18''}$, 0.5% by weight $C_{18'''}$), technical-grade palmitic/stearic acid (about 1% by weight $C_{12}$, 2% by weight $C_{14}$, 45% by weight $C_{16}$, 2% by weight $C_{17}$, 47% by weight $C_{18}$, 1% by weight $C_{18'}$), and soybean oil fatty acid (about 2% by weight $C_{14}$, 15% by weight $C_{16}$, 5% by weight $C_{18}$, 25% by weight $C_{18'}$, 45% by weight $C_{18''}$, 7% by weight $C_{18'''}$).

Fatty acid esters which can be used are the esters of fatty acids with alkanols, diols or polyols, fatty acid polyol esters being preferred. Suitable fatty acid polyol esters include monoesters and diesters of fatty acids with certain polyols. The fatty acids which are esterified with the polyols preferably saturated or unsaturated fatty acids having from 12 to 18 carbon atoms, examples being lauric acid, myristic acid, palmitic acid or stearic acid, use being made preferably of the fatty acid mixtures obtained industrially, for example, the acid mixtures derived from coconut, palm kernel or tallow fat. In particular, acids or mixtures of acids having from 16 to 18 carbon atoms such as tallow fatty acid, for example, are suitable for esterification with the polyhydric alcohols. Suitable polyols esterified with the aforementioned fatty acids include, in the context of the present invention, sorbitol, trimethylol propane, neopentyl glycol, ethylene glycol, polyethylene glycols, glycerol, and polyglycerols.

Preferred embodiments of the present invention provide for the use of glycerol as a polyol which is esterified with fatty acid(s). Accordingly, preferred demolding additives are fatty substances from the group of the fatty alcohols and fatty acid glycerides. Particularly preferred demolding additives are fatty substances from the group of the fatty alcohols and fatty acid monoglycerides. Examples of those fatty substances used with preference are glyceryl monostearate and glyceryl monopalmitate.

In order to prevent unwanted changes to the injection molding compounds, caused by oxygen exposure and other oxidative processes, these molding compounds may comprise antioxidants. To this class of compounds there belong, for example, substituted phenols, hydroquinones, pyrocatechols, and aromatic amines, and also organic sulfides, polysulfides, dithiocarbamates, phosphites, and phosphonates.

In preferred processes of the invention the material for the hollow shape, the wall thickness, and the size of the hollow shape are chosen such that the hollow body dissolves or releases the ingredients of the filling in less than 300 seconds, preferably in less than 60 seconds, in unagitated water at 20° C. It is not necessary here for the entire shaped body to dissolve spontaneously. Instead, it is sufficient if all of the constituents dissolve within the period of application under the conditions of application. For standard laundering or washing operations, this means temperatures of 20° C. and above, mechanical exposure, and times of less than 200 minutes, preferably less than 60 minutes, in particular below 20 minutes. The release of the ingredients of at least one compartment, however, should take place preferably in less than 300 seconds, in particular less than 60 seconds. This can be effected using disintegration assistants, by sealing a compartment with a thin, water-soluble film, by dissolving a "plug" which seals an aperture, or in another customary fashion.

Further details of ingredients (a) and of their division between individual compartments, and also details of the process steps (ii) and (iii), are apparent above from the remarks above.

The production of injection molded hollow bodies with the injection molding compound comprising water-soluble polymers has not hitherto been described in the prior art. The present invention therefore further provides an injection molding process for hollow bodies which comprise such polymers, i.e., a process for producing hollow bodies by injection molding, which is characterized in that the injection molding compound comprises one or more water-soluble polymers, preferably one or more materials from the group consisting of (unacetalized or acetalized) polyvinyl alcohol (PVAL), polyvinylpyrrolidone, polyethylene oxide, gelatin, cellulose, and their derivatives and mixtures thereof, with particular preference (unacetalized or acetalized) polyvinyl alcohol (PVAL).

As already described above, preference is given here to processes of the invention in which the injection molding compound comprises a polyvinyl alcohol whose degree of hydrolysis is from 70 to 100 mol %, preferably from 80 to 90 mol %, with particular preference from 81 to 89 mol %, and in particular from 82 to 88 mol %.

With regard to the molecular weight distribution as well the comments made above apply; preference is given here to processes of the invention in which the injection molding compound comprises a polyvinyl alcohol whose molecular weight is situated within the range from 10 000 to 100 000 g $mol^{-1}$, preferably front 11 000 to 90 000 g $mol^{-1}$, with particular preference from 12 000 to 80 000 g $mol^{-1}$, and in particular from 13 000 to 70 000 g $mol^{-1}$.

The processes of the invention can be conducted with particular advantage if the fraction of the water-soluble polymers in the injection molding compound is high. Preferably, the entire injection molding compound consists only of water-soluble polymers and, where appropriate, auxiliaries (see above). Preference is given here to processes of the invention in which the injection molding compound contains the polymers mentioned in amounts of at least 50% by weight, preferably of at least 70% by weight, with particular preference of at least 80% by weight, and in particular of at least 90% by weight, based in each case on the weight of the injection molding compound.

With regard to the other process parameters (pressure, temperature) and to the shaped bodies preferably produced, the remarks made above apply analogously.

In general, the dimensionally stable hollow body produced by injection molding does not have closed walls on all sides and as a result of its production is open on at least one of its sides—in the case of a spherical or elliptical body, in the region of one part of its shell. Through the aperture which remains, one or more detersive formulations is/are introduced into the compartment(s) formed in the interior of the dimensionally stable hollow body. This is done likewise in a conventional way, for example, as part of production processes which are known from the confectionery industry; also conceivable are procedures taking place over two or more steps. A single-stage procedure is especially preferred when in addition to solid formulations the intention is to incorporate formulations (dispersions or emulsions, suspensions) comprising liquid components or even formulations (foams) comprising gaseous components into the detergent portions in the hollow bodies.

In one particularly preferred embodiment of the process of the invention one or more detersive formulations is/are filled into compartments which surround one another, preferably arranged concentrically or coaxially with one another, or is/are brought into the form of compartments which are arranged concentrically or coaxially with one another or surround one another in part or in whole. These compartments, together if desired with one or more detersive formulations, are introduced into a separately produced, dimensionally stable shaped body. It is possible here for the compartments surrounding one another in part or in whole, preferably the compartments arranged concentrically or coaxially with one another, to be present in the dimensionally stable hollow body either alone or in addition to one or more other compartments filled with one or more detersive formulations.

In a final step, the dimensionally stable hollow body containing, in its interior, one or more detersive formulations in one compartment or distributed in more compartments is sealed and the formulation (s) is (are) thus sealed within its interior. This can be done—as already described above—by applying a "lid" to the still-open (nth) surface of the dimensionally stable hollow body or—in the case of spherical or elliptical hollow bodies—by applying a corresponding part-sphere shell or part-ellipse shell to the aperture. Said application may take place preferentially by adhesive bonding, preferably with a water-soluble adhesive, by melting, by welding or else by other types of joining that are known to the skilled worker.

The invention also relates, finally, to a laundering process, especially process for machine laundering in a commercially customary washing machine, which comprises the steps whereby

- a detergent portion as described above is introduced into the washing machine, especially into its rinse-in compartment or washing drum;
- the desired laundering conditions are set; and
- when the conditions came about the detersive formulation(s) of the detergent portion is (are) released into the laundering liquor and contacted with the material to be laundered.

A laundry detergent which can be used with preference in such a laundering process comprises two or more "phases", which are contained within compartments in a dimensionally stable hollow body, comprising a laundry detergent portion, in accordance with the invention. The means for compartmentalization, preferably, that is, at least one wall of each compartment, dissolves owing to the inherent properties of the material forming the respective wall, when certain parameters are set in water or in the aqueous liquor. The following "phases" may be mentioned by way of example for a laundry detergent of the invention;

Phase 1: anionic surfactants, nonionic surfactants, polycarboxylate, citrate, citric acid, phosphonates, enzymes (excluding protease);

Phase 2: sodium carbonate, alkali carriers, protease;

Phase 3: alkaline builders, zeolite, silicates, perborate, percarbonate, carboxymethylcellulose;

Phase 4: perfume, optical brighteners, soil repellent, plasticizers (incl. ester quats).

The water-solubility of the walls/compartmentalization means surrounding the phases can be set so that in each case, after a compartment has opened, from 5 to minutes elapse until the content of the next compartment is released.

Simplified forms of the laundry detergent portion can be produced by omitting phase 2 and distributing its content between phases 1 (protease) and 3 (sodium carbonate, alkali carriers), and, in a further simplification, by omitting not only phase 2 but also phase 4, adding perfume, optical brighteners, and soil repellent to phase 3, and dosing the fabric softener in a separate product.

The invention also relates to a cleaning process which comprises the steps whereby

- a detergent portion as described in detail above is introduced into the cleaning liquor;
- the desired cleaning conditions are set; and
- when the conditions come about the detersive formulation(s) of the detergent portion is (are) released into the cleaning liquor and contacted with the material to be cleaned.

The invention also relates to a washing process, especially process for machine washing in a commercially customary dishwasher, which comprises the steps whereby

- a detergent portion as described in detail above is introduced into the dishwasher, especially into its rinse-in compartment or wash chamber;
- the desired wash conditions are set; and
- when the conditions come about the detersive formulation (s) of the detergent portion is (are) released into the wash liquor and contacted with the material to be washed.

With the detergent portions in accordance with the invention the objects posed are advantageously achieved. Thus it is possible to effect spatial separation of incompatible detersive formulations or components thereof, which owing to the absence of a common contact surface are unable to enter into any reactions with one another, particularly no reaction which impairs the activity of the respective formulation. Particularly in the case of heightened concentrations of active substance, this leads to increased storage stability of the detergent portions, to an improved wash performance owing to the absence of a loss of activity, and to a saving on active substance, since the excess of active substance that was formerly used owing to the anticipated loss in activity can be omitted in the detergent portions in accordance with the invention. Furthermore, the skilled worker is presented with new formulating options, which open up for the combination of substances hitherto regarded as incompatible in detergent formulations. Because of the spatial separation of the individual components it is possible to optimize the technological functions of the individual components independently of one another, without having to be concerned about effects of the components on one another.

For the user as well there are distinct advantages. The detergent portions present in the hollow bodies comprising one or more compartments promise consistent and preformulated dosing with all of the components required or desired for the entire laundering, cleaning or washing operation. In the course of dosing there is no dusting and there is also no need to be concerned about spilling product, coming into contact with active substances, or accidents involving consumption of active substances. Dosing takes place in one step, and the solubility of the enclosure or of the hollow body material for the release of the ingredients takes place reliably in accordance with preset or predetermined kinetics, so that the laundering, cleaning or washing results improve markedly as compared with pulverulent compositions or compressed shaped bodies having the same composition but without compartmentalized separation of the components.

EXAMPLES a) Injection Molded Compartments

Polyvinyl alcohol granules (Vinex® 2019 from Texas Polymers) were melted in a hydraulic screw injection molding machine from Arburg and injected into single-cavity molds with a hot runner nozzle. In Example 1 a trochoidal shell having three corrugated intermediate walls and an edge running round was produced, in Example 2 a hemisphere having a stacking projection running round and an edge.

The mold temperature was 40° C., with demolding taking place by way of an air-assisted stripper system. Further operating parameters are summarized in Table 1:

TABLE 1

| Injection molding [process step (i)] | Example 1 | Example 2 |
|---|---|---|
| Injection pressure [bar] | 1280 | 1120 |
| Volume flow [ml/s] | 50 | 45 |
| Total cycle [s] | 13 | 13 |
| Temperature of material [° C.] | 140-160 | 140-160 |
| Wall thickness [mm] | 0.55 | 0.55 |

The shaped shells produced as described above were introduced into water and the time until they disintegrated or until they dissolved completely was measured:

| | Temperature [° C.] | | | | |
|---|---|---|---|---|---|
| | 20 | 30 | 40 | 50 | 60 |
| Disintegration after [min] | 12 | 7 | 5 | 4 | 2 |
| Complete dissolution after [min] | 18 | 11 | 8 | 6 | 4 |

Polyvinyl alcohol granules (Vinex® 2019 from Texas Polymers) were melted in a hydraulic screw injection molding machine from Arburg and injected into single-cavity molds with a hot runner nozzle, the shell having the form of a hemisphere with a stacking projection running round and an edge.

The mold temperature was 40° C., with demolding taking place by way of an air-assisted stripper system. Further operating parameters are summarized in Table 1:

TABLE 1

| Injection molding [process step (i)] | |
|---|---|
| Injection pressure [bar] | 1120 |
| Volume flow [ml/s] | 45 |
| Total cycle [s] | 13 |
| Temperature of material [° C.] | 140-160 |
| Wall thickness [mm] | 0.55 |

A half-shell was filled with a commercially customary low-water-content liquid laundry detergent (Persil® Gel, commercial product of the applicant) and sealed with a polyvinyl alcohol film from Greensol. A second half-shell was filled with an extruded heavy-duty laundry detergent containing bleach (Persil® Kegaperls®, commercial product of the applicant) and subsequently was likewise sealed with a PVAL film. The two partial hollow bodies in the closed enclosures (A) and (B) were then bonded together using cold-seal adhesive.

b) Melt Compartments

1. Production of Hollow Spheres with Bunghole:

3 g of each of the substances listed below were metered in melted form into a closable two-part mold made of heat-resistant plastic (Makrolon®), where the upper shell and lower shell each had the form of a hemisphere (radius= 1 cm), and the mold, in the closed state, was pivoted in all directions for one minute and rotated in space. Demolding produced spherical hollow bodies with wail thicknesses of between 700 and 1000 μm which could be filled with detergent through a bunghole.

| Substance | Temperature of the melt |
|---|---|
| Potassium hydrogen sulfate | 212° C. |
| Sodium hydrogen sulfate | 69° C. |
| Maleic anhydride | 63° C. |

2. Production of Hemispheres:

Coated aluminum molds with an ejector pin were filled to the top edge with the melts listed in the table below, and after a certain residence time were freed from the liquid which had not solidified by means of a 180° rotation of the mold. The hemispherical hollow bodies were then demolded and stored for further processing. In parallel, the solubilities of the shaped bodies were investigated by placing the hemispheres into a 2 liter glass beaker which was filled with one liter of distilled water at 25° C. and was agitated at rpm using a magnetic stirrer. The results of these investigations are shown by the table below:

| Substance | Casting temperature [° C.] | Residence time in the mold [s] | Wall thickness [mm] | Dissolution time [s] |
|---|---|---|---|---|
| 97% urea, 3% PEG 35000 | 145 | 5 | 1.7-2.0 | 5 |
| | 145 | 10 | 1.8-2.0 | 7 |
| | 145 | 15 | 2.1-2.3 | 10 |
| | 145 | 20 | 2.5-2.9 | 12 |
| 95% urea, 5% PEG 35000 | 145 | 5 | 1.6-1.8 | 7 |
| | 145 | 10 | 1.7-1.9 | 8 |
| | 145 | 15 | 1.8-2.0 | 15 |
| | 145 | 20 | 2.3-2.6 | 18 |
| 93% urea, 7% PEG 35000 | 145 | 5 | 1.7-1.9 | 7 |
| | 145 | 10 | 2.2-2.4 | 9 |
| | 145 | 15 | 2.9-3.1 | 15 |
| | 145 | 20 | 3.3-3.6 | 17 |

The hemispheres were filled exemplarily with a detergent composition, and sealed. The composition of the detergent was as follows:

| | |
|---|---|
| Sodium carbonate | 16.0 |
| Sodium tripolyphosphate | 71.7 |
| Sodium perborate | 5.0 |
| Tetraacetylethylenediamine | 1.25 |
| Benzotriazole | 0.5 |
| $C_{12}$ fatty alcohol containing 3 EO | 1.25 |
| Dye | 0.1 |
| Enzymes | 3.0 |
| Perfume | 0.2 |
| Silicone oil | 1.0 |

The filled hollow bodies were sealed with a polyvinyl alcohol film (type M8630, from Greensol).

The portions of the invention featured a firm bond between film and hollow body, so that there could be no loss of active substance.

The invention claimed is:

1. A process for producing a detergent portion which is contained within one or more dimensionally stable hollow bodies comprising at least two compartments and which comprises (a) at least two detersive formulations of different compositions, one of said formulations comprising bleach;

(b) at least one enclosure which wholly or partly surrounds said at least two formulations according to (a) and comprises an unpressed material which is disintegrable under laundering, cleaning or washing conditions and gives the hollow bodies dimensional stability; and (c) at least two compartments in the dimensionally stable hollow bodies;

the process comprising the steps of (i) producing the dimensionally stable hollow bodies, comprising at least two compartments, by injection moulding;

(ii) filling each of the compartments with one of at least two detersive formulations of different compositions wherein one of the formulations comprises bleach; and (iii) optionally, subsequently sealing the dimensionally stable hollow bodies to form a partial or complete enclosure around the detersive formulations.

2. The process of claim 1, wherein step (i) is conducted at a pressure of 100 to 5000 bar.

3. The process of claim 2, wherein step (i) is conducted at a pressure of 500 to 2500 bar.

4. The process of claim 3, wherein step (i) is conducted at a pressure of 750 to 1500 bar.

5. The process of claim 4, wherein step (i) is conducted at a pressure of 1000 to 1250 bar.

6. The process of claim 1, wherein step (i) is conducted at temperatures of 100 to 250° C.

7. The process of claim 6, wherein step (i) is conducted at temperatures of 120 to 200° C.

8. The process of claim 6, wherein step (i) is conducted at temperatures of 140 to 180° C.

9. The process of claim 1 wherein enclosure (b)

comprises one or more water-soluble polymers selected from the group consisting of (unacetalized or acetalized) poly vinyl alcohol (PVAL), polyvinylpyrrolidone, polyethyene oxide, gelatin, cellulose, cellulose ethers, cellulose esters, acrylic acid (co) polymers, polyacrylamides, oxazoline polymers, polystyrenesulfonates, polyurethanes, polyesters, and polyethers.

10. The process of claim 9, wherein the enclosure (b) produced in step (i) comprises one or more polymers selected from the group consisting of acrylic acid (co)polymers, polyacrylamides, oxazoline polymers, polystyrenesulfonates, polyurethanes, polyesters, and polyethers.

11. The process of claim 9, wherein the enclosure (b) produced in step (i) comprises one or more water-soluble polymers selected from the group consisting of (unacetalized or acetalized) poly vinyl alcohol (PVAL), polyvinylpyrrolidone, polyethylene oxide, gelatin, cellulose, cellulose ethers and cellulose esters.

12. The process of claim 1, wherein the dimensionally stable hollow bodies comprise two or more compartments or chambers, each of which contains one or more detersive formulations.

13. A process for producing a detergent portion which is contained within one or more dimensionally stable hollow bodies comprising at least one compartment and which comprises (a) at least one detersive formulation;

(b) at least one enclosure which wholly or partly surrounds said at least one formulation according to (a) and comprises an unpressed material which is disintegrable under laundering, cleaning or washing conditions and gives the hollow bodies dimensional stability and has wall thicknesses of 100 to 5000 μm; and (c) at least one compartment in of the dimensionally stable hollow bodies;

the process comprising the steps of (i) producing the dimensionally stable hollow bodies, comprising at least one compartment in by injection moulding;

(ii) filling the compartments with at least one detersive formulation; and (iii) optionally, subsequently sealing the dimensionally stable hollow bodies to form a partial or complete enclosure around the detersive formulations.

14. The process of claim 13, wherein the enclosure (b) produced in step (i) has wall thicknesses of 200 to 3000 μm.

15. The process of claim 14, wherein the enclosure (b) produced in step (i) has wall thicknesses of 300 to 2000 μm.

16. The process of claim 15, wherein the enclosure (b) produced in step (i) has wall thicknesses of 500 to 1500 μm.

* * * * *